US008689362B2

(12) United States Patent
Lavin

(10) Patent No.: US 8,689,362 B2
(45) Date of Patent: Apr. 8, 2014

(54) SUN PROTECTIVE NECKWEAR GARMENT

(76) Inventor: Patricia A. Lavin, Belle Harbor, NY (US)

( * ) Notice: Subject to any disclaimer, the term of this patent is extended or adjusted under 35 U.S.C. 154(b) by 59 days.

(21) Appl. No.: 13/373,950

(22) Filed: Dec. 5, 2011

(65) Prior Publication Data

US 2012/0210501 A1 Aug. 23, 2012

Related U.S. Application Data

(60) Provisional application No. 61/463,501, filed on Feb. 18, 2011.

(51) Int. Cl.
*A41D 23/00* (2006.01)

(52) U.S. Cl.
USPC ..... 2/91; 2/468

(58) Field of Classification Search
CPC .. A41D 23/00; A41D 15/007; A41D 13/0512
USPC ..... 2/69, 91, 60, 90, 130, 131, 142, 190, 2/272, 203, 207, 133, 127, 98, 1, 35, 138, 2/141.2, 147, 468
See application file for complete search history.

(56) References Cited

U.S. PATENT DOCUMENTS 4,168,543 A * 9/1979 Baker ..... 2/91
4,495,660 A * 1/1985 Hayden ..... 2/91
5,822,800 A * 10/1998 Anderson ..... 2/202
6,611,960 B2 9/2003 Kim
2007/0214542 A1 9/2007 Kim
2010/0037367 A1* 2/2010 Benderradji ..... 2/202
2012/0272429 A1* 11/2012 Porporino et al. ..... 2/69

OTHER PUBLICATIONS

REI Sunscreen Neck Gaiter—REI official website item No. 794179.

* cited by examiner

*Primary Examiner* — Khoa Huynh
*Assistant Examiner* — Khaled Annis
(74) *Attorney, Agent, or Firm* — PatentPending, PLLC; Elizabeth Reilly

(57) ABSTRACT

An ultraviolet protective garment is provided for wear to protect the user's neck, chest, upper back, chin, and portions of the shoulders. The sun protective neckwear garment is provided for wear primarily during outdoor activity, wherein the user engages in activity which exposes the user's neck, upper chest, upper back, chin, and shoulders to the ultraviolet rays of the sun whether in hot weather climate or cold weather climate, and can be used during indoor activity, or when a user is driving in a vehicle; and provides a secondary wicking utility. The neckwear garment is a single body tubular unit, with a unique generally ship decanter shape, comprising a chin-collar portion; a neck portion; bib portion having shoulder portions. The neckwear garment is manufactured from flexible, elasticized, fabric with ultraviolet blocking capability. The neckwear garment can reduce the wearer's risk of developing various types of skin damage.

16 Claims, 31 Drawing Sheets

14A

14B

15A

15B

SUN PROTECTIVE NECKWEAR GARMENT

BACKGROUND OF THE INVENTION

1. Field of the Invention

Sun Protection

This invention relates to wearing apparel, and more particularly to a neck, chin, upper chest, upper back, and shoulders sun protective neckwear garment for preventing wearers from contracting any type of skin cell damage, mutation, or skin cell change, or solar lentigines, or actinic keratosis, or skin carcinoma, or melanoma, or skin cancer, or sun burn, or sun freckles, that develop as a result of the intrusion of the ultraviolet radiation while participating primarily in outdoor physical activity, or while driving a vehicle. In addition, the sun protective neckwear garment provides a secondary utility which enables wicking of moisture and perspiration from the user. The neckwear garment can also be warn indoors by a user participating in indoor physical exercise especially if exercising near a clear glass window to prevent exposure to the sun's ultraviolet rays and to wick away perspiration.

The invention relates to garments manufactured with sun-blocking fabrics for protection against damaging sun rays for the neck, lower chin, upper chest, upper back and shoulders, and secondarily manufactured with wicking fabrics to absorb moisture from the wearer's body. In addition, the invention relates to a garment especially suitable for wearing around the neck, upper chest, upper back, and portion of the shoulders, while the wearer is participating in outdoor physical activity or driving a vehicle to protect against the sun's radiation and to wick away perspiration. The invention can also be worn by the wearer while partaking in indoor physical activity. The engineering and construction of the sun protective neckwear garment prohibits the intrusion of the ultraviolet radiation to the skin around the neck, upper chest, upper back, and portion of the shoulders. The sun protective neckwear garment not only provides the user with protection against the ultraviolet radiation of the sun, and wick perspiration, it can also provide a fashionable means to do so for athletes, sports participants, marathon runners, drivers of vehicles, or a wearer may include lifeguards, landscapers, surveyors, equestrians, snorkelers, oil riggers, as well as crossing guards, police men, firemen, and construction workers, or for any physical activity under the sun.

The sun protective neckwear garment can be made with sun-blocking or sun-protective lightweight fabrics and knits as well as recycled materials that block ultraviolet rays of the sun on the wearer's chin, neck, upper chest, portion of the shoulders and upper back to enable the prevention of skin maladies, skin cancer, brown spots, and advanced aging of the skin. A person partaking in physical activity outdoors, for example, during sunny and hot weather often requires further protecting garments to shield the neck, upper chest, upper back, shoulders, and chin, against the radiation of the sun. More particularly, when a jogger is running on a sunny day, the jogger is likely to be exposed to the damaging rays of the sun in the areas of the thin skin of the neck, upper chest, upper back and shoulders, and chin, as evidenced by sun burn and skin damage to these areas. Many garments are configured as scarves, dickeys, gaiters, loops, buffs, and mufflers, for use in cold weather to protect against cold weather and wind. The garments also fail to shield the wearer comfortably and suitably in hot weather from the sun and fail to wick moisture from the wearer's body. In addition, most garments cover the wearer's neck and face blocking the wearer's mouth but fail to shield the shoulders and upper chest of a wearer from the sun. More particularly, when the mouth of the wearer is covered this can cause increase in $CO^2$ which can cause discomfort and breathing problems for the wearer.

Ultraviolet Rays and Consequences

As mentioned above, the invention relates to the sun and more specifically, the sun's ultraviolet A (long-wave) and ultraviolet B (short-wave) rays. The invention provides for protection, when the user is outdoors, or inside while near a clear glass window, against ultraviolet A and ultraviolet B rays. Special sun-protective fabric with UPF (ultraviolet protection factor) indicate how much ultraviolet radiation can penetrate the fabric; the higher the UPF, the better. For example, a garment with UPF of 30 means that just 1/30th of the sun's ultraviolet radiation can reach the skin. Although, shielding your body with garments made with most fabrics can block the damaging rays of the sun, one can enhance your sun safety simply by learning to evaluate your outdoor activity and wearing garments manufactured from fabrics with sun protection qualities and choosing those with the best protection.

Ultraviolet radiation is part of the electromagnetic (light) spectrum that reaches the earth from sun. It has wavelengths shorter than visible light, making it invisible to the naked eye. These wavelengths are classified as UVA, UVB, or UVC, with UVA the longest of the three at 320-400 nanometers (nm, or billionths of a meter). UVA is further divided into two wave ranges, UVA I, which measures 340-400 nanometers, and UVA II which extends from 320-400 nanometers. UVB ranges from 290 to 320 nm. With even shorter rays, most UVC is absorbed by the ozone layer and does not reach the earth. Both UVA and UVB, however, penetrate the atmosphere and play an important role in conditions such as premature skin aging, eye damage (including u.v. cataracts), and skin cancers. They also suppress the immune system, reducing the body's ability to fight off these and other maladies.

The most common pre-cancer is actinic keratosis, and can be the first step leading to squamous cell carcinoma or other types of skin cancer. Actinic keratosis is slightly scaly, reddish patches that form on people with sun-damaged skin. They are precancerous growths that may change into a squamous cell carcinoma, liver spots, or "solar lentigines," are flat tan-to-brown spots that occur mainly on the face, neck, hands, and forearms. They have nothing to do with the liver. Rather, they develop as a result of aging and sun exposure. It most often appears on the bald scalp, face, ears, lips, backs of the hand, forearms, necks, and shoulders and chest, or any other areas of the body frequently exposed to the sun. Basal cell carcinoma (BCC) is the most common form of skin cancer, affecting approximately two million Americans per year. These cancers arise in the basal cells, which line the deepest layer of the epidermis or top skin layer. Almost all basal cell carcinomas occur on parts of the body excessively exposed to the sun—especially the face, ears, neck, chest, scalp, shoulders, and back. Melanoma is the most dangerous form of skin cancer. In its advanced state, it can cause serious illness and even death. Center for Disease Control most recent year for which statistics are currently available (2006) revealed 53,919 people in the United States were diagnosed with melanoma of the skin, of which 30,560 of them were men and 23,359 of them were women.

All good sun protection advice includes wearing a hat to protect against sun exposure. One of the most important reasons behind this advice is the known fact that scalp and neck cancers can be more deadly than skin cancers diagnosed elsewhere on the body. Researchers have found that although only six percent of melanoma patients present with head and neck melanomas, they account for 10 percent of melanoma deaths. Experts recommend wearing a hat with an Ultraviolet Protection Factor (UPF) of at least 50+. The brim should be at least three inches wide to protect the neck. Many hat brims are not wide enough to provide protection to the wearer's chin, neck, shoulders, upper chest, or upper back. Many people use sunblock lotions but coverage is uneven and many people are unlikely to "reapply" every two hours. Therefore, one should wear my invention, the sun protective neckwear garment for one's neck, upper chest area, upper back and neck, and chin.

Wrinkles

It has been reported that the formation of wrinkles involves changes in the elastic properties of the dermis due to the denaturation of elastic fibers. Several studies have shown that the hydration condition of the stratum corneum is also important in wrinkle formation. Scientists have investigated the relationship between the formation of wrinkles and changes in the physical properties and condition of the skin after repetitive ultraviolet B (UVB) irradiation. Repetitive UVB irradiation can cause wrinkles on the dorsal skin. UVB exposure also caused a deterioration of the fibrous ultrastructure of keratin intermediate filaments (KIFs) in the skin. Scientists have concluded that the deterioration of KIFs in the stratum corneum caused by repetitive UVB irradiation decreases the elastic properties of the stratum corneum, resulting in the formation of wrinkles. Therefore, the present invention provides a needed and probably desired means of prevention against wrinkles.

Brown Spots

Brown spots, liver spots, or "solar lentigines," are flat tan-to-brown spots that occur mainly on the face, neck, hands, and forearms. They have nothing to do with the liver. Rather, they develop as a result of aging and sun exposure. The present invention, therefore, provides a critically needed means of protection for the neck against the ultraviolet waves of the sun.

Experts recommend wearing a fabric with Ultraviolet Protection Factor (UPF) of at least 50+. The present invention may be worn instead of applying sunscreen which can irritate the user's eyes, makes the hands slippery, and should be reapplied every two hours, which is unlikely that the user will do. At the same time, the garment is manufactured with water absorbing fabric which can wick sweat and water away from the wearer's skin, so the wearer will stay cool and dry as they participate in outdoor activities.

Our understanding of exactly what kinds of damage ultraviolet rays of the sun causes to the skin, and how best to protect ourselves, seems to shift every day as new research uncovers the physiological and immunological mechanisms involved. The present invention provides a novel sun protective neckwear garment for protection against ultraviolet rays and can help all users prevent sun damage and harm to neck, lower chin, and shoulders.

Ultraviolet Blocking Fabrics

The sun protective neckwear garment is preferably manufactured using ultraviolet blocking fabric. Ultraviolet protection fabrics provide consistent and effective ultraviolet protection under all conditions. The basic science behind ultraviolet protection fabric is chemical ultraviolet inhibitors and ultraviolet blocking weave technology. To receive an ultraviolet block certification, sun protection fabrics must meet stringent industry and governmental guidelines. UVBLOCK® certified means that: The fabric has been tested for ultraviolet light transmission and it is then laundered 40 times and submitted to 100 hours of ultraviolet light once again tested for ultraviolet light transmission, then given a certified rating and labeled only fabrics tested by the International Ultraviolet Testing Laboratories are UVBLOCK® certified. The FDA regulates any fabric or garment that makes specific claims of a medical nature. FDA approved fabrics are guaranteed to reduce ultraviolet radiation by 97% or more.

An example, of an ultraviolet blocking fabric is SUNSCREEN50™ which is a medium weight, high thread count, nylon fabric with a cottony hand. It has been treated to provide a UPF50 blocking over 98% of the sun's UVA and UVB rays. It is lightweight, washable, breathable and cottony soft. It also has a durable water repellent finish to shed water.

Wicking Fabrics

Wicking fabrics are believed to aid in the transfer of moisture through absorption and transfer moisture (wicking) or a combination of both moisture management mechanisms. In addition, synthetic fabrics for the most part are hydrophobic and encourage moisture vapor and moisture to flow along, around and over but not through the synthetic fibers so as to be carried away for evaporation. This process is called "wicking." Natural fibers and some synthetic fibers are hydrophilic and draw moisture into themselves. In combinations these fibers both absorb and wick moisture away. Independently, both natural and synthetic fibers encourage the movement of moisture vapor. Many of these nonwoven fibers may be chemically modified to increase their moisture transfer characteristics with wicking or ionized solutions.

The sun protective neckwear garment can be constructed for different embodiments using specific fabrics possessing certain desired characteristics of combined ultraviolet blocking capabilities and wicking capabilities. A choice of fabrics can be employed depending upon the individual needs of their application as well as the individual needs of each wearer. Fabrics with wicking capabilities are mentioned, below.

"WICKAWAYS™" are a class of fabrics that provide great moisture control. They move perspiration away from the body to the fabric's outer surface where it can evaporate. WICKAWAYS™ are soft, lightweight and breathable. These knit WICKAWAY™ fabrics do have elasticity and may be used to manufacture the sun protective neckwear garment woven as a seamless single body unit as embodied in the present invention and are successful in providing a means to keep the wearer's skin cool and dry while participating in physical activity, for example, running, cycling, golfing, walking, playing sports, or driving a vehicle.

Lycra WICKAWAY™ fabrics do have lots of stretch and may be used to manufacture the sun protective neckwear garments woven in a seamless single body unit that provides further and resiliency and elasticity such that the neck garment may be securely pulled up around the wearer's neck and chin, disposed upon the wearer's upper chest, shoulders, and upper back, while a wearer is running, exercising, cycling, etc., or driving a vehicle, or for any physical activity, where the neckwear garment provides a means to keep the wearer's skin protected against the damaging rays of the sun and simultaneously, keep the wearer's skin as cool and dry as possible.

In addition, the present invention can be manufactured using a fabric with ILLUMINITE™ technology which provides a significant improvement to the existing retro-reflective trim (piping, etc) as it dramatically improves the speed and accuracy by which a motorist can recognize a person who is jogging, walking, or participating in sports at night. The ILLUMINITE™ retroreflective technology embeds millions of microscopic satellite dishes into the weave of the fabric. These dishes act like mirrors to reflect back to the original light source. ILLUMINITE™ strategically create silhouette reflectivity on the wearer through the design expertise, all of the while maintaining fashion and performance.

Promotional Garment

Recognition, awareness, and support are raised for a particular cause, charitable organization, or non-profit organization, or sports team, or sports league, or amateur sports team or sports affiliation, Nascar, or medical needs group, or commercial entity, or military organization, or public figure, or personal figure, or a media event, or public event, or personal event, animals, holidays, a college, a university, a high school, an automobile racing series, or an automobile racing team, or churches, or clubs, or companies, or departments, or political parties, or candidates and issues, or interest groups and causes, and the like, through display of specific logos, marks, indicia, monikers, embellishments, or inspirational or motivational slogans, ribbons, buttons, mascots, team logos, team colors, images, names, symbols, embroidery, or other decorations or promotional images or messages, or special timely messages. The sun protective neckwear garment can be affixed with such promotional embellishments or logos for display, and to create awareness, interest, and funds for charities, special interest groups, sports teams, and the like, as mentioned above.

Welding

Conventionally, seams are formed by sewing. Alternatively, seams may be formed by technology consisting of welding. Welded seams create a clean finish on both the exterior and interior surfaces of the garment increasing the streamlined characteristics of the neckwear garment. Welded seams, also, provide greater compressibility and improved wet-weather performance than traditionally sewn seams. Welding provides a method which eliminates thread decay and adds to the fine appearance of the garment.

Fabric welding is the process of joining pieces of fabrics using heat and pressure. Thermoplastic coatings, such as polyvinylchloride (PVC), polyurethane (PU), polyethylene fabric (PE), and polypropylene (PP) are used for heat sealing. Fabric welding reduces maintenance cost as there is no need of threads, sewing machines, seam tapes or any other such materials. There are generally two basic types of fabric welding: (1) Dielectric Welding; (2) Rotary Welding. They are further categorized into many types of welding of which five are mostly used by those skilled in the art: (i) Water Resistant; (ii) Hot Air Welding; (iii) Hot Wedge Welding; (iv) Radio Frequency Welding; (v) Ultra Sonic Welding. Hot Air, Hot Wedge, and Ultra Sonic Welding are generally categorized as rotary welding. In this type, the fabric moves continuously through the machine while it is being welded. Radio frequency welders are a stamping type machine. The fabric pieces don't move but are held in place while they are being welded.

Dielectric welding includes a method wherein a dye is lowered onto the fabric pieces that are supported by an underlying base plate. A time pulse of radio frequency energy is sent between the die and the base plate. The fabric between the die and base plate gets heated enough so as to melt the thermoplastic coating on a temporary basis. Upon the melting of this coating, both pieces of fabric are fused together. The die is then lifted and new pieces of fabric move into position, and the whole process is repeated again.

Rotary welding is faster than dielectric welding. The speed increases with the length of the products and seams. Welding speeds of up to 20 feet per minute and even higher can be achieved through it. It is also capable of producing three dimensional finished products. As dielectric welding uses flat base plate, it restricts its application to the products whose seams must lie flat during the sealing process. Currently technology has provided certain specialized dielectric welders having three dimensional dies, base plates, and vacuum systems for holding the fabric pieces in position while the dies are applied.

Hot air welding is a faster welding process than the hot wedge welding. In wedge welding, a small metal wedge is used to deliver heat to the fabric immediately before it passes between the drive wheels where pressure is applied to seal the fabric together. In hot air welding, a hot air nozzle instead of a metal wedge is used to deliver heat. Wedge welding is more suitable for welding generally simple products that are made from fabrics having regular and smooth surfaces. Hot air welding can be used for fabrics having more advanced designs and textured fabrics.

Sonic welding, reinforced with thin mesh and backed by flexible tapes, provides a method which minimizes weight, speeds dry time and reduces abrasion of the fabric.

Glued seams use a lap-gluing technique which improves speed dry times and reduces bulk in the fabric.

2. Description of the Prior Art

Various protective neck garments are known in the prior art; such prior art protective garments have included scarves, buffs, gaiters, cowls, balaclavas, neck warmers, socks, mufflers, portions of sweaters and/or jackets, and/or the like. While these prior art protective neck garments have provided some protection to the cold, wind, and other environmental elements, they have not been totally satisfactory to providing a lightweight, elastic, resilient, neckwear which provides protection against the sun's ultraviolet rays while a wearer is participating in physical activity, or while driving in a car, in hot climates. The garments described in the prior art usually involved garments for cold climates, which were non-continuous, were not light flexible and light weight, and thus allowed skin to be exposed to ultraviolet waves of the sun, or the garments restricted the wearer's mobility, or the garments lacked comfort and/or the garments were irritating to the wearer's neck. In addition, the prior art protective neck garments do not provide wicking properties to wick perspiration, sweat, or moisture from the body of the wearer.

More particularly, there are no versatile sun protective neckwear garments available that are provided for use by the wearer while participating in physical activity, sports, or while driving a car. There are currently a number of different types of apparel worn around the neck but manufactured with materials to insulate the wearer from cold weather and not for hot weather when the wearer is engaged in physical activity and exposed to the damaging radiation of the sun. More particularly, current neck garments are manufactured with wool and typically use excess material, which can present a safety hazard to a wearer participating in physical activity. Many of the current neck garments cover the wearer's mouth and therefore increase the amount of carbon dioxide a user may inhale and exhale while jogging, or bicycling, or participating in physical activities. Other types of neck garments are bulky, uncomfortable, itchy, and may be awkward to use. Other neck garments do not include elasticity and therefore flop up and down while the wearer is exercising. In addition, in today's world there is a deep consciousness of the damaging radiation of the sun and the risks of skin cancer. There is an ongoing critical need for a neck garment to protect a wearer from the rays of the sun, more particularly, to protect the thin skin of the neck, the upper chest, upper back, and shoulders. In addition, there is an ongoing need for a lightweight, breathable, wicking garment to absorb moisture, perspiration, and sweat from the wearer's body.

What is needed is my sun protective neckwear garment which protects the neck, upper chest, upper back, shoulders and, if needed and desired, the chin of the wearer that is manufactured from a lightweight, breathable, elasticized, stretchable, resilient material woven in a seamless single body unit that hugs the wearer's neck, and covers the upper chest, upper back and portion of the shoulders, that protects the skin in these sensitive areas against the sun's radiation. Secondarily, the sun protective neckwear garment can wick moisture from the neck, upper chest, upper back, and shoulders, and if needed or desired the chin of the wearer. My novel sun protective neckwear garment can be easily donned on the wearer and pulled off a wearer; is reversible; and easily transportable to be placed into the wearer's pocket, purse, backpack, sports bag, or any storage item. The sun protective neckwear garment of the type described is relatively simple and inexpensive to manufacture. In addition, the neckwear garment is simple to maintain where it is washable. In addition, the neck garment can provide a pocket as a carrying means for small items, a loop to hang the garment or for aesthetics, and a neck garment with utility as a sports garment, or as a decorative garment, and/or as a promotional garment.

SUMMARY OF THE INVENTION

In accordance with the preferred embodiment of the present invention, the principal object of the present invention is to provide a comfortable, lightweight, breathable, portable, elasticized, single tubular body sun protective neckwear garment having a generally ship decanter shape, that is worn around the wearer's neck, over the wearer's upper chest, upper back, and portion of the shoulders, to provide a means to protect the wearer's neck, upper chest, upper back, portion of the shoulders, and if needed or desired chin, from the sun's radiation while the wearer is outdoors, or indoors, or the wearer is participating in activities in cold or hot weather, while the wearer is partaking in physical outdoor activities or indoor activities, such as jogging, bicycling, golfing, playing sports, playing soccer, playing rugby, football, baseball, basketball, skiing, snowboarding, cross country skiing, snowmobiling, jet skiing, water skiing, surfing, sand dune mobiling, walking, walking along the beach, standing on the beach, hiking, skateboarding, marathons, walkathons, bikeathons, gardening, or while exercising near a clear glass window, or when driving a vehicle, such as a car, cab, truck, boat, golf cart, all-terrain vehicle, or while sitting on a chair-lift, and/or the like. Secondarily, it is an object of the present invention, to provide a means to wick sweat and perspiration from the wearer's neck, upper chest, upper back, shoulders, and chin.

A protective sun protective neckwear protection garment is provided for wear primarily during outdoor activity, which surrounds the wearer's neck, if needed chin, overlies the wearer's chest and upper back, and extends across the wearer's shoulders. The sun protective neckwear garment is a single tubular body having a generally ship decanter shape, having a front side and a back side substantially identical, which includes a top opening and a bottom opening bounded by two biconcave sides having generally crescent shapes. The bottom of the sun protective neckwear garment includes an opening and configured such that the bottom opening is larger in diameter than the opening configured at the top of the garment and includes a narrower generally tubular neck to enable the wearer to easily don the neck garment on and off and at the same time maintain the neck garment snugly around the wearer's neck, and comfortably cover the wearer's shoulders, upper chest, and upper back to primarily protect the wearer's chin, neck, portion of the shoulders, front upper chest, and upper back, from the sun's rays.

A sun protective neckwear garment is provided for wear when participating in activities when a user is primarily outdoors and at risk of being exposed to the sun, whether in either hot weather climate, or cold weather climate, and/or during indoor activity, when the user is at risk of being exposed to the sun while exercising near a clear glass window, or when a user is driving in a vehicle, car, bus, boat, golf cart, or riding a chair-lift or ski-lift. The garment can be worn by anyone and everyone under the sun and is particularly useful for participants of outdoor activities when the sun is apparent, and the harmful ultraviolet rays can be invasive and potentially hazardous. The protective neckwear garment is versatile to protect a user primarily against the ultraviolet waves of the sun, and secondarily, wicks away perspiration while the user is participating in outdoor physical activity. In addition, the neckwear garment can also be used while the wearer is exercising on an indoor physical exercise device, for example, treadmill, rowing machine, indoor-bicycle, and elliptical machine when the user is in close proximity to a glass window, or skylight, and the sun is apparent.

The novel neckwear garment is preferably of one single continuous unit, with a unique generally tubular shape having a ship decanter shape. The resiliently stretchable ship decanter tubular body comprising top chin-collar portion; generally tubular neck portion; bottom bib portion; and right and left shoulder portions configured to extend laterally across a portion of the shoulders of the user, having a contoured thickness of predetermined form and ultraviolet blocking capability, and absorbency capability, of predetermined levels. The neckwear garment is preferably stretchable, resilient, and not rigid, or coarse, as to allow the wearer ease of entry and use to pull the garment on and off over the wearer's head and to retract to conform to the wearer's neck, chest bone, and shoulder slope. The neckwear garment provides coverage around the user's neck, chin, chest, and shoulder, while in use, at the same time permitting substantially unrestricted physical activity and no irritation. The sun protective neckwear garment's top chin-collar portion preferably extends up along the wearer's chin; the tubular neck portion preferably snugs the wearer's neck comfortably; the bib portion extends over the wearer's upper chest area and upper back; while the shoulder portion laterally extends slightly over the shoulder slope of the user.

The sun protective neckwear garment can be manufactured preferably from fabric with ultraviolet blocking capability to protect the wearer's chin, neck, and shoulders from the sun's UVA and UVB rays. In addition, the garment can be manufactured from fabric with water absorbing capability, or wicking, to enable the absorption of the wearer's sweat. The ultraviolet protection neckwear garment can effectively block a user's exposure to harmful ultraviolet waves of the sun and reduce the wearer's risk of developing any type of skin damage or skin carcinomas, skin melanomas, skin cancers, or any skin maladies related to invasive ultraviolet radiation from the sun.

The neckwear garment can also be worn by a driver of a vehicle, car, cab, boat, bus, golf cart, all terrain-vehicle, and/or the like, who at times and even long periods of time is exposed to intense rays of the sun as they pass through the glass of the windshield of the vehicle. The neck garment can also be worn while the wearer is partaking in indoor physical activities, especially if the user is partaking in physical exercise near a clear glass window or sky light through which harmful ultraviolet rays can pass through.

The upper chin-collar of the neckwear garment is configured with a predetermined height and width and is also made with stretchable textile, fabric, or material, which allows the wearer enough flexibility to change the manner in which the garment is being worn so that the collar can extend and stretch securely over a wearer's chin such that the upper chin-collar portion of the neckwear garment overlies the bottom portion of the chin and beneath the wearer's mouth, or the chin-collar of the neckwear garment can be a turndown style and lay under the wearer's neck.

The sun protective neckwear garment can be manufactured preferably with sun-blocking fabrics (supporting the FDA recommendations to protect the skin), wicking fabrics, or any lightweight fabrics, and knits, as well as recycled fabrics, that block ultraviolet rays of the sun from targeting the wearer's chin, neck, portion of the shoulders, upper chest, and upper back. It is also preferred that the neckwear garment are made from fabrics which are lightweight, resilient, breathable, washable, durable after many washings, elastic and retain shape after stretching.

The garment can be manufactured with various fabrics and materials including ultraviolet blocking properties including various colors and patterns including solid colors, patterns, tie-dyes, silk screens, stripes, checks, geometric patterns of circles, squares, triangles, rectangles, hexagons, pentagons, octagons, diamonds, paisleys, zigzags, and freehand splashes and designs, cartoon characters, amusement theme park characters, photos, statements, comic strip characters, super hero characters, graphics, monikers, artistic designs, marks, trademarks, and any design which is imbedded within the selected fabric of choice to manufacture the neckwear garment.

In addition, the sun protective neckwear garment can be manufactured with textiles, fabrics, or materials, that contain within or contain affixed thereon, display of promotional embellishments or decorations, specific logos, marks, indicia, monikers, embellishments, or inspirational or motivational slogans, ribbons, buttons, mascots, team logos, team colors, images, names, symbols, embroidery, or other decorations or promotional images or messages, or special timely messages which raise recognition, awareness, support, or funds, for a particular cause, charitable organization, or non-profit organization, or sports team, or sports league, or amateur sports team or sports affiliation, Nascar, or medical needs group, or commercial entity, or military organization, or public figure, or personal figure, or a media event, or public event, or personal event, animals, holidays, a college, a university, a high school, an automobile racing series, or an automobile racing team, or churches, or clubs, or companies, or departments, or political parties, or candidates and issues, or interest groups and causes, and the like.

In another embodiment, the sun protective garment is made with fabric that is not imbedded with sun-blocking threads or yarn, where the fabric inherently provides a means to block the damaging rays of the sun and maintains the spirit and usefulness of the neckwear garment according to the embodiments of the present invention. The sun protective neckwear garment can be manufactured woven as a single continuous tubular body having a ship decanter shape with materials having a combination of ultraviolet blocking capabilities, water wicking capabilities, and resilient elasticity that is comfortable, lightweight, not bulky and does not interfere with the activity of the wearer. It is preferred, that the garment be manufactured using fabrics and knits that range in thickness from 0.1 mm to 10 mm.

The sun protective neckwear garment has many advantages over prior garments worn about the neck, shoulders, upper chest, upper back, and chin, where my invention is lightweight, breathable, easily removable, does not cover the wearer's mouth, fashionable, transportable, simple and inexpensive to manufacture, and easily stored in one's pocket, purse, sports bag, and the like, when not in use.

The sun protective neckwear garment of the present invention is configured and manufactured to be very versatile. For that purpose, the neckwear garment, in another embodiment, is constructed having a vertical medial split. The fabric ends created by the split can be affixed with fastening means to form a sun protective neckwear garment that is removably fastenable when worn. The split feature permits the wearer to put the sun protective neckwear garment on and off, without requiring the neck garment to pass over the wearer's head.

In another embodiment, the sun protective neckwear garment is manufactured with two sheets of fabric, each having a generally ship decanter shape, and therewith the two sheets of fabric are affixed at the two biconcave sides to form a continuous tubular body having a generally ship decanter shape. In addition, the second sheet includes a vertical marginal split having fastening means to form a removably fastenable neckwear garment, as mentioned above.

In another embodiment of the present invention, the bib portion is increased in length such that the neckwear garment provides more coverage to the wearer's chest and back.

In another embodiment of the present invention, the front bib portion is configured such that the bottom fabric edge is drawn to an apex; and the back bib portion is configured with a convex fabric edge, and further the front bib side is configured with a longer length than the rear bib side.

The present invention accomplishes its objects by providing a sun protective neckwear garment formed of a single tubular piece of fabric having a generally ship decanter shape. The fabric formed is elasticized, resilient, lightweight, flexible, having ultraviolet blocking capabilities, manufactured preferably with yarn, or thread, on circular sewing machines, or a double needle-bar raschel knitting machines for producing seamless garments for example, a SANTONI, or a knitting machine supplied by KARL MAYER, or by LIBA, double needle bar warp knitting, double needle bar raschel machines, or any circular knitting machines for seamless garments.

The principal object of the present invention is to provide a single tubular body, one size-fits-all, sun protective neckwear garment which provides a means to protect the wearer's neck, chin, upper chest, upper back, and portion of the shoulders, from the damaging effects of the sun's radiation, and make sun protection part of a user's daily routine. Secondarily, the neckwear garment provides a means to wick sweat and perspiration from a wearer's body.

Another object of the present invention is to provide a garment which is simple and inexpensive to manufacture.

Another object of the present invention, in the preferred embodiment, is to provide a garment manufactured as a single body unit which can be easily put on and removed by the wearer without any cumbersome fastening means.

Another object of the present invention is to provide a neckwear garment which can be quickly and easily maneuvered so that the neckwear garment can be easily worn under the chin, and readily stretched to be worn over the chin. The wearer should be able to easily change the position of the chin-collar portion while wearing it, and without the need to remove the garment.

Another object of the present invention is to provide a neckwear garment that does not cover the wearer's mouth or nose.

Another object of the present invention is to provide a neckwear garment that is lightweight, compact, and easily foldable, to place in a wearer's pocket, purse, backpack, handbag, or any storage item.

Another object of the present invention is to provide a neckwear garment with a hook loop which further comprises a support means for hanging the neckwear garment, of for holding sunglasses, or other items.

Another object of the present invention is to provide a neckwear garment which further comprises a pocket means to retain personal identification, keys, money, jewelry, but not limited to.

Another object of the present invention is to provide a neckwear garment that is sporty, fashionable, aesthetically pleasing, and compliments other garments worn by the wearer, so that, it becomes an integral component of the overall outfit, without compromising the neckwear garment or the wearer's overall outfit.

Another object of the present invention is to provide a neckwear garment that further comprises embellishments, or indicia, or decorations, or promotional designs, associated with a specific cause, secured to the sun protective neckwear garment that provide a means to raise funds, awareness, and interest in the specific cause, school sport's team booster organization, a charitable organization, or non-profit organization, a geographical location, a social service organization, medical needs group, or special needs group, a sports team, or amateur sports team, and other entities, for example, the Alzheimer's Association. In addition, money is raised for the selected specific cause by selling my new and unique sun protective neckwear garment and donate back to the selected specific cause.

Another object of the present invention is to provide a neckwear garment that is interchangeable among garments or apparel, but does not comprise the garment or apparel itself, therefore, maintaining the original integrity of the garment and overcoming the burden and financial expense of acquiring a variety of garments which display a logo or decoration of an individual's favorite sport or charitable organization or favorite entity.

Skin cancer can develop in anyone, therefore anyone can use the sun protective neckwear garment provided by the present invention to prevent the interloping ultraviolet rays of the sun and prohibit the development of malevolent skin disorders, from forming on the neck, chin, upper chest, upper back, and portions of the shoulders.

Notwithstanding long term damage and health hazards from the sun's rays, people often distress over damaged, tanned and aging skin, around the neck, upper chest, upper back, shoulders, and chin, due to the ultraviolet sun exposure while participating in outdoor activities and while driving vehicles. More than likely, consumers invest thousands of dollars in products to repair cellular sun damaged skin, for example, expensive cosmetic lotions, serums, creams, injections, or cosmetic surgery. Some of these temporary cosmetic remedies are successful, but many are not successful. The sun protective neckwear garment presented here, is the novel, useful, inexpensive remedy to this problem. The present invention is easily manufactured and can be manufactured at economically affordable costs.

In addition to the ultraviolet sun blocking utility and prevention of skin disorders, the sun protective neckwear garment provides a secondary utility which enables wicking of moisture and perspiration from the user. The neck garment can also be warn indoors by a user participating in indoor physical exercise especially if exercising near a clear glass window, or skylight, to prevent exposure to the sun's ultraviolet rays and to wick away perspiration.

In addition, a third utility of the present invention provides a convenient transportable protective neck garment that is light weight, breathable, comfortable, resilient, soft, foldable, easy to store and easy to wear. Furthermore, the present invention provides a decorative protective garment for the neck, upper chest, upper back, chin, and shoulders which can be worn and compliment the user's clothes. The present invention provides a means to promote interest and contributions to charitable causes. The sun protective neckwear provides a comfortable, breathable, garment to be worn by a patient who has undergone dermatological procedures at the site of the neck, chin, upper chest, upper back, or portion of the shoulder.

Other objects, advantages, benefits, and features of the invention will become apparent to those skilled in the art, when the following descriptions of an example of the best modes contemplated for practicing the invention is read in conjunction with the accompanying drawings.

BRIEF DESCRIPTION OF THE DRAWINGS

The accompanying drawings, which are incorporated herein and form part of the specification, illustrate various embodiments of the present invention and together with the description, further serve to explain the principles of the invention and to enable a person skilled in the pertinent art to make the invention. In the drawings, like reference numbers indicate identical or functional similar elements. A more complete appreciation of the invention and many of the attendant advantages thereof will be readily obtained as the same becomes better understood by reference to the following detailed description when considered in connection with the accompanying drawings, wherein:

FIGS. 15A and 15 B are illustrations of the sun protective neckwear in use worn by users while driving in a car seen in FIG. 15A to protect against the sun; the sun protective neckwear in use worn by a user while driving in a truck seen in FIG. 15B to protect against the sun.

DICTIONARY

Arcuately—bent like a bow, curved

Figure 1:
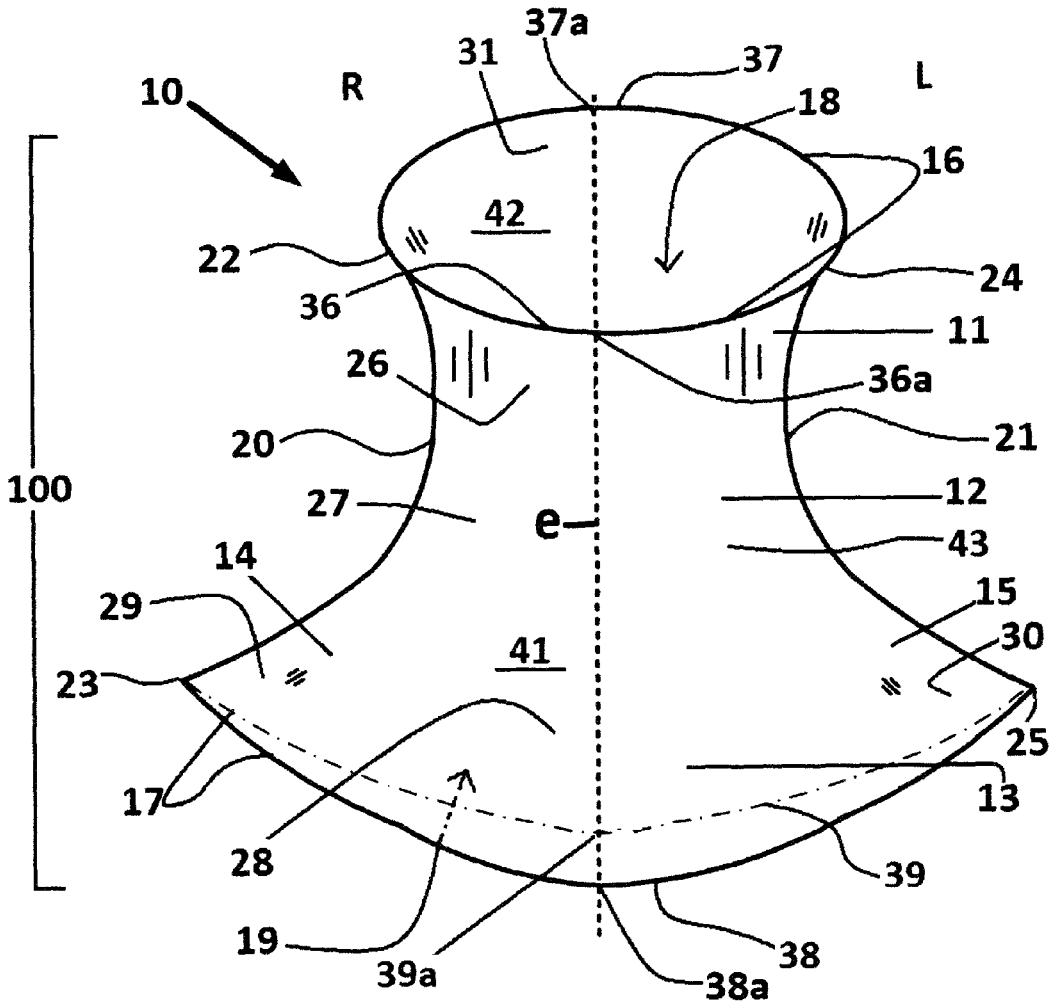
FIG. 1 is an elevation view of a sun protective neckwear garment from a front perspective according to the preferred embodiment of the present invention.

Circumferential—the border or outer boundary of a two-dimensional figure, especially a circular area; the length of such a boundary; a line bounding or marking off an area.

Laterally—left side and right side; of or pertaining to the side; situated at, proceeding from, or directed to a side.

Longitudinal—of or pertaining to length

Embellishments—decorations, ribbons, studs, logos, marks, indicia, monikers, jewels, or inspirational or motivational slogans, ribbons, buttons, mascots, team logos, team colors, images, names, symbols, embroidery, or other decorations or promotional images or messages, or special timely messages.

Fabric—Fabric can be material, woven fabric, woven material.

Tubular—a hollow, usually generalized cylindrical body; generalized cylinder wherein the cross-section can be any curve.

Welding—Fabric welding is the process of joining pieces of fabrics using heat and pressure, as described in Background of the Invention above.

NUMBERS

10—Sun protective neckwear garment
11—Chin collar portion
12—Tubular neck portion
13—Bib portion
14—Right shoulder portion
15—Left shoulder portion
16—Circumferential top straight fabric edge
17—Circumferential bottom convex fabric edge

18—Top opening
19—Bottom opening
20—Right concave side
21—Left concave side
22—Right top end point
23—Right bottom end point
24—Left top end point
25—Left bottom end point
26—Front chin-collar portion
27—Front tubular neck portion
28—Front bib portion
29—Front right shoulder portion
30—Front left shoulder portion
31—Back chin-collar portion
32—Back tubular neck portion
33—Back bib portion
34—Back right shoulder portion
35—Back left shoulder portion
36—Front top straight fabric edge
36*a*—Front top midpoint
37—Back top straight fabric edge
37*a*—Back top midpoint
38—Front bottom convex fabric edge
38*a*—Front bottom midpoint and most convex front bottom fabric edge, back bottom midpoint and most convex back bottom fabric edge
(e)—Front medial axis
(e')—Back medial axis
39—Back bottom convex fabric edge
40—Scoop version sun protective neckwear garment
41—Exterior surface of sun protective neckwear garment
42—Interior surface of sun protective neckwear garment
43—Front side of sun protective neckwear garment
44—Back side of sun protective neckwear garment
45—Reinforcement elastic patch for chin
46—Zipper
47—VELCRO®
48—Buttons
48'—Button holes
49—Snaps
50—V-shaped embodiment of sun protective neckwear garment
51—Front V-shaped bib portion
52—V-shaped bottom fabric edge
53—Apex of V-shaped fabric edge
54—Back convex fabric edge of V-shaped embodiment sun protective neckwear garment
55—Chin-collar portion of V-shaped embodiment sun protective neckwear garment
56—Tubular neck portion of V-shaped sun protective neckwear garment
57—Circumferential bottom V-convex fabric edge
58—Front side of V-shaped sun protective neckwear garment
59—Back side of V-shaped neckwear protective neckwear garment
60—Circumferential top straight fabric edge of V-shaped sun protective neckwear garment
61—Front top straight fabric edge of V-shaped sun protective neckwear garment
62—Back top straight fabric edge of V-shaped sun protective neckwear garment
63—Front chin collar portion of V-shaped sun protective neckwear garment
64—Back chin collar portion of V-shaped sun protective neckwear garment
65—Front tubular neck portion
66—Back tubular neck portion
67—Right concave side of V-shaped sun protective neckwear garment
68—Left concave side of V-shaped sun protective neckwear garment
69—Back bib portion of V-shaped sun protective neckwear garment
70—Top opening of V-shaped sun protective neckwear garment
71—Bottom opening of V-shaped sun protective neckwear garment
72—Right top end point of V-shaped sun protective neckwear garment
73—Left top end point of V-shaped sun protective neckwear garment
74—Right bottom end point of V-shaped sun protective neckwear garment
75—Left bottom end point of V-shaped sun protective neckwear garment
76—Right shoulder portion of V-shaped sun protective neckwear garment
77—Left shoulder portion of V-shaped sun protective neckwear garment
78—Bib portion of V-shaped sun protective neckwear garment
79—Front right shoulder portion of V-shaped sun protective neckwear garment
80—Front left shoulder portion of V-shaped sun protective neckwear garment
81—Back right shoulder portion of V-shaped sun protective neckwear garment
82—Back left shoulder portion of V-shaped sun protective neckwear garment
83—Exterior surface of V-shaped sun protective neckwear garment
84—Interior surface of V-shaped sun protective neckwear garment
85—Split in back side of sun protective neckwear garment (10)
86—First end
87—Second end
88—First end marginal edge
89—Second end marginal edge
90—Seamed sun protective neckwear garment
91—First sheet of fabric having ship decanter shape
92—Second sheet of fabric having ship decanter shape
93—Top straight fabric edge of first sheet of fabric
93'—Top straight fabric edge of second sheet of fabric
94—Bottom convex fabric edge of first sheet of fabric
94'—Bottom convex fabric edge of second sheet of fabric
95—Right concave fabric edge of first sheet
95'—Right concave fabric edge of second sheet
96—Left concave fabric edge of first sheet
96'—Left concave fabric edge of second sheet
97—Right concave marginal edge of first sheet
97'—Right concave marginal edge of second sheet
98—Left concave marginal edge of first sheet
98'—Left concave marginal edge of second sheet
99—Right stitched seam
100—Ship decanter shape
101—V-shaped ship decanter shape
102—Left stitched seam
103—Top opening of seamed sun protective neckwear garment
104—Bottom opening of seamed sun protective neckwear garment
105—Right seamed concave side
106—Left seamed concave side

107—Seamed continuous single tubular ship decanter shaped body
108—Zipper handle
109—Purple Alzheimers Ribbon
110—Front side of seamed sun protective neckwear garment
111—Back side of seamed sun protective neckwear garment
112—Chin-collar portion of seamed sun protective neckwear garment
113—Tubular neck portion of seamed sun protective neckwear garment
114—Bib portion of seamed sun protective neckwear garment
115—Right shoulder portion of seamed sun protective neckwear garment
116—Left shoulder portion of seamed sun protective neckwear garment
117—Right top end point first sheet of fabric
117'—Right top end point of second sheet of fabric
118—Left top end point of first sheet of fabric
118'—Left top end point of second sheet of fabric
119—Right bottom end point of first sheet of fabric
119'—Right bottom end point of second sheet of fabric
120—Left bottom end point of first sheet of fabric
120'—Left bottom end point of second sheet of fabric
121—Circumferential top straight fabric edge of seamed sun protective neckwear garment
122—Circumferential bottom convex fabric edge of seamed sun protective neckwear garment
123—Fastening means
124—Corresponding fastening means
125—Hooks of hook and eye fastening means
126—Eyes corresponding to hooks of hook and eye fastening means
127—First longitudinal edge of zipper
128—Second longitudinal edge of zipper
129—Hook loop
130—First end of hook loop
131—Second end of hook loop
132—Sunglasses
133—Hidden pocket
134—Cavity of hidden pocket
135—Credit card
136—Diamond heart embellishment
137—Exterior surface seamed sun protective neckwear garment
138—Interior surface seamed sun protective neckwear garment
150—Split sun protective neckwear blank—providing sun protective neckwear garment 10 further including vertical medial split
160—Buttoned split sun protective neckwear garment
170—Snapped split sun protective neckwear garment
180—Hook and eyes split sun protective neckwear garment
190—Loop sun protective neckwear garment
200—VELCRO@ split sun protective neckwear garment
210—Pocket sun protective neckwear garment
220—Alzheimers ribbon sun protective neckwear garment
230—Diamond embellishment sun protective neckwear garment

DETAILED DESCRIPTION OF THE INVENTION

The following detailed description of the preferred embodiment and other aspects of the present invention is undertaken in connection with the drawings. This description, while undertaken with respect to the disclosed embodiments, is intended to enable a variety of different applications and slight modifications which form a part of the present invention. More specifically, many of the materials used in this neck garment have been developed relatively recently, and in many cases are still being modified and improved. Where possible, trade names of specific products have been used to assist in the understanding of the invention. The neck garment according to the present invention can be easily adapted to accommodate further developments and improvements in these materials. The preferred embodiments currently envisioned are set forth below.

As described and illustrated below, it is for illustrative purposes only, the drawings are shown such that the portions within the sun protective neckwear garment 10 meet along common lines as seen in FIGS. 1-9. The four portions seamlessly integrally formed including the chin-collar portion 11, the tubular neck portion 12, the bib portion 13 comprising therein the two laterally opposing right shoulder 14 and left shoulder portion 15; and include a top opening 18 and bottom opening 19; such that there are no clear lines of demarcation corresponding to the dotted lines L1-L2 in FIG. 2; such that there are no clear lines of demarcation corresponding to the dotted lines L3-L6 in FIG. 3 such that there are no clear lines of demarcation corresponding to the lines a-g and a'-g' in FIGS. 16 and 17; among the chin-collar portions 11, tubular neck portions 12, shoulder portions 14 and 15, and bib portion 13; and front side 43 and back side 44 therein. The novel sun protective neckwear 10 can be manufactured with elasticized, resilient, flexible, fabric, textile, or material, preferably having a contoured thickness of predetermined form and ultraviolet blocking capability, and absorbency capability, of predetermined levels to provide protection against the ultraviolet rays of the sun to a wearer's neck, chin, upper chest, upper back, and portion of the shoulders.

Figure 2:
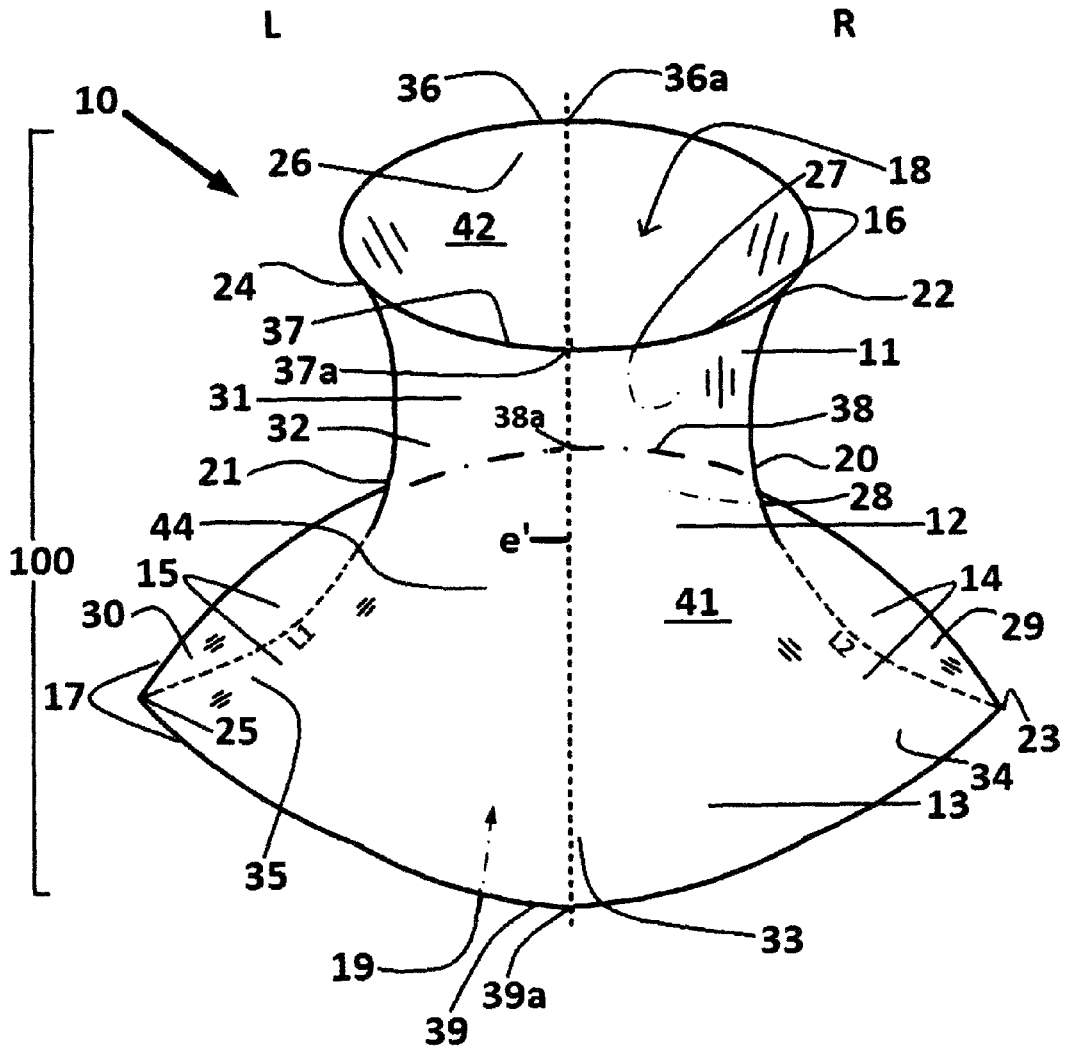
FIG. 2 is an isometric view from a rear perspective of the sun protective neckwear garment shown in FIG. 1.

Referring now to the drawings, FIG. 1 illustrates an elevation view of the sun protective neckwear garment 10 according to the preferred embodiment of the present invention. FIG. 2 is an isometric view of sun protective neckwear garment 10 from the rear perspective of the sun protective garment 10. As illustrated in FIGS. 1 and 2, the sun protective neckwear garment 10 has a generally tubular body having a ship decanter shape 100 having a front side 43 substantially identical with a back side 44 continuously integrally seamlessly formed; further having an exterior surface 41 substantially identical to an interior surface 42. More particularly, FIGS. 1 and 2, shows the sun protective neckwear garment 10, includes a horizontally aligned circumferential top straight fabric edge 16 defining the top opening 18 of the neckwear garment 10, and a generally parallel horizontally aligned bottom circumferential bottom convex fabric edge 17 defining the larger bottom opening 19 of the neckwear garment 10; and top opening 18 and larger bottom opening 19 joined by two laterally opposing generally parallel substantially identical vertically aligned concave sides 20 and 21, a right concave side 20 and a left concave side 21, having a generally C-shape, and therewith provide the unique generally tubular ship decanter shape 100 of the sun protective neckwear garment 10 of the present invention. Further, FIGS. 1 and 2 shows the front straight fabric edge 36 continuous with the back straight fabric edge 37 therewith to form the top circumferential fabric edge 16; and FIG. 1 shows the front convex fabric edge 38 is continuous with the back convex fabric edge 39 shown in phantom dash-dot line to illustrate the portion of the back convex fabric edge 39 hidden by the front convex fabric edge 38 and front bib portion 28 as elucidated more clearly in FIG. 2 wherein the back convex fabric edge 39 is continuous with the front convex fabric edge 38 to form the bottom circumferential convex fabric edge 17 which is shown more particularly in FIG. 2. Further, the top opening 18 is generally horizontally aligned, and generally parallel to the generally horizontally aligned larger bottom opening 19 seamlessly integrally joined by the two concave sides 20 and 21, wherein each concave side 20 and 21 has top end points 22 and 24, a right top end point 22 and a left top end point 24; and each concave side (20 and 21) has bottom end points 23 and 25, a right bottom end point 23 and a left bottom end point 25. As illustrated in FIG. 1 the sun protective neckwear garment 10 has the smaller opening at the top 18 and comprises an opposing larger bottom opening 19 through which the wearer may pass his head through while donning or removing the neckwear garment 10, with reference to FIGS. 10, 11, and 12.

Figure 3:
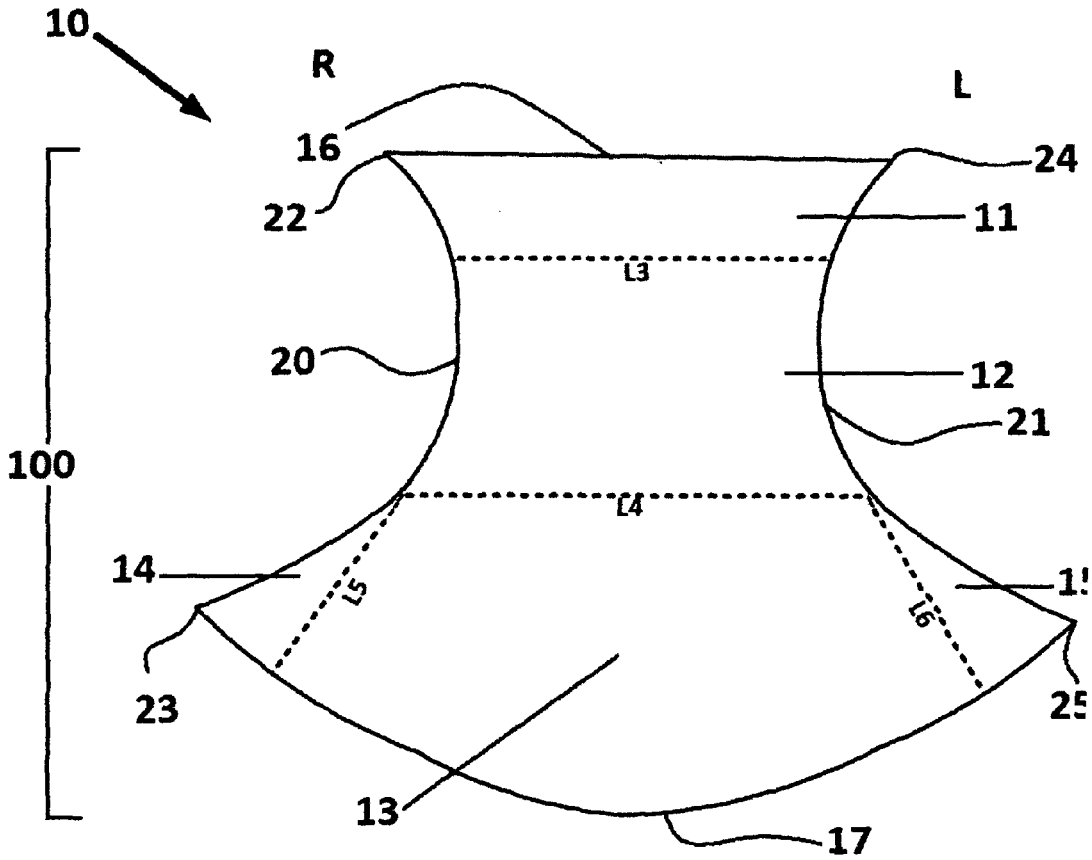
FIG. 3 is a top planar view of the sun protective neckwear with demarcation dotted lines L3-L6 to define the portions of the sun protective neckwear garment, according to the preferred embodiment of the present invention.

Further as seen in FIGS. 1 and 2, and delineated in FIG. 3 a top planar view of the sun protective neckwear garment 10 with lines L3-L 6; the neckwear garment according to the preferred embodiment further includes a circumferential top chin-collar portion 11; a circumferential bib portion 13, wherein the bib potion 13 includes two laterally opposing shoulder portions 14 and 15, a right shoulder portion 14 and a left shoulder portion 15; and a circumferential tubular neck portion 12 disposed therebetween the chin-collar portion 11 and the bib portion 13. FIGS. 1 and 2 further shows the sun protective neckwear garment 10 exterior surface 41 and interior surface 42 substantially identical; the front side 43 and the back side 44 substantially identical and continuously integrally seamlessly formed. FIG. 1 shows the front chin collar-portion 26 seamlessly integrally formed to the front tubular neck portion 27; the front tubular neck portion 27 seamlessly integrally formed to the front bib portion 28; the front bib portion 28 seamlessly integrally formed to the front right shoulder portion 29 and the laterally opposing left shoulder portion 30. In addition, FIG. 1 illustrates the seamless continuity of the front chin collar portion 26 as it, encircled back and seamlessly integrally formed to the back chin collar portion 31.

FIG. 2 shows the back side 44 of the sun protective neckwear garment 10 and further shows the bottom convex fabric edge 17 in a stretched open position to illustrate the larger bottom opening 19 bound by the circumferential bottom convex edge 17. FIG. 2 further illustrates the seamless continuity of the back side 44 of the sun protective neckwear garment 10 to the front side 43 of the sun protective neckwear garment 10 and elucidates the unique ship decanter tubular body 100 shape of the neckwear garment 10 according to the preferred embodiment of the present invention. In addition, FIG. 2 shows the sun protective neckwear garment 10 top opening 18 and the larger bottom opening 19 integrally seamlessly formed by the two concave sides 20 and 21. As illustrated, the bottom opening 19 is stretched in the open position elucidating the two concave sides 20 and 21 seamlessly integrated into the tubular decanter shape 100 of the sun protective neckwear garment 10. FIG. 2 shows the back chin-collar portion 31 circles integrally seamlessly forward to the front chin-collar portion 26; and the back chin collar-portion 31 seamlessly integrally formed to the back tubular neck portion 32 wherein the back tubular neck portion 32 circles integrally seamlessly forward to the front tubular neck portion 27; and the back tubular neck portion 32 seamlessly integrally formed to the back bib portion 33; the back bib portion 33 seamlessly integrally formed to the back right shoulder portion 34 and the laterally opposing left shoulder portion 35. FIG. 2 further elucidates the front right shoulder portion 29 integrally seamlessly formed to the right back shoulder portion 34 and similarly shows the front left shoulder portion 30 integrally seamlessly formed to the back left shoulder portion 35. In addition, the front right shoulder portion 29 and the front left shoulder portion 30 are integrally seamlessly formed to the front bib portion 28. The front bottom convex fabric edge 38 and the back bottom fabric convex fabric edge 39 form a singularly smooth continuous curved bottom fabric edge 17, the singularly smooth circumferential curved bottom concave fabric edge 17 has a circumferential length which is in continuous contact with the skin of the wearer when worn. It is critical that the sun protective neckwear garment 10 comprises the feature of the singularly smooth continuous circumferential curved bottom fabric edge 17 where the entire circumferential length is in constant contact with the skin of the wearer so that the wearer's skin is continuously and properly protected against ultraviolet rays of the sun when the sun protective neckwear garment 10 is worn. The correct ultraviolet protection factor (UPF) levels of the ultraviolet blocking fabric of the sun protective neckwear garment 10 are maintained and not compromised with the sun protective neckwear garment 10 having the singularly smooth continuous curved bottom fabric edge 17 in contact with the wearer's skin because there are no gaps or spaces in the singularly smooth continuous circumferential curved bottom fabric convex edge 17 which can expose the wearer's skin to the ultraviolet rays of the sun. Neckwear garments that include pleats or gaps in the bottom fabric edge can result in gaps or spaces in the bottom fabric edge which allows portions of the wearer's skin to be exposed to the sun when worn.

Illustrated more particularly in FIGS. 1 and 2 the top chin-collar portion 11 is bound by a generally horizontally aligned top opening 18 defined by a circumferential top straight fabric edge 17; and a bottom bib portion 13 is bound by a generally parallel horizontally aligned larger bottom opening 19 defined by a circumferential bottom convex fabric edge 16 integrally seamlessly connected by the two laterally opposed, generally parallel, vertically aligned, substantially identical, concave sides 20 and 21, the right concave side 20 and the left concave side 21, having a generally C-shape, wherein the concave sides 20 and 21 provide the unique shape shared by the top chin collar portion 11, the bottom bib portion 13, and the tubular neck portion 12 therebetween Particularly, FIG. 1 shows a front bottom midpoint 38*a*; a most convex front bottom fabric edge 38*a*; and a front medial axis (e). More particularly, the front bottom midpoint 38*a* and the most convex front bottom fabric edge 38*a* structurally occur at the same location along the front medial axis and, therefore, the front bottom midpoint 38*a* and the most convex front bottom fabric edge 38*a* are designated with the same numeral 38*a* for consistency and clarity. Particularly, FIG. 2 shows a back bottom midpoint 39*a*; a most convex back bottom fabric edge 39*a*; and a back medial axis (e'). The back bottom midpoint 39*a* and the most convex back bottom fabric edge 39*a* structurally occur at the same location along the back medial axis (e') and, therefore, the back bottom midpoint 39*a* and the most convex back bottom fabric edge 39*a* are designated with the same numeral 39*a* for consistency and clarity. As shown in FIGS. 1 and 2, the front top fabric edge 36 has a front top midpoint 36*a* located between the right top end point 22 and the left top end point 24. Similarly, the back top fabric edge 37 has a back top midpoint 37*a* located between the right top end point 22 and the left top end point 24.

Referring now to FIG. 3, the sun protective neckwear 10, as illustrated shows a top planar view of the neckwear garment 10 having the generally tubular ship decanter shape 100 showing the two laterally opposing, vertically aligned, substantially identical concave sides 20 and 21, the right concave side 20 and the left concave side 21, generally C-shaped. Each of the two concave sides 20 and 21 sides are seamlessly joined by a top straight fabric edge 16 at two laterally opposing top end points 22 and 24, right top end point 22 and left top end point 24. Each of the two concave sides 20 and 21 tapers arcuately and further diverging downward to join the convex bottom fabric edge 17 at two laterally opposing bottom side end points 23 and 25, right bottom end point 23 and left bottom end point 25 to form the unique generally tubular ship decanter shape 100. If the sun protective neckwear garment 10 is folded in the center each concave side 20 and 21 is the mirror image of each other and identically symmetrical to each other. As described and illustrated, it is for illustrative purposes only, the drawing in FIG. 3 is shown such that the portions within the sun protective neckwear garment 10 meet along common lines defined by tiny dotted lines L3-L6. FIG. 3 shows the integral portions of the sun protective neckwear garment 10 including the chin-collar portion 11 bounded by the top circumferential straight fabric edge 16 and laterally by the two laterally opposed concave sides 20 and 21 and terminates generally at L3 where the chin-collar portion 11 integrally seamlessly merges with the tubular neck portion 12; the tubular neck portion 12 is bounded laterally by the two concave sides 20 and 21 and generally terminates at L4 where the tubular neck portion 12 integrally seamlessly merges with the bib portion 13; the bib portion 13 terminates with the circumferential bottom convex fabric edge 17; and the bib portion 13 terminates generally at L5 and laterally opposed L6 where the bib portion 13 merges integrally seamlessly with the shoulder portions 14 and 15, including the right shoulder portion 14 at L9; and the left shoulder portion 15 at L10. The right shoulder portion 14 is bounded by the right concave side 20 and merges with the right concave side 20 when the neckwear garment 10 is stretched in the open position, as illustrated in FIG. 2 at line L1. The left shoulder portion 15 is bounded by the left concave side 21 and merges with the left concave side 21 when the neckwear garment 10 is stretched open, as illustrated in FIG. 2 at line L2.

Figure 4:
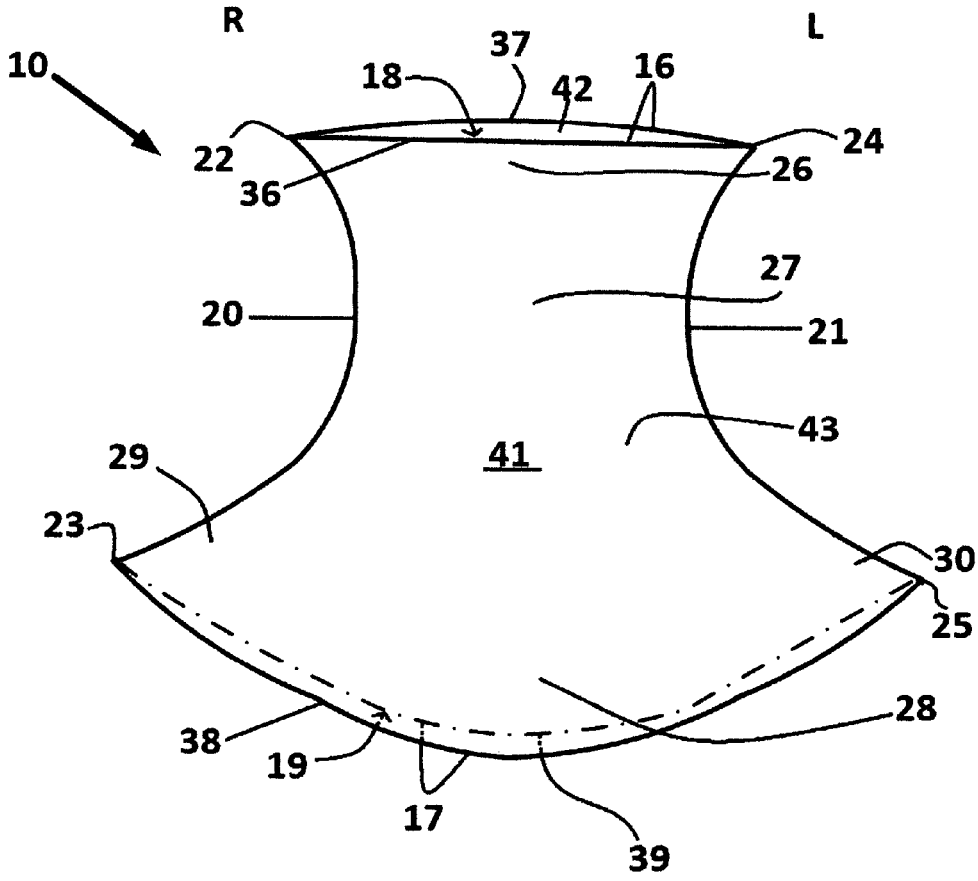
FIG. 4 is a front perspective view of the sun protective neckwear garment folded and laid flat.
Figure 5:
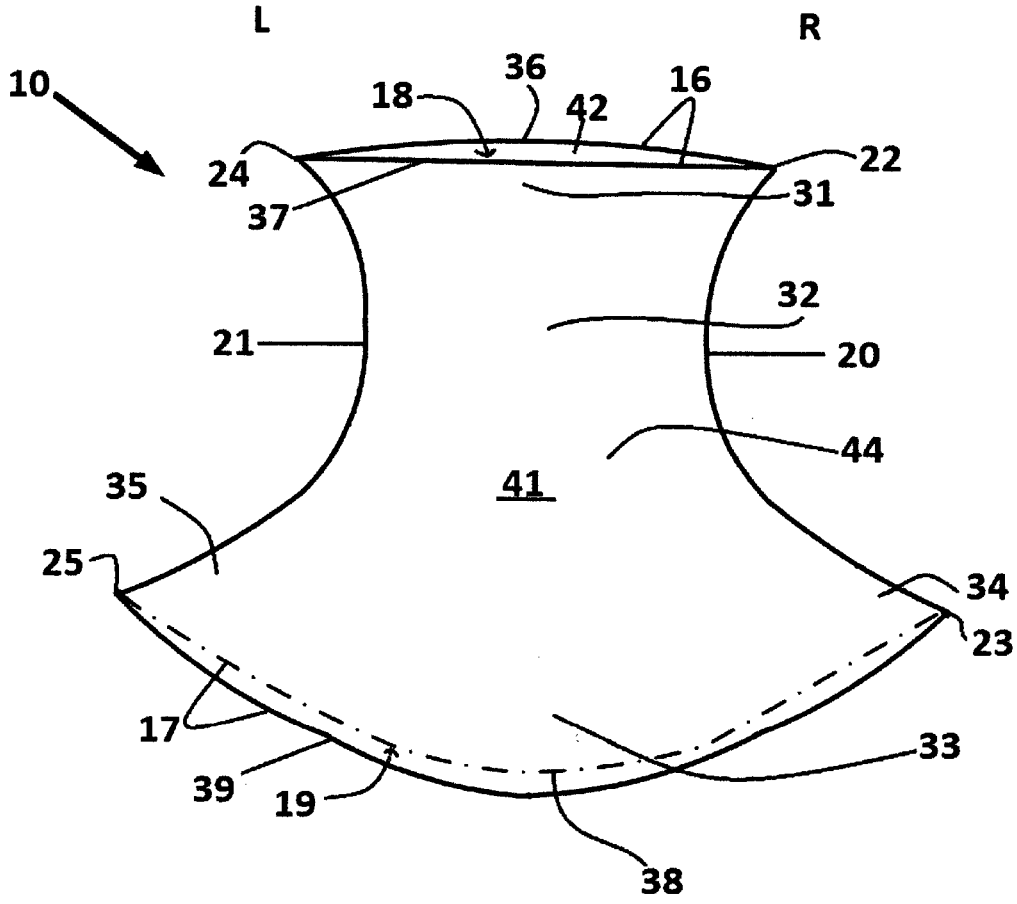
FIG. 5 is a rear perspective view of the sun protective neckwear garment folded and laid flat.

Addressing the present invention in further detail, FIG. 4 illustrates a front perspective view of the sun protective neckwear 10 when folded and laid flat. FIG. 5 illustrates a back perspective view of the sun protective neckwear 10 when folded and laid flat. FIGS. 4 and 5 show the neckwear garment folded, wherein the neckwear garment comprises substantially identical planar front side 43 surface and back side 44 surface bounded by flattened top opening 18 and flattened bottom opening 19 having concealed interior 42 flattened neck tubular 12 surface therebetween, More particularly, FIG. 4 illustrates the front side 43 portions of the neckwear garment 10 integrally seamlessly formed including the front chin collar portion 26 integrally seamlessly formed to the front tubular neck portion 27; the front tubular neck portion 27 integrally seamlessly formed to the front bib portion 28; and the front bib portion 28 integrally seamlessly formed to the front shoulder portions 29 and 30, front right shoulder portion 29 and front left shoulder portion 30. In addition, FIG. 4 illustrates the circumferential top straight fabric edge 16 folded and laid flat and therewith defines the top opening 18 of the neckwear garment 10 and a portion of which contemporaneously provides the front top straight fabric edge 36 of the front chin-collar portion 26 of the neckwear garment 10. As illustrated, the front top straight fabric edge 36 and the back side of the top straight fabric edge 37 are continuous. Further, FIG. 4 shows the bottom generally circumferential convex fabric edge 17 folded and laid flat and therewith shows the circumferential convex fabric edge 17 defines the bottom opening 19 and a portion of which contemporaneously provides the front bottom convex fabric edge 38 of the front bib portion 28 of the neckwear garment 10. As illustrated, the front bottom convex fabric edge 38 and the back side bottom convex fabric edge 39, shown in phantom by the dash-dot line, are continuous. Further, the circumferential top fabric edge 16 of neckwear garment 10 and the circumferential bottom convex fabric edge 17 are joined by the two laterally opposed vertically aligned substantially identical concave generally C-shaped sides 20 and 21 at two laterally opposing top end points 22 and 24, right concave side end point 22 and left concave side end point 24 and joined by two laterally opposing bottom concave side end points 23 and 24, right concave side end point 23 and left bottom concave side end point 25. The two concave sides 20 and 21 as illustrated are shared by the front chin-collar portion 26 and front shoulder portions 29 and 30 and the tubular neck portion 27 therebetween. The two opposing concave sides 20 and 21 provide the unique tubular ship decanter shape 12 of the neckwear garment 10.

As illustrated, FIG. 5 illustrates the sun protective neckwear 10 folded and laid flat showing the back side 44 of the neckwear garment 10 is substantially identical to the front side 43 of the neckwear garment 10 and therewith seamlessly integrally formed; and wherein the back chin collar portion 31 is integrally seamlessly formed to the back tubular neck portion 32; the back tubular neck portion 32 integrally seamlessly formed to the back bib portion 33; and the back bib portion 33 integrally seamlessly formed to the back shoulder portions 34 and 35, back right shoulder portion 34 and back left shoulder portion 35. In addition, FIG. 5 illustrates the circumferential top straight fabric edge 16 folded and laid flat and therewith defines the top opening 18 of the neckwear garment 10 and a portion therewith contemporaneously provides the back top straight fabric edge 37 of the back chin-collar portion 31 of the neckwear garment 10. As illustrated, the back top straight fabric edge 37 and the front side of the top straight fabric edge 36 are continuous. Further, FIG. 5 shows the bottom generally circumferential convex fabric edge 17 folded and laid flat and therewith shows the circumferential convex fabric edge 17 defines the bottom opening 19 and a portion therewith contemporaneously provides the back bottom convex fabric edge 39 of the back bib portion 33 of the neckwear garment 10. As illustrated, the back bottom convex fabric edge 39 and the front side bottom convex fabric edge 38, shown in phantom by the dash-dot line, are continuous. Further, the circumferential top fabric edge 16 of neckwear garment 10 and the circumferential bottom convex fabric edge 17 are joined by the two laterally opposed vertically aligned substantially identical concave generally C-shaped sides 20 and 21 at two laterally opposing top end points 22 and 24, right concave side end point 22 and left concave side end point 24 and joined by two laterally opposing bottom concave side end points 23 and 24, right concave side end point 23 and left bottom concave side end point 25. The two concave sides 20 and 21, as illustrated, are shared by the back chin-collar portion 31 and back shoulder portions 34 and 35 and the back tubular neck portion 32 therebetween. The two opposing concave sides 20 and 21 provide the unique tubular ship decanter shape 12 of the neckwear garment 10.

Figure 6:
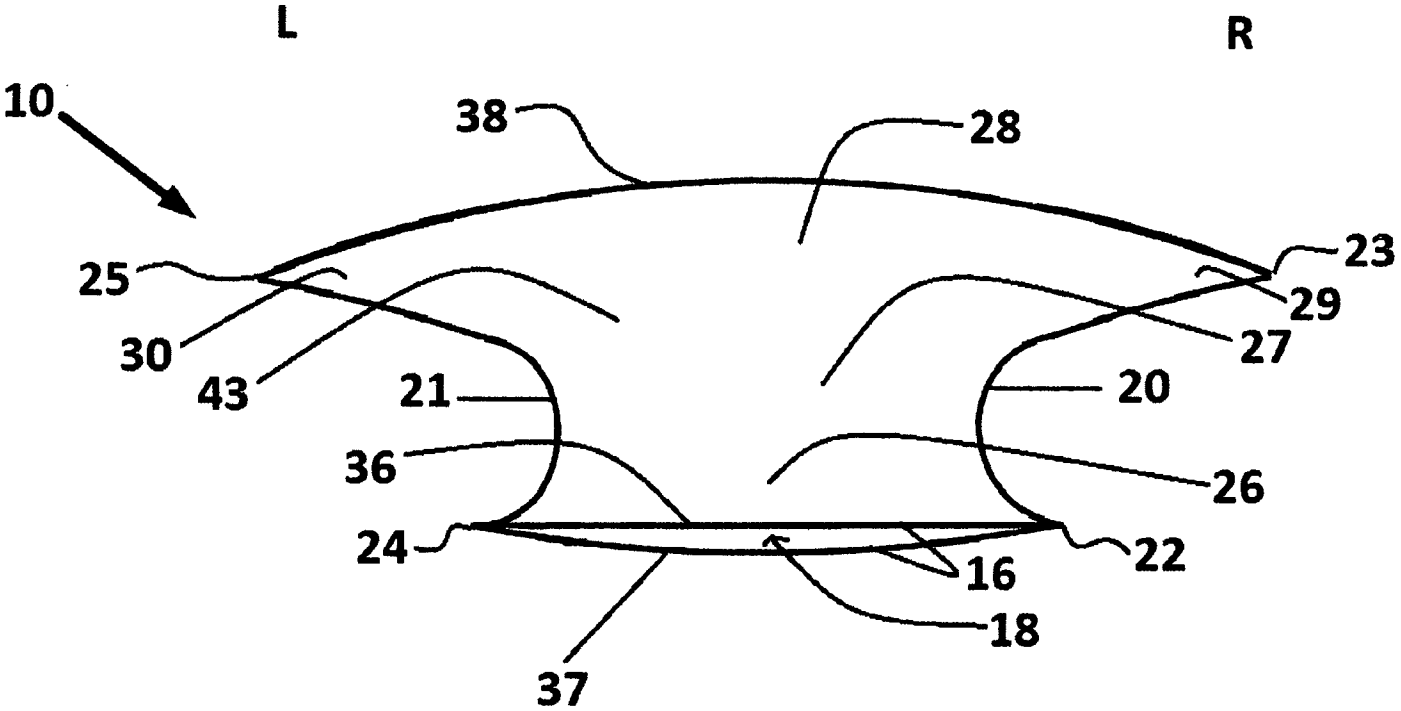
FIG. 6 is a perspective view of the top of the sun protective neckwear folded and laid flat with the top opening of the neckwear garment slightly open.
Figure 7:
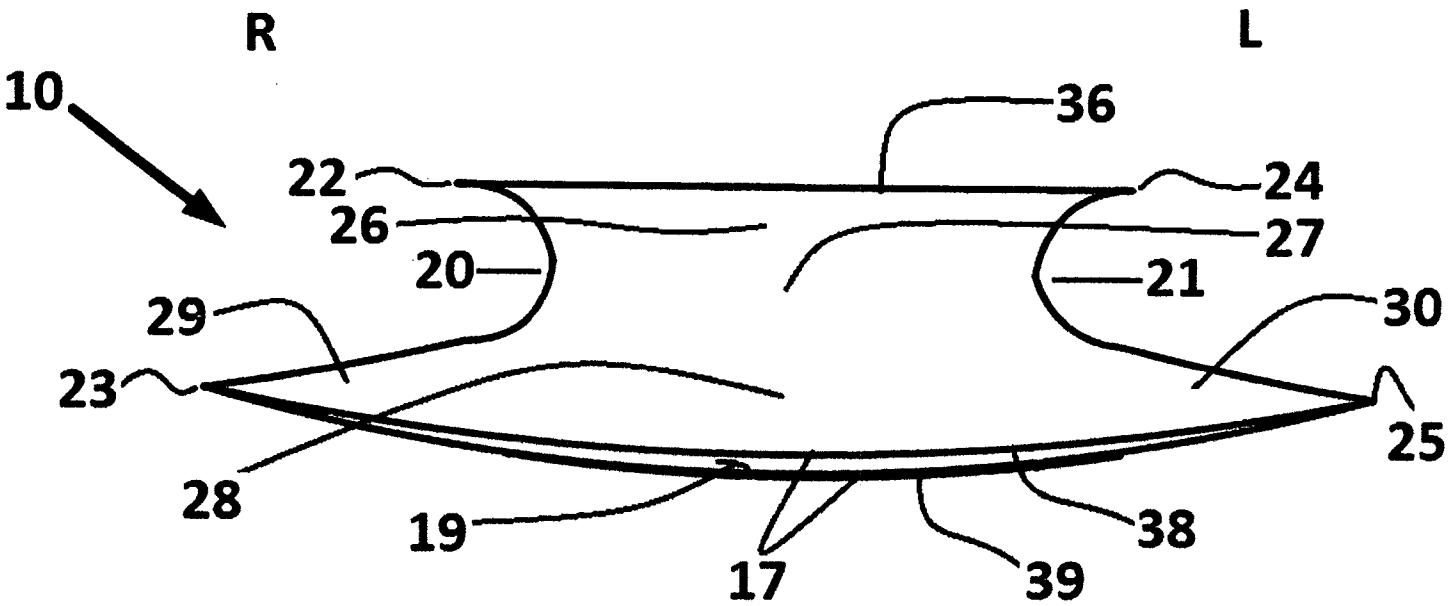
FIG. 7 is a perspective view of the bottom of the sun protective neckwear garment folded and laid flat with the bottom opening of the neckwear slightly open.
Figure 8:
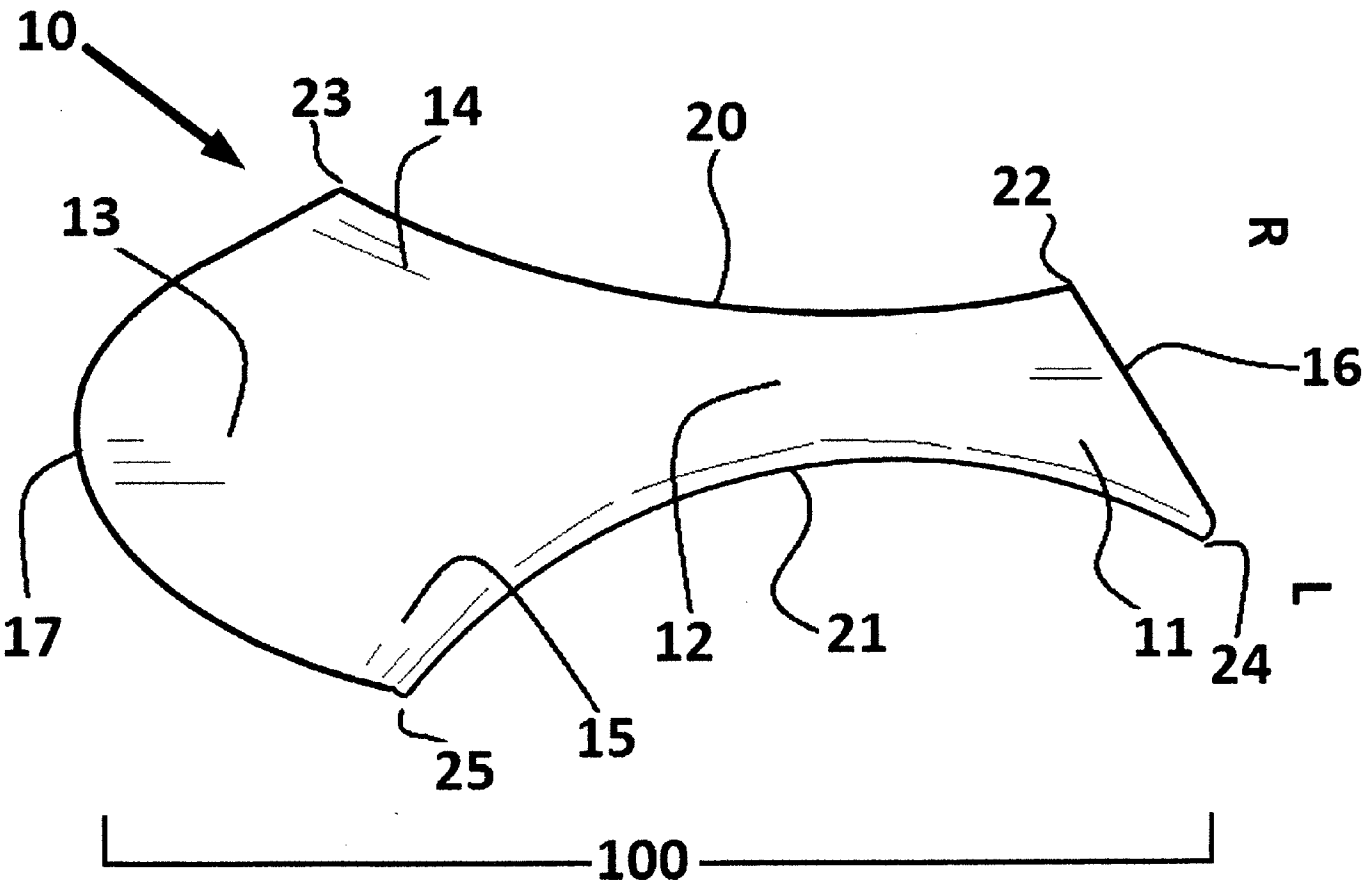
FIG. 8 is a side perspective planar view of the sun protective neckwear garment, according to the preferred embodiment of the present invention.

FIG. 6 is a perspective view of the sun protective neckwear 10 single body ship decanter shape 100 folded and laid flat, elucidating the top opening 18 flattened and slightly open; and FIG. 7 is a perspective view of the sun protective neckwear garment 10 folded and laid flat, elucidating the bottom opening 19 flattened and slightly open; and showing the top opening 18 of the sun protective garment 10 is smaller in diameter than the bottom opening 19. In addition, in FIGS. 6 and 7, shows the tubular neck portion flattened elucidating the unique configuration of the concave generally C-shaped sides 20 and 21 of the neckwear garment 10 well apparent; as well as, the laterally opposing top end points 22 and 24 and laterally opposing bottom end points 23 and 25 which contribute to the novel ship decanter shape 100 of the neckwear garment 10. FIG. 8 is a side perspective planar view of the sun protective neckwear garment 10, according to the preferred embodiment of the present invention, clearly illustrating the two laterally opposed concave sides 20 and 21; wherein the two concave sides 20 and 21 are integrally joined to the top straight fabric edge 16 at two laterally opposing top end points 22 and 24; and showing the two concave sides 20 and 21 are joined to the bottom convex fabric edge 17 at the two laterally opposing bottom end points 23 and 25; and further FIG. 8 illustrating the sun protective neckwear garment 10 having the generally tubular ship decanter shape 100 unique to the present invention.

It is well appreciated by those skilled in the art, that the bottom convex fabric edge 17 can be contoured to take on a plurality of shapes and still provide sufficient coverage to a wearer and enable protection against the ultraviolet rays of the sun.

Figure 9:
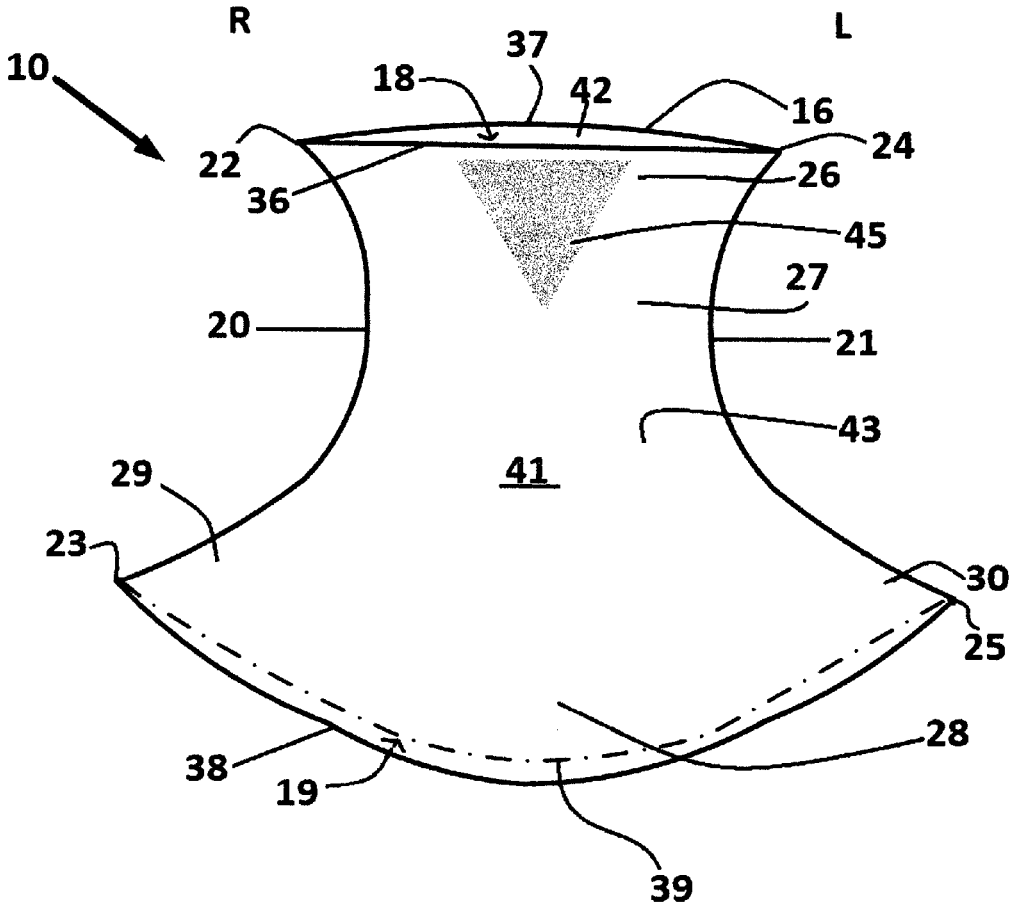
FIG. 9 is a front perspective view of the sun protective neckwear garment, folded and laid flat, with a reinforcement elastic patch at the chin-collar portion.

Further illustrated in FIG. 9 according to another aspect of the present invention, the sun protective neckwear garment 10 is shown with the front chin-collar portion 26 having a preconfigured reinforcement patch 45 of stronger reinforced elastic fabric which provides a support means that has a tighter fit against the chin when the neckwear garment's 10 front chin-collar portion 26 is pulled up over the wearer's chin. FIG. 9 is a top planar front view of the preferred embodiment of the present invention illustrating the elastic reinforcement 45 at generally the midpoint of the front chin-collar portion 26. Other neckwear garments do not include elasticity and therefore flop up and down while the wearer is exercising.

In use, the sun protection neckwear 10 is easy, comfortable, and convenient to use and store. The neckwear garment 10 can be easily pulled on and over the wearer's head and positioned around the neck of the wearer, the upper chest, upper back, and portion of the shoulders, for the wearer to use while participating in outdoor or indoor physical activity and likewise, be easily pulled off and over the wearer's head when the wearer wishes to remove the neck garment. The sun protection neckwear 10 is lightweight, and not bulky, and therefore does not interfere with the physical movement of the wearer. Moreover, the neckwear garment 10 is flexible and includes a generally small surface mass which provides a neckwear garment 10 capable of being portable, and therefore, can be folded and carried in a clothes' pockets, gym bags, handbags, or any carrying units of the wearer.

In use, the wearer orients the sun protective neckwear garment 10 with the smaller opening 18 at the top and the larger opening 19 at the bottom, and pulls the wearer's head therein the bottom opening 19 and through the smaller top opening 18, maneuvering the tubular neck portion 12 around the wearer's neck and the bib portion 13 to lay upon the wearer's upper chest and upper back, the shoulder portions 14 and 15 to extend over a portion of the wearer's shoulders, and the chin-collar portion 11 stretched over the wearer's chin, or in the alternative the chin-collar portion 11 folded down under the wearer's chin. Because the sun protective neckwear garment 10 includes a front side and a back side substantially identical, and includes an exterior surface and interior surface substantially identical, the sun protective neckwear garment is reversible. In addition, the front side 43 of the neckwear garment 10 can be worn upon the back side of a wearer; and the back side 44 of the neckwear garment 10 can be worn upon the front side of a wearer.

Figure 10:
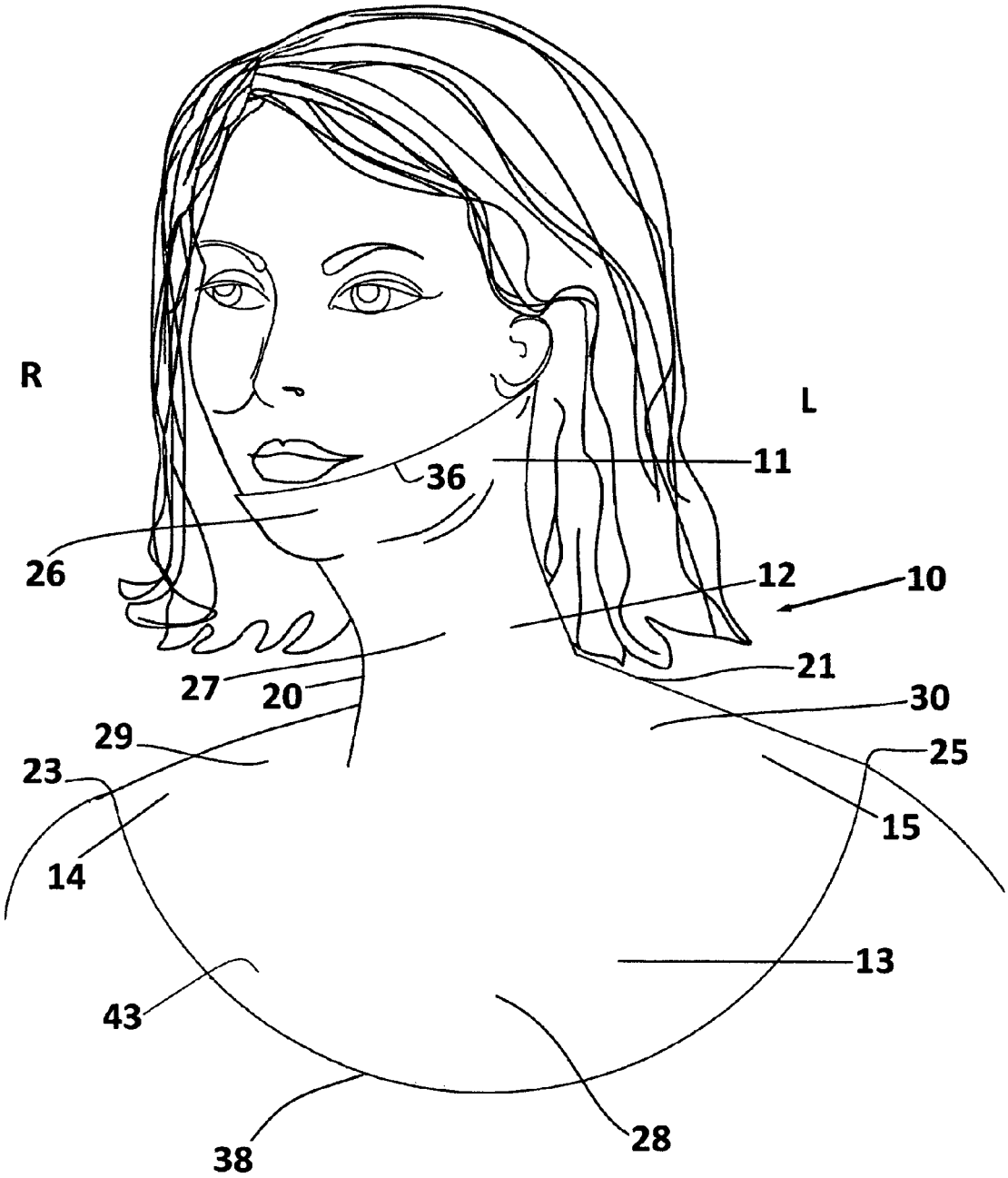
FIG. 10 is a front view of a user wearing the sun protective neckwear garment with the chin-collar portion stretched in the up position covering the wearer's chin, according to the preferred embodiment of the present invention.
Figure 11:
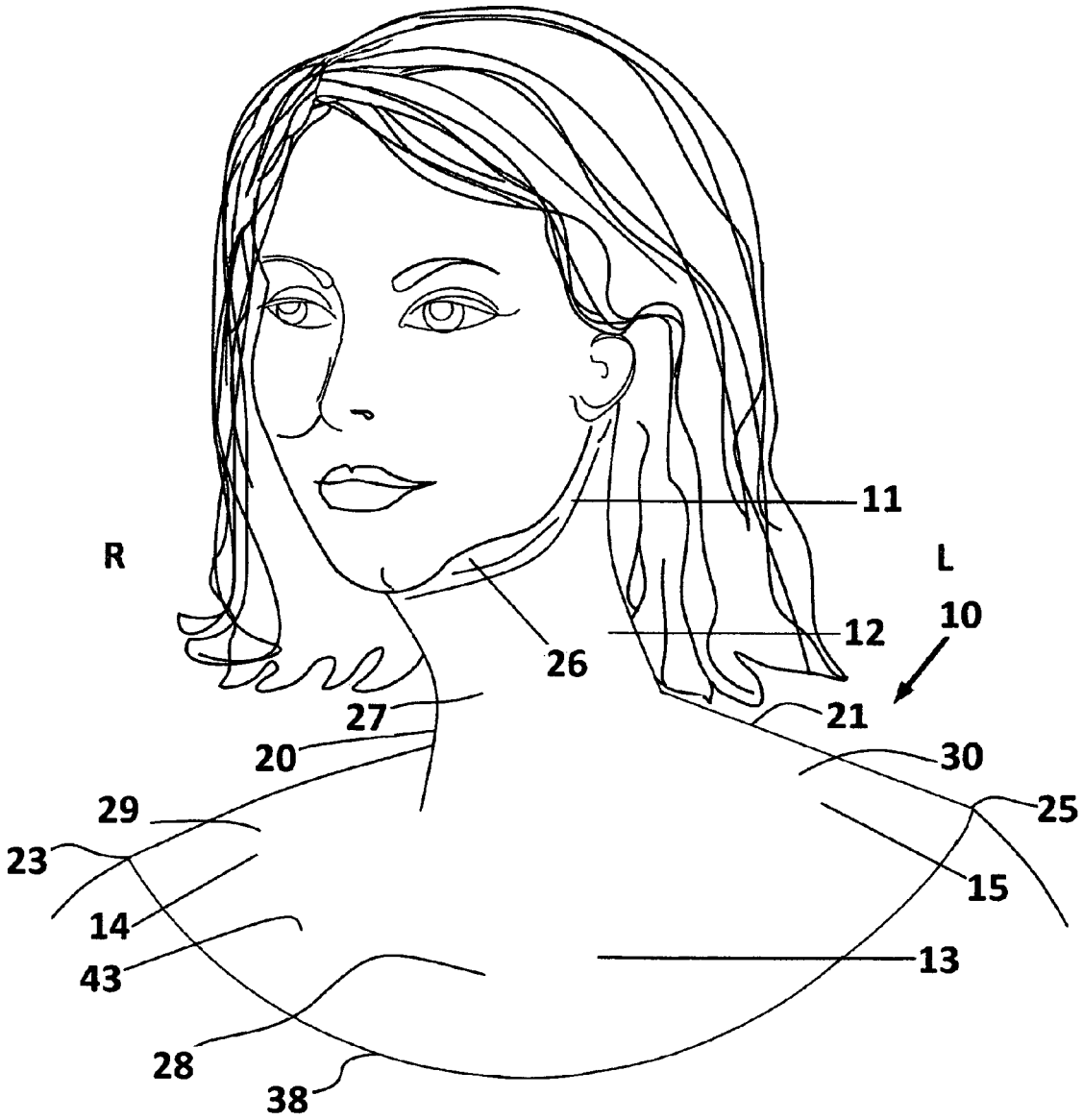
FIG. 11 is a front view of a user wearing a sun protective neckwear garment with the chin-collar portion in the folded down position.
Figure 12:
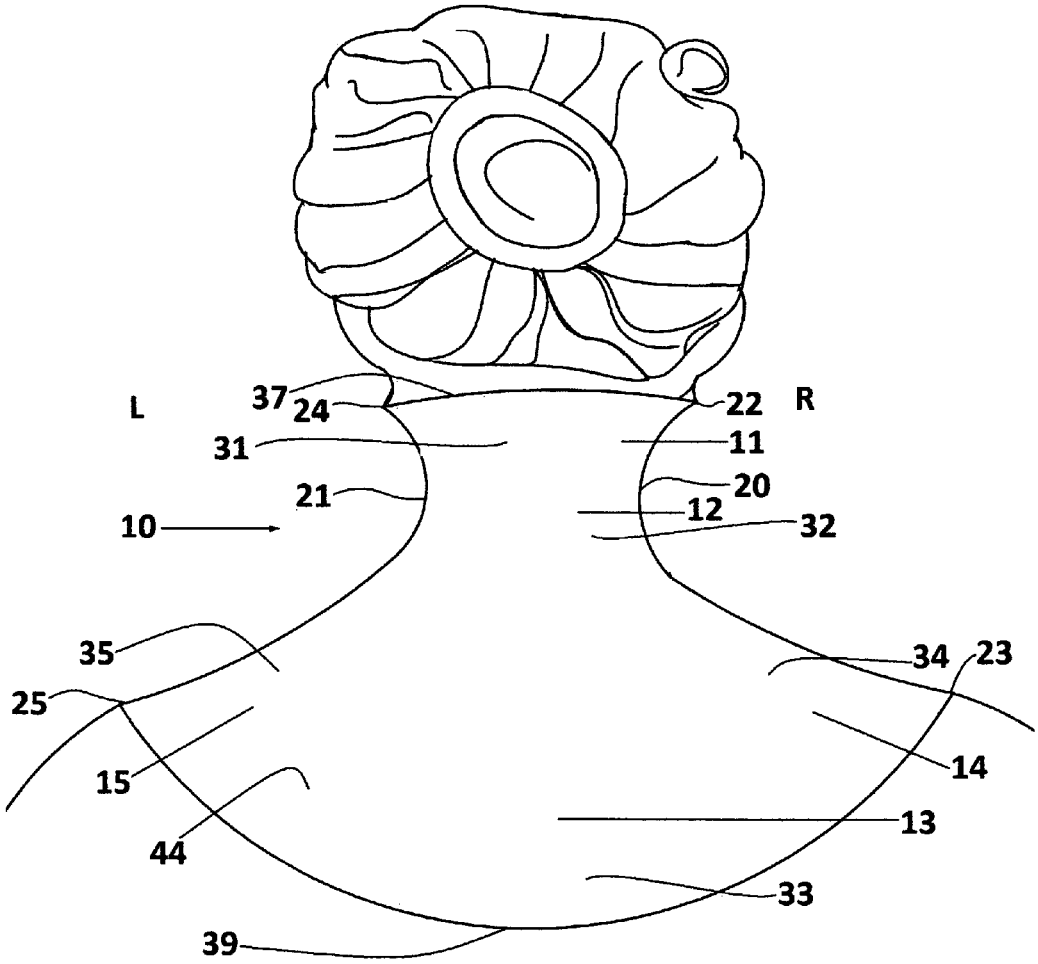
FIG. 12 is a rear view of a user wearing a sun protective neckwear garment according to the preferred embodiment of the present invention.

Now addressing the sun protective neckwear as worn by a user, FIGS. 10, 11, and 12, shows the novel tubular ship decanter 100 configuration, as illustrated above in FIGS. 1-5, provides close contact with the wearer's skin and therefore provides excellent protection from the ultraviolet rays of the sun. FIG. 10 shows a front perspective view of the sun protective neckwear garment 10 worn by a user wherein the front tubular neck portion 27 provides close contact and coverage of the wearer's front neck and skin; and the front top chin-collar portion 26 in the up position provides close contact and coverage to the wearer's chin and skin; and the front bib portion 28 provides close contact and coverage to the wearer's upper chest and skin and the front side bottom bib portion 28 is sized with a width having sufficient surface to extend over the wearer's upper chest; and front bib portion 28 with a length sized with sufficient surface such that the front bib portion 28 extends to a position at or below the sternum; and the front shoulder portions 29 and 30, including right shoulder portion 29 and left shoulder portion 30 and back provide close contact and coverage to the wearer's shoulders and skin.

In addition, turning to FIG. 12, the novel tubular neck portion 12 configuration provides close contact with the wearer's neck wherein the back side tubular neck portion 32 provides close contact and coverage of the wearer's back neck and skin; and the back side top chin-collar portion 31 in the up position provides close contact and coverage to the wearer's back of the neck and skin; and the back side bib portion 33 provides close contact and coverage to the wearer's upper back and skin and the back bib portion 33 is sized with a width having sufficient surface to extend over the wearer's upper back and a length sized with sufficient surface such that the back bib portion 33 extends to a position at or below the first thoracic vertebra of the wearer; and the back right shoulder portion 34 and the back left shoulder portion 35 provide close contact and coverage to a portion of the wearer's shoulders and skin.

With reference to FIGS. 1 to 5 the bottom bib portion includes a horizontally aligned circumferential convex fabric edge 17 defining the bigger bottom opening 19 of the neckwear garment and now referring to FIGS. 10, 11, and 12, shows the bottom opening 19 sized with circumferentially sufficient surface to be pulled over a wearer's head and to extend over a portion of the wearer's shoulders. Further, referring to FIGS. 10 and 11, the front side bottom bib portion 33 includes a horizontally aligned front side bottom convex fabric edge 38, and further front bib portion 28 is sized with a width having sufficient surface to extend over the wearer's upper chest and a portion of the wearer's shoulders, and a length sized with sufficient surface such that the front bib portion 28 extends to a position at or below the sternum. Further, as specified above, and illustrated in FIG. 5 the back side of the neckwear garment 10 is substantially identical to the front side of the neckwear garment 10. As such, with reference to FIG. 12 illustrating the back side 44 of the neckwear garment 10 the back side bottom bib portion 33 terminates with the back side convex fabric edge 39 and the back bib portion 33 is sized with a width having sufficient surface to extend over the wearer's upper back and portion of the wearer's shoulders and a length sized with sufficient surface such that the back bib portion 33 extends to a position at or below the first thoracic vertebra of the wearer.

With reference back again to FIGS. 1-5 and together referring now to FIGS. 10, 11, and 12 the neck portion has a tubular configuration ship decanter in shape sized with a diameter smaller than the top opening 18; and the top opening 18 smaller in diameter than bottom opening 19 and tubular neck portion 12 having sufficient circumferential surface dimensioned to fit snugly around a wearer's neck.

The sun protective neckwear 10 is preferably stretchable, resilient, and flexible, and not rigid or coarse as to allow the wearer ease of entry and use to pull the garment on and off over the wearer's head and to retract to conform to the wearer's neck, chest bone, and shoulder slope. Further, the sun protective neckwear garment 10 can be stretched an additional 2.00 inches 2-ways laterally or in 4-way stretch, and therefore, can be easily stretched over the wearer's head.

The sun protective neckwear 10 can be manufactured from lightweight, elasticized, resilient, fabric or material having sun blocking capabilities having ultraviolet protection factor of at least 30 UPF. Further, the fabric can include wicking capabilities of predetermined levels to absorb sweat from the wearer's body when worn. As noted above, the neckwear garment 10 includes a top opening 18 and a bottom opening 19 which permits donning the garment on or taking it off easily over the user's head. The sun protective neckwear 10 is worn by first pulling the neckwear over a wearer's head such that the tubular neck portion 12 surrounds the wearer's neck snugly and comfortably; and the neckwear garment 10 can be worn in either of two positions, an up position and a folded down position, such that the front chin-collar portion 26 of the neckwear garment 10 can be pulled up and stretched over the wearer's chin, as illustrated in FIG. 10; or in the alternative if needed or desired, remain folded down under the wearer's chin as illustrated in FIG. 11.

Addressing the drawings in more detail, FIGS. 10, 11, and 12, with reference to FIGS. 1-3, illustrate an exemplary sun protective neckwear garment 10 as used by a wearer. FIGS. 10 and 11 are perspective views of the front side 43 of the neckwear garment 10 as worn by a wearer; and FIG. 12 is a perspective view of the back side 44 of the neckwear garment as worn by a wearer. FIG. 10 illustrates the preferred embodiment of the sun protective neckwear garment 10 on a user showing the front side 43 of the neckwear garment 10 with the front chin collar portion 26 in the up position stretched around the wearer's chin. FIG. 12 shows the back chin-collar portion 31 pulled up under the hair line of the wearer. FIG. 11 shows the neckwear garment on a user with the front chin-collar portion 26 in the down position folded juxtaposed under the wearer's chin. In addition, FIG. 10 shows the front elasticized chin-collar portion 26 bound by the circumferential elasticized top straight fabric edge 16 with the front top straight fabric edge 36 visible along the wearer's chin; FIG. 12 shows the back elasticized chin collar portion 31 bound by the back portion 37 of the circumferential top straight fabric edge 16 positioned under the wearer's hairline. FIG. 10 further shows the elasticized seamlessly integrated tubular neck portion 12 positioned snugly around the wearer's neck, visible only the front tubular neck portion 27; with the back tubular neck portion visible in FIG. 12 positioned snugly around the back of the wearer's neck. Further FIG. 10 shows the seamlessly integrated elasticized front bib portion 28 positioned over and covering the upper chest of the wearer, wherein the front bib portion 28 extends to the seamlessly integrated elasticized front right shoulder portion 29 and front left shoulder portion 30 to cover a portion of the wearer's shoulders; and FIG. 12 shows the seamlessly integrated elasticize back bib portion 33 positioned over and covering the upper back of the wearer, wherein the back bib portion 33 extends to the seamlessly integrated elasticized back right shoulder portion 34 and extends to the back left shoulder portion 35 of the neckwear garment 10. In addition, FIGS. 10 and 11 shows the front bib portion 28 terminates with the circumferential convex bottom edge 17 with the front convex fabric edge 38 visible in FIGS. 10 and 11; and FIG. 12 shows the seamlessly integrated elasticized back bib portion terminates with the back convex fabric edge 39.

FIGS. 10, 11, and 12, clearly illustrate the unique tubular neck portion 12, with reference to FIGS. 1-3, formed by the two opposing substantially identically concave sides 20 and 21 generally C-shaped, configured to fit snugly around a wearer's neck. The tubular neck portion 12 provides a neck shield against the sun with resiliency and elasticity which enables the tubular neck portion 12 to come in comfortable, close contact with the wearer's neck.

The neckwear garment 10 is preferably constructed using ultraviolet blocking fabric with sufficient elasticity, resiliency and pliability to enable the sun protective neckwear garment to be donned on and off a wearer and still maintain its shape after continued use. In addition, the sun wear protective garment 10 has sufficient surface area to cover the wearer's neck, chin, upper chest, upper back, and portion of the shoulders to provide protection against the ultraviolet rays of the sun.

FIGS. 10 and 11 further illustrates the front bib portion 28 is sized with a width having sufficient surface to extend over the wearer's upper chest and a portion of the wearer's shoulders; and front bib portion 28 has a length sized with sufficient surface such that the front bib portion 13 extends to a position at or below the sternum of a wearer, and therefore the neckwear garment 10 provides protection to the skin, at these particular areas of the wearer, against the ultraviolet rays of the sun. FIG. 12 further illustrates the back bib portion 33 is sized with a width having sufficient surface to extend over the wearer's upper back and a portion of the wearer's shoulders, and a length sized with sufficient surface such that the back bib portion 33 extends to a position at or below the first thoracic vertebra of the wearer, and therefore the neckwear garment 10 also provides protection to the skin, at these particular areas of the wearer, against the ultraviolet rays of the sun.

As illustrated in FIG. 10, the chin-collar portion 11 is of predetermined width and length which allows the wearer to extend the resilient elasticized chin-collar portion 11, more specifically, front chin-collar portion 26 securely and comfortably over the chin of the wearer and provide a shield for the chin from the ultraviolet rays of the sun to enable protection of the thin skin of the neck and chin. This enables the wearer to have protection from the sun while engaging in physical activity and still have his mouth unencumbered by a collar that may block the wearer's mouth and breathing.

The sun protective neckwear garment 10 has sufficient stretch, elasticity and resiliency such that the neckwear 10 may be snugly worn around the wearer's neck and stretched securely over the wearer's chin, and extended upon the wearer's upper chest, upper back, and portion of the wearer's shoulders while a wearer is participating in activities in sunny weather, while the wearer is partaking in physical outdoor activities or indoor activities whereupon the wearer is exposed to the sun, such as jogging, bicycling, golfing, sports, soccer, rugby, football, baseball, basketball, skiing, snowboarding, cross country skiing, snowmobiling, jet skiing, water skiing, surfing, sand dune mobiling, walking, walking along the beach, standing on the beach, hiking, skateboarding, marathons, walkathons, bikeathons, gardening, or while exercising near a clear glass window, or when driving a vehicle, such as a car, cab, truck, boat, golf cart, all-terrain vehicle, or while sitting on a chair-lift, or participating in any sport, or driving a vehicle, or boat, or for any physical activity under the sun, or a wearer may include lifeguards, landscapers, surveyors, equestrians, snorkelers, oil riggers, as well as crossing guards, police men, firemen, and construction workers, where the sun protective neckwear 10 primarily provides a means to keep the wearer's skin protected against the damaging rays of the sun and secondarily keeps the wearer's skin as cool and dry as possible.

Figure 13:
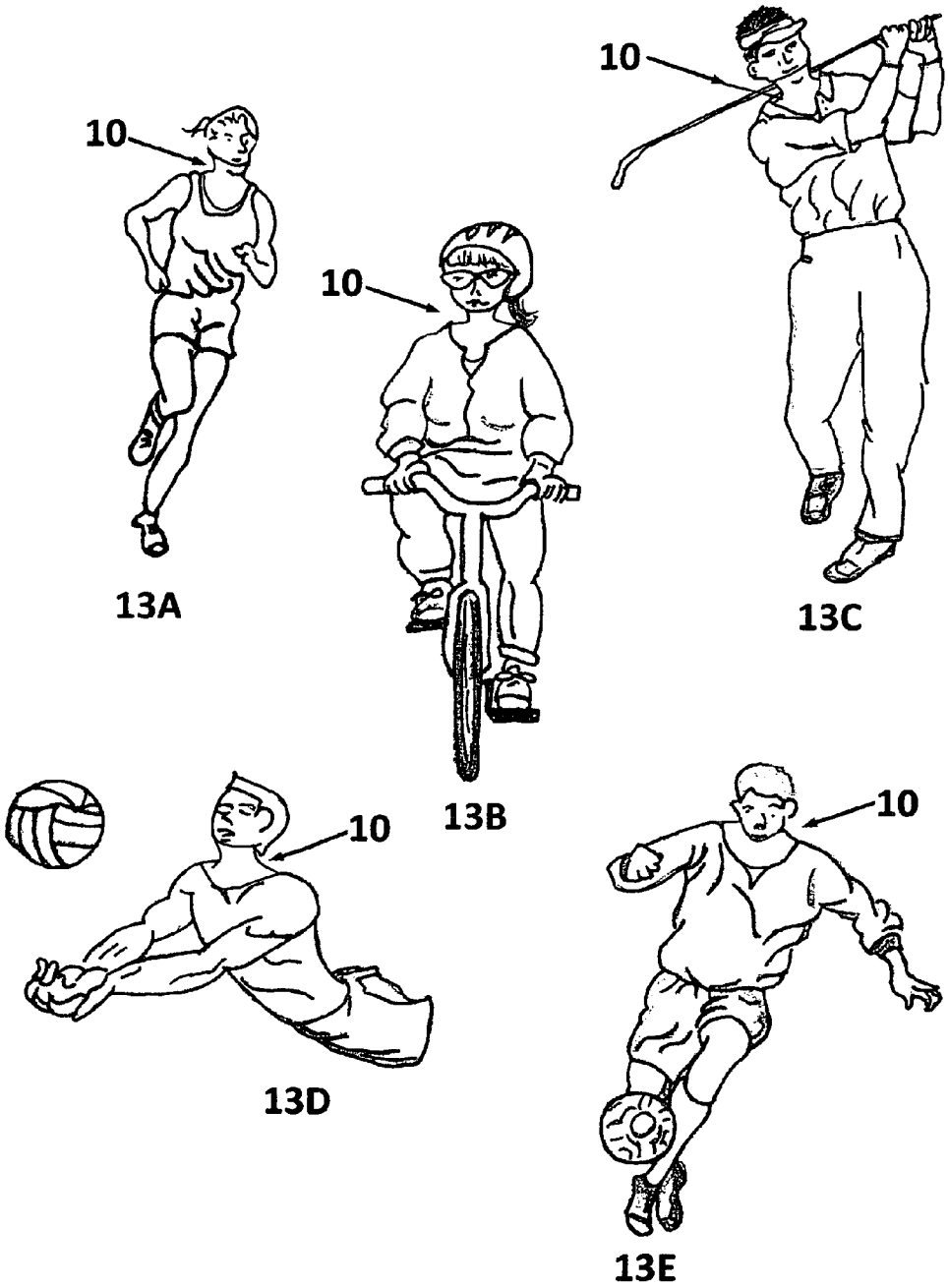
FIGS. 13A, 13B, 13C, 13D, and 13E, are illustrations of the sun protective neckwear garment in use worn by a variety of users while a user is jogging FIG. 13A, a user is riding a bicycle FIG. 13B, a user is golfing FIG. 13C, a user is playing volleyball FIG. 13D, and a user is kicking a soccer ball FIG. 13E.
Figure 14:
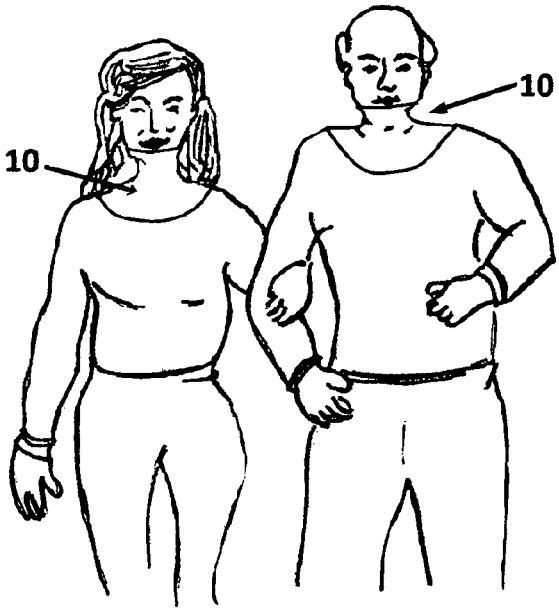
FIGS. 14A and 14B are illustrations of the sun protective neckwear garment in use worn by a variety of users while two users are walking FIG. 14A; and while two users are running FIG. 14B.
Figure 14:
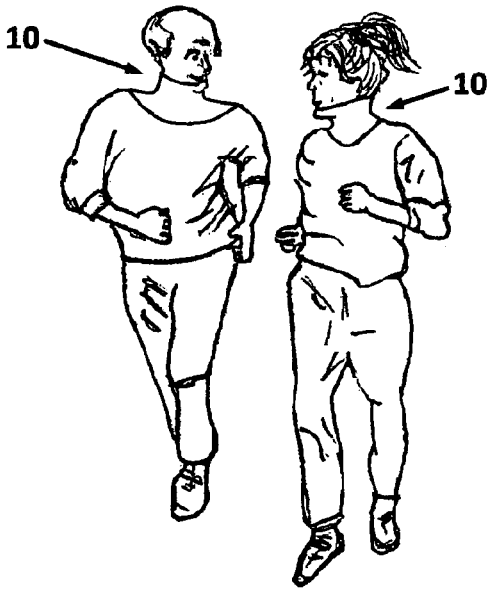

FIGS. 13A, 13B, 13C, 13D, and 13E illustrates the sun protective neckwear garment 10 in use particularly to protect wearers against the sun on their chin, neck, upper chest, upper back and portion of their shoulders when a variety of users are engaged in physical activities. FIG. 13 A shows a wearer while jogging; FIG. 13B shows a wearer riding a bicycle, FIG. 13C shows a wearer playing golf; FIG. 13D shows a wearer playing volleyball; FIG. 13E shows a wearer and playing soccer. Other physical activities are shown in FIGS. 14A and 14B illustrating the sun protective neckwear garment 10 in use while the wearers are walking FIG. 14A and while the wearers are jogging FIG. 14B.

As illustrated in FIGS. 13A, 13B, 13C, 13D, 13E, and 13A and 13B the sun protective neckwear garment 10, according to the preferred embodiment of the present invention, provides coverage around the user's neck, chin, upper chest, upper back, and portions of the shoulders, while in use, at the same time permitting substantially unrestricted physical activity to the wearer without danger of ultraviolet exposure from the sun to the user's chin, neck, upper back, chest, and shoulders; and contemporaneously, the neckwear garment 10 provides absorption of the wearer's sweat and provides against irritation. The sun protection neckwear 10 can effectively block a user's exposure to harmful ultraviolet waves of the sun and reduce the risks of skin disorders which may invade the wearer without use of the garment.

Figure 15:
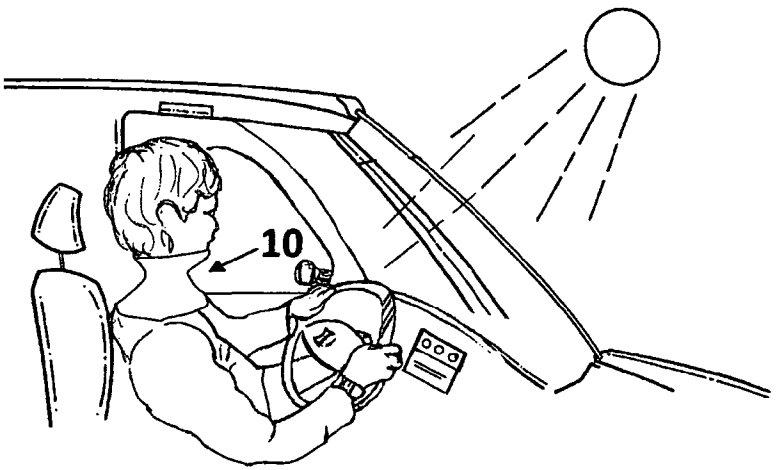
Figure 15:
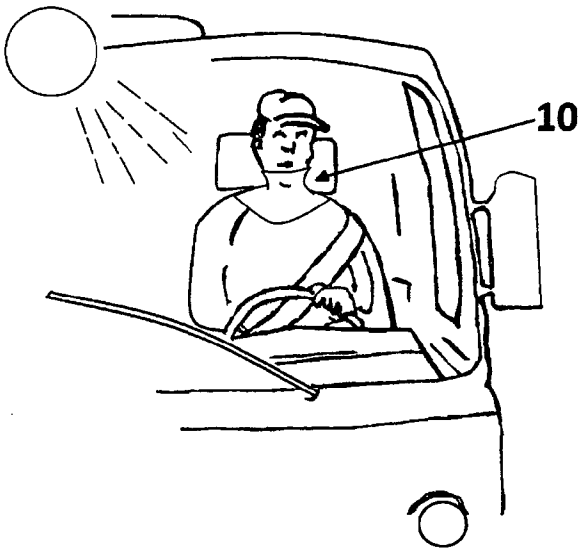

Moreover, the sun protective neckwear 10 provides drivers of vehicles protection from the strong glaring rays of the sun while driving as illustrated in FIGS. 15A and 15B. FIG. 15A illustrates a driver while driving in a car wearing the sun protective neckwear 10 which enables protection of the driver's chin, neck, portion of shoulders, and upper chest from the glaring rays of the sun glaring through the glass of the windshield and still have the wearer's mouth unobstructed by the chin-collar 11 of the neckwear garment. Similarly, FIG. 15B illustrates the sun protective neckwear worn by a user driving a truck in which the sun protective neckwear 10 enables protection against the glaring rays of the sun glaring through the glass of the truck's windshield.

In use, as illustrated in FIGS. 10, 11, 12, 13A-E, 14A-B, and 15A-B according to the preferred embodiment, the neckwear garment 10 provides a protection means to enable protection to the wearer from the radiation of the sun in critical areas where the skin on the wearer's body is very thin, for example, on the neck, upper chest, upper back, and the tops of the shoulders. In addition, the sun protection neckwear 10 provides an absorption means to enable perspiration to be wicked and absorbed from the wearer's body onto the neckwear garment 10. This further provides a cooling mechanism to the wearer and prevents the wearer from overheating and from uncomfortably dripping with moisture and sweat around the neck, upper chest, upper back, and shoulders, and lower chin.

Furthermore, with reference back to FIGS. 10, 11, and 12, the tubular neck portion 12 overlies and surrounds the wearer's neck with a close, tight but comfortable fit allowing the neckwear garment 10 to come in contact with the wearer's neck and in combination provides a shield for the wearer's front neck and back neck against radiation from the sun, provides a wick to absorb wearer's perspiration, and further provides a support means for the neckwear garment 10 such that the neckwear garment 10 is securely held in place upon the wearer's neck while the wearer participates in physical exercise and prevents against the neck garment from falling down. In addition, the chin-collar 11, more particularly illustrated in FIG. 10, the front chin collar portion 26 can be pulled over the wearer's chin to provide additional support means to maintain the sun protection neckwear 10 in place as the wearer continues with physical activity and additional protection from the sun's radiation.

Referring again, as illustrated in FIGS. 10, 11, and 12 each of the shoulder portions 29, 30, and 34, 35, overlie a portion of each of the wearer's shoulders further providing protection against ultraviolet rays of the sun and providing additional absorption of perspiration from the wearer. FIGS. 10 and 11 illustrates the front bib portion 28 overlies the upper chest of the wearer providing critical protection against exposure to the sun's radiation to the wearer's chest where the wearer is more likely to be exposed to the sun's damaging radiation and therefore more likely to incur damage to the skin and underlying cells which can cause skin maladies such as brown spots, aging skin, wrinkles, and more importantly skin maladies as serious as melanomas, and squamous cell carcinomas. In addition, as illustrated in FIG. 12 the back bib portion 33 overlies a portion of the wearer's back that is likely to be exposed to the sun's radiation if the wearer has short hair or if the wearer has hair pulled up in a ponytail or in a hat and therefore, the upper back shield provides critical protection.

As described above, FIGS. 10, 11, 12, 13A-E, 14A-B, and 15A-B the sun protective neckwear 10 is shown being worn by several users, for example, participating in various sports illustrated while running, bicycling, golfing, playing volleyball, playing soccer, or driving a vehicle. When the sun protective neckwear 10 is worn by a user, the neckwear 10 is independent from the wearer's outer top garment for providing a versatile easily removable neckwear 10 that can be donned on and pulled off without removing any of the user's clothes. Furthermore, the sun protective neckwear 10 in the preferred embodiment is manufactured woven in a single tubular body unit having a ship decanter shape 100, as well illustrated in FIGS. 1-8, and preferably with ultraviolet fabric with UPF to provide 90% protection against ultraviolet radiation on the neck, shoulders, upper chest, and upper back. Furthermore, as illustrated in FIGS. 10, 11, and 12 the sun protective neckwear 10 surrounds the wearer's neck and can belie the shoulders, upper chest, and upper back and further provide the wearer with a shield from the sun's rays, especially on the upper chest where the sun is more likely to cause sunburn and long term damage, brown spots to the delicate skin of the upper chest area.

In addition, the sun protective neckwear garment 10 as illustrated in FIGS. 10, 11, 12, 13A-E, 14A-B, and 15A-B, provides a user(s) with a combination of protective and preventative features from the ultraviolet rays of the sun while providing a decorative sun protective neckwear garment 10 to embellish the user's overall outfit.

Figure 16:
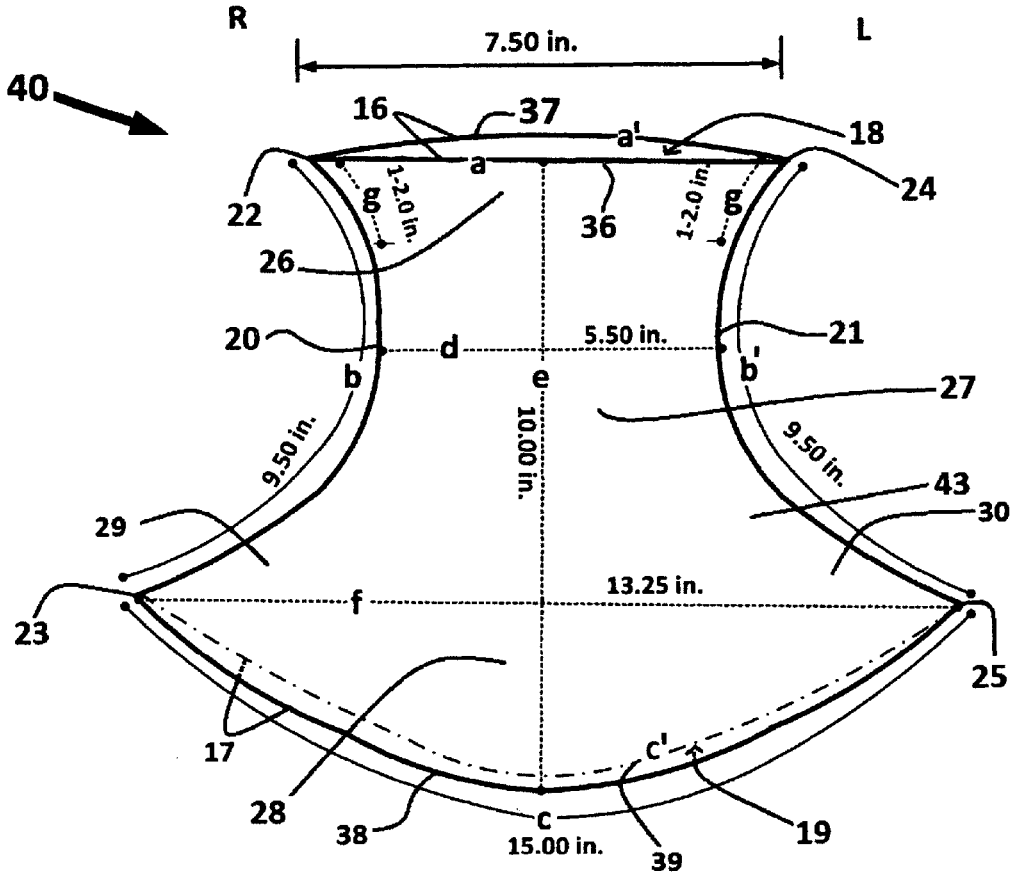
FIG. 16 is a front perspective view of another embodiment of the sun protective neckwear garment, the scoop embodiment, folded and laid flat with demarcation lines to define the front dimensions of the scoop embodiment.
Figure 17:
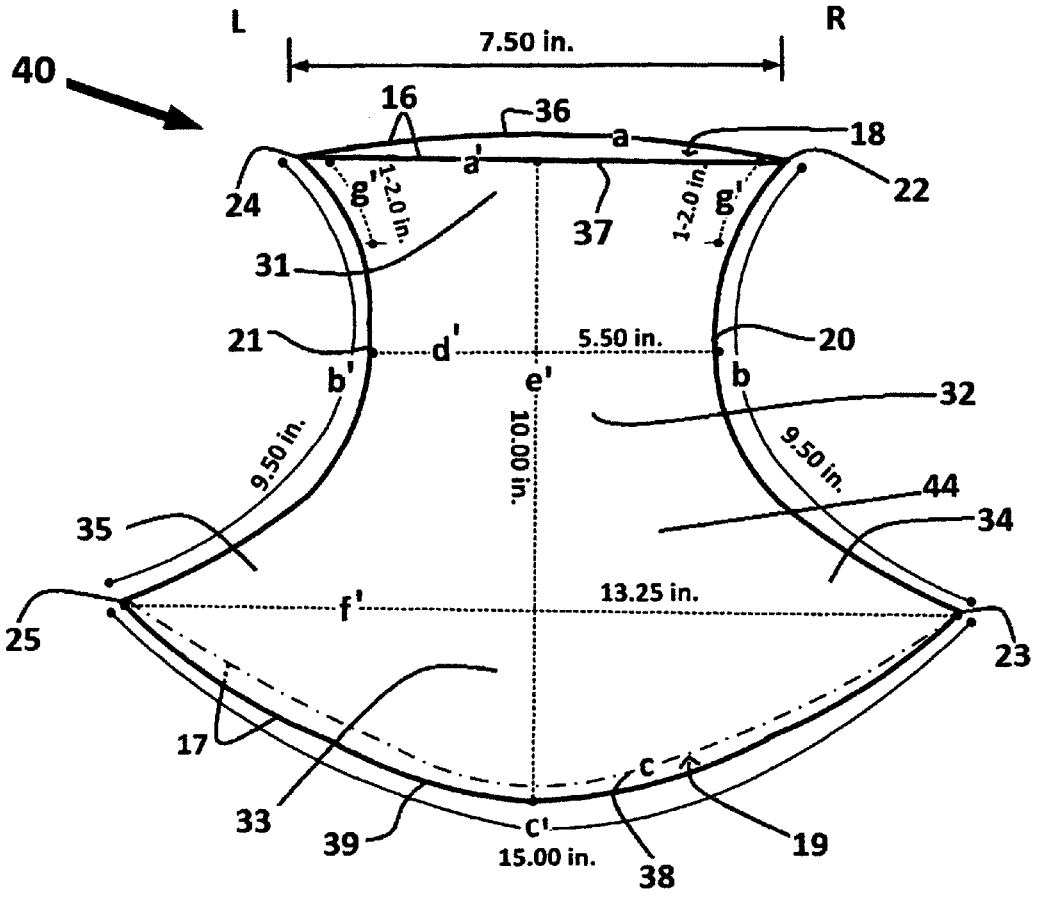
FIG. 17 is a rear perspective view of the scoop embodiment of the sun protective neckwear garment folded and laid flat with demarcation lines to define the back dimensions of the scoop embodiment.

Turning now to another aspect of the present invention, FIGS. 16 and 17 illustrate the neckwear garment 10 in detail with predetermined dimensions to construct the scoop version 40 sun protective neckwear garment 10. The scoop version neckwear garment 40, as illustrated in the drawings shown in FIGS. 16 and 17, retains the numbered elements of the sun protective neckwear garment 10 as illustrated and described above in FIG. 1-8, for consistency and clarity. FIG. 16 is a perspective view of the front side 43 of the scoop sun protective neckwear garment 40 when folded and laid flat with dimensions illustrated in inches and designation lines, described in more detail below. FIG. 17 is a perspective view of the back side 44 scoop sun protective neckwear garment 40 with dimensions illustrated in inches and designation lines, described in more detail below. As illustrated in FIGS. 16 and 17, the dimensions of the scoop sun protection neckwear garment 40 are preferably selected based upon one size fits all. Fabric may stretch up to generally 2.00 inches laterally wherein the fabric has two-way stretch, or in the alternative the fabric may stretch 2.00 inches laterally and longitudinally wherein the fabric has four-way stretch. Alternatively, the dimensions of the sun protective neckwear 40 are selected measured from the size of the person that will be wearing the present invention, as well as, the portion of the wearer's chin.

When disposed on a flat surface, as illustrated in FIG. 16 the scoop sun protection neckwear garment 40 has a first length dimensioned substantially 10.00 inches extending along the front vertical medial axis from the front top straight fabric edge 36 to the front bottom convex fabric edge 38 as indicated by line e seen on the front side 43 of the scoop version neckwear garment 40; and similarly, as shown in FIG. 17, the back side 44 of the scoop version neckwear garment 40 has a second length dimensioned substantially 10.00 inches extending along the back vertical medial axis from the back top straight fabric edge 37 to the back bottom convex fabric edge 39 as indicated by line e' seen on the back side 44 of the neckwear garment 40.

As further illustrated in FIGS. 16 and 17, the two concave sides 20 and 21 of the scoop sun protective neckwear garment 40 are dimensioned equally with the right concave side 20 dimensioned with a third length substantially 9.50 inches along the periphery from right top end point 22 to right bottom end point 23 as indicated by line b; and equally the left concave side 21 is dimensioned with a fourth length substantially 9.50 inches along the periphery from left top end point 24 to left bottom end point 25 as indicated by line b'.

As further shown in FIGS. 16 and 17, the front top straight fabric edge 36 of the sun protective neckwear 10, is dimensioned having a first width substantially 7.50 inches from the right concave side 20 to the left concave side 21 as indicated by line a in FIG. 16; and the back side top straight fabric edge 37 is dimensioned having a second width substantially 7.50 inches extending from the right concave side 20 to the left concave side 21 as indicated by line a' in FIG. 17; and therewith defining the top opening 18 of the scoop version neckwear garment 40 dimensioned having a first exterior circumferential surface substantially 15.00 inches. FIG. 16 shows the front bib portion 28 terminates with a front convex fabric edge 38 having a third width dimensioned along the exterior periphery of the convex fabric edge 38 substantially 15.00 inches from right bottom end point 23 to left bottom end point 25 as indicated by line c seen in FIG. 16; and the back bib portion 33 terminates with a convex fabric edge 39 having a fourth width dimensioned along the exterior periphery of the back convex fabric edge 39 substantially 15.00 inches from right bottom end point 23 to left bottom end point 25 as indicated by line c' seen in FIG. 17; and therewith defining the bottom opening 19 of the neckwear garment dimensioned with a second exterior circumferential surface substantially 30.00 inches.

In addition, as illustrated in FIG. 16 the scoop sun protection neckwear 40 when folded and laid flat includes a front tubular neck portion 27 with a fifth width dimensioned substantially 5.50 inches at its narrowest, as indicated by line d which extends from right concave side 20 to left concave side 21. Similarly, when folded and laid flat, the scoop sun protective neckwear garment 40 includes a back tubular neck portion 32 with a sixth width dimensioned substantially 5.50 inches at its narrowest, as indicate by line d' seen in FIG. 17 which extends from the right concave side 20 to the left concave side 21; and therewith defines the tubular neck portion 12 to include a third exterior circumferential surface dimensioned substantially 11.00 inches which can be further stretched an additional 2 inches if needed or desired with elasticity sufficient when stretched to pass over the head of the wearer and to retract back to fit snugly and comfortably around the wearer's neck.

The front bib portion 28 is dimensioned with a seventh width substantially 13.25 inches extending along a straight line from right bottom end point 23 to left bottom end point 25 as designated by line f, as shown in FIG. 16. Similarly, the back bib portion 33 of the neckwear garment 10 scoop embodiment 40 is dimensioned with an eighth width substantially 13.25 inches extending along a straight line from right bottom end point to left bottom end point as designated by line f' to form a fourth exterior circumferential surface substantially 26.50 inches as illustrated in FIG. 17.

The front chin-collar 26 portion of the scoop sun protective neckwear garment 40 is configured having a fifth length dimensioned substantially 1-2.00 inches extending from the front top straight fabric edge 36 towards the front tubular neck portion 27, designated by line g as illustrated in the front view in FIG. 16; and the back chin-collar portion 31 is configured having a sixth length dimensioned substantially 1-2.00 inches extending from the back top straight fabric edge 37 down towards the back tubular neck portion 32, as illustrated by line g' seen in FIG. 17. Referring back to FIG. 1, the front chin-collar portion 26 can be worn up over the chin of the wearer, or in the alternative, with reference to FIG. 2 the front chin-collar portion 26 can be worn down under the chin of the wearer.

Figure 18:
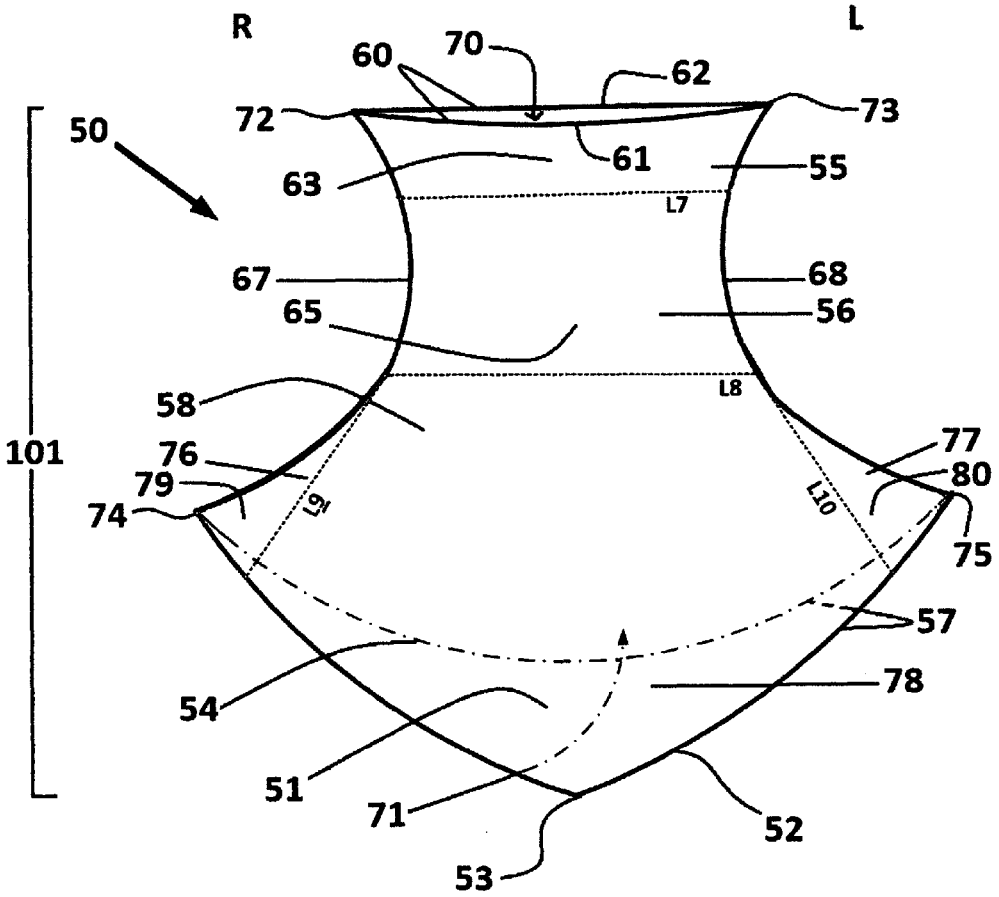
FIG. 18 is a front perspective view of another embodiment of the sun protective neckwear garment, the V-shaped embodiment, folded and laid flat with demarcation lines to define the portions of the V-shaped neckwear garment.
Figure 19:
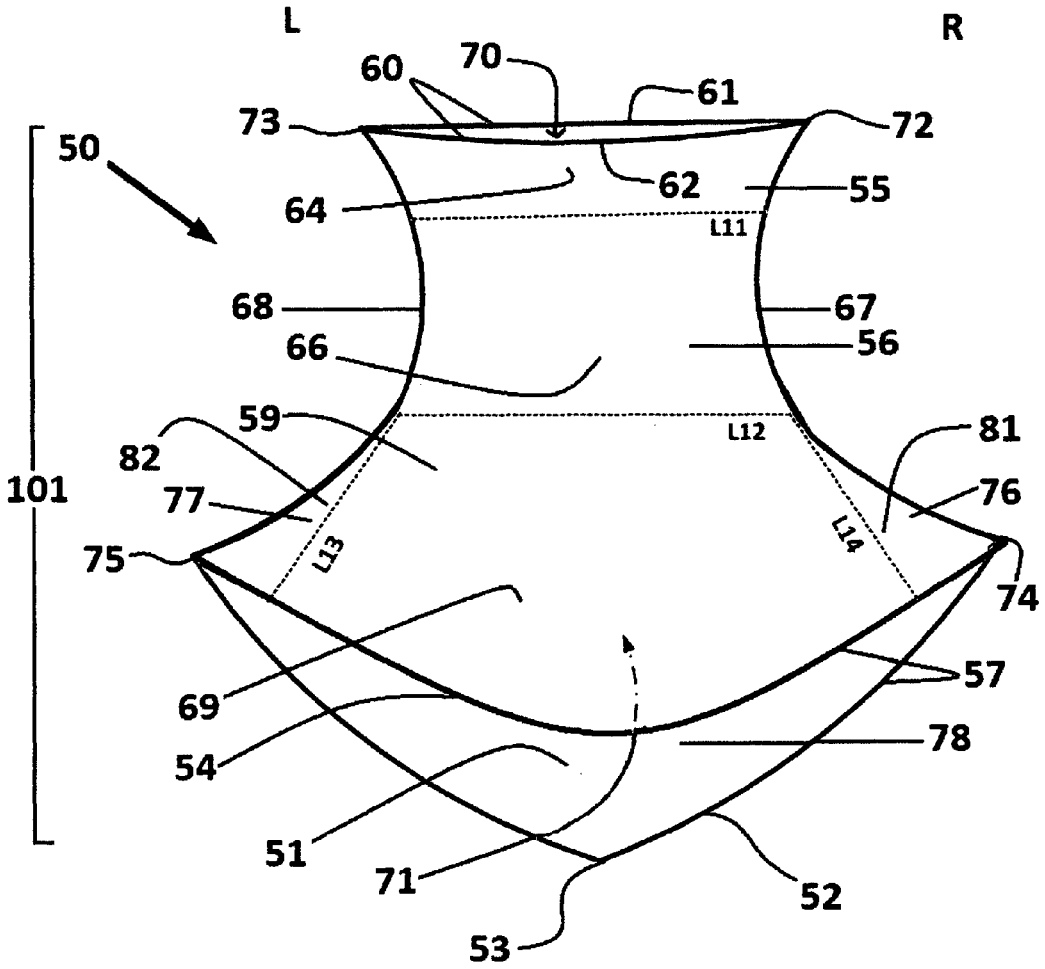
FIG. 19 is a rear perspective view of the V-shaped embodiment of the sun protective neckwear garment folded and laid flat with demarcation lines to define the portions of the V-shaped neckwear garment.

In another embodiment of the present invention, namely the V-shaped version sun protective neckwear garment 50 as illustrated in FIGS. 18-22 the sun protective neckwear garment 10, can be modified to include a front bib portion 51 terminating with a V-shaped bottom fabric edge 52 having an apex 53. As illustrated and described in detail below, it is for illustrative purposes only, the drawings are shown such that the portions within the V-shaped sun protective neckwear garment 50 meet along common lines, L7-L10 as seen in FIG. 18; and along common lines, L11-L14 as seen in FIG. 19. The four portions seamlessly integrally formed including the chin-collar portion 55, the tubular neck portion 56, the bib portion 78 comprising therein the two laterally opposing right shoulder 76 and left shoulder portion 77; such that there are no clear lines of demarcation corresponding to the dotted lines L7-L10 in FIG. 18; such that there are no clear lines of demarcation corresponding to the dotted lines L11-L14 in FIG. 19; such that there are no clear lines of demarcation corresponding to the dotted lines L15-L 16 in FIG. 20; such that there are no clear lines of demarcation corresponding to the lines h-o in FIG. 21; and that there are no clear lines of demarcation corresponding to the lines h'-o' in FIG. 22.

Figure 20:
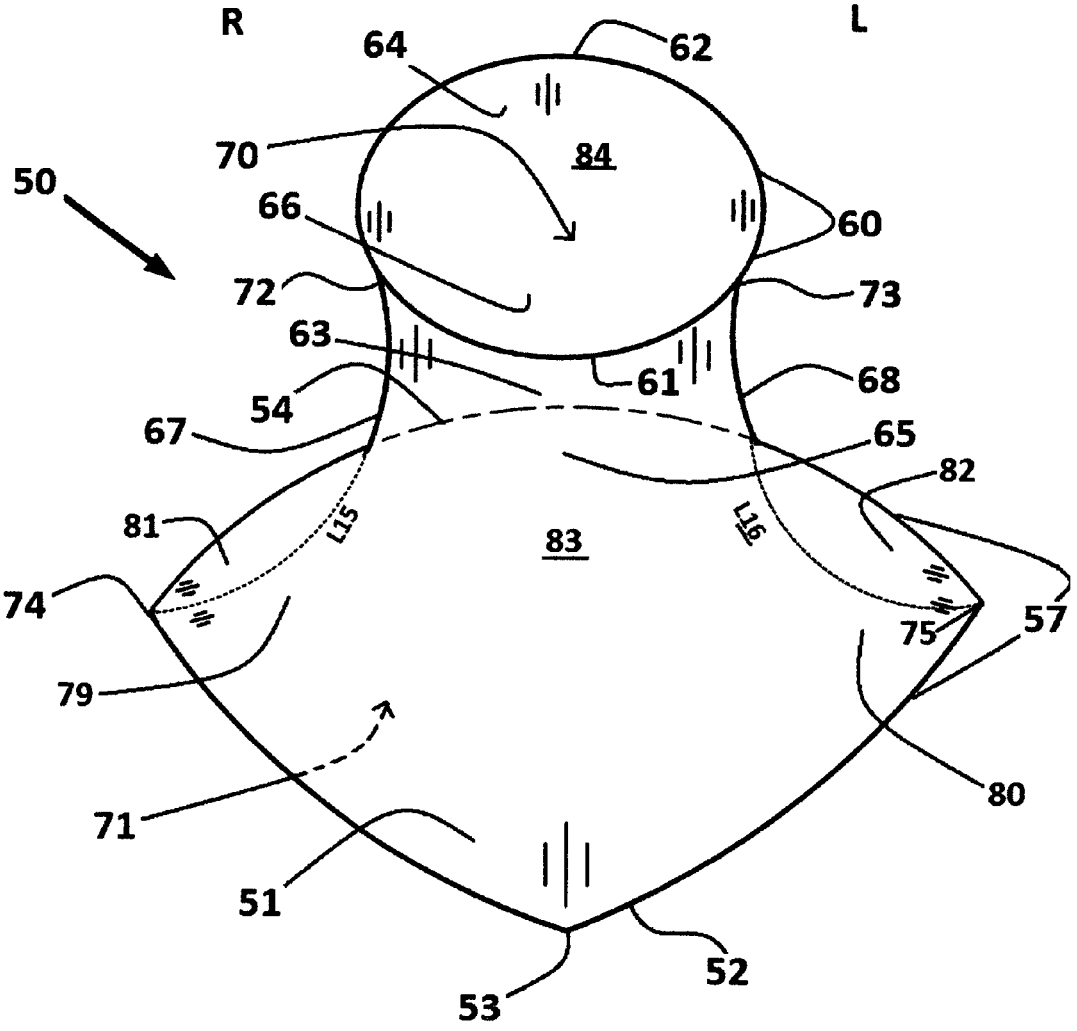
FIG. 20 is an isometric view of the V-shaped embodiment of the sun protective neckwear garment
Figure 21:
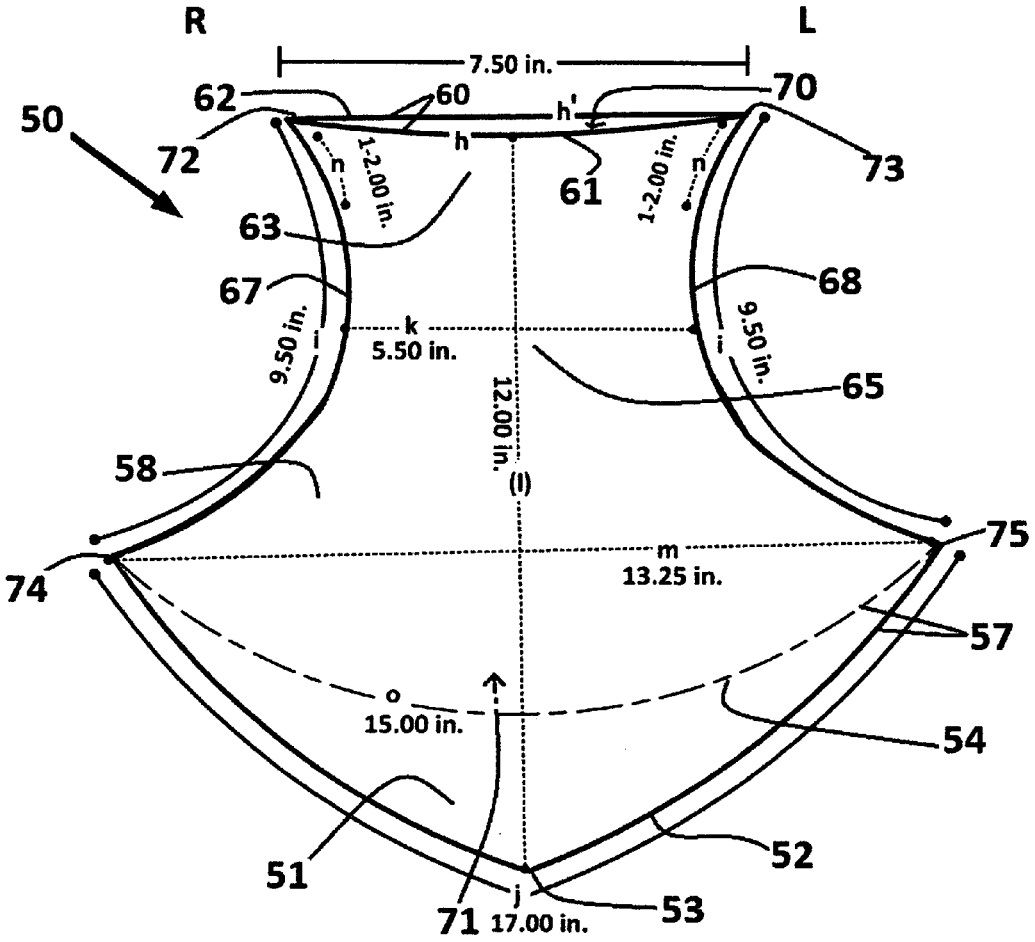
FIG. 21 is a front perspective view of the V-shaped embodiment of the sun protective neckwear garment folded and laid flat with demarcation lines to define the front dimensions of the V-shaped embodiment of the sun protective neckwear garment.
Figure 22:
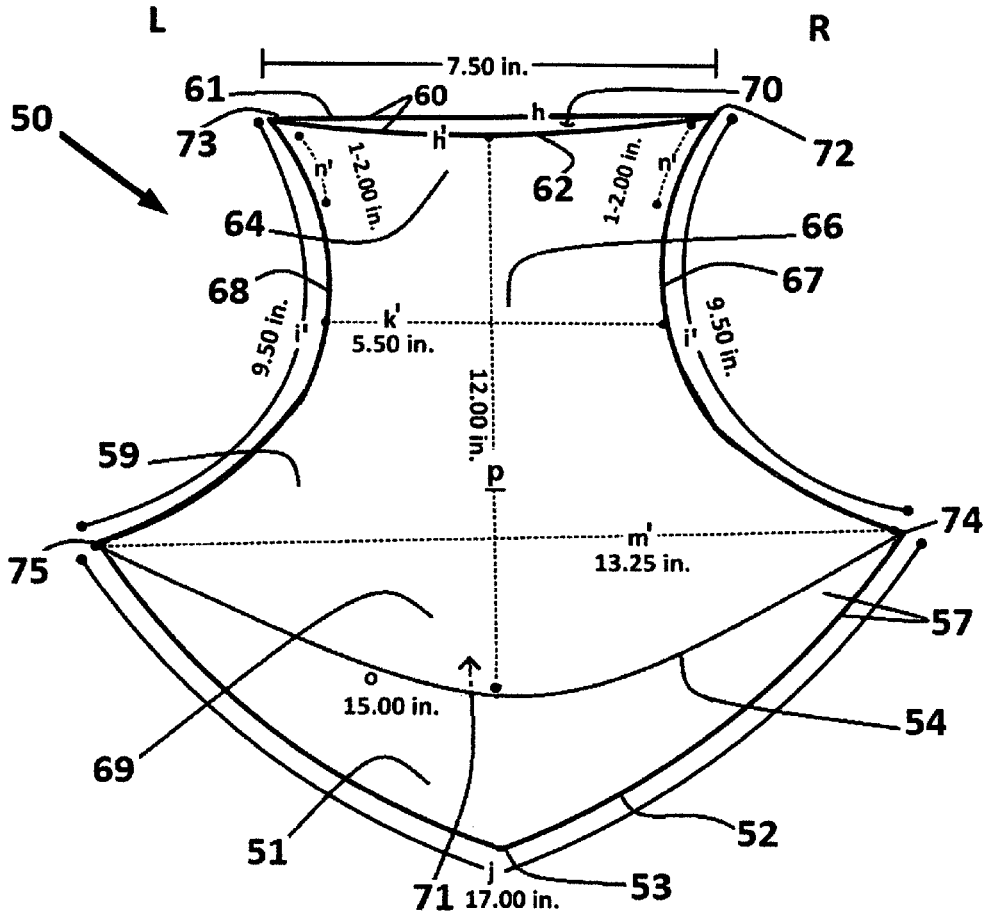
FIG. 22 is a rear perspective view of the V-shaped embodiment of the sun protective neckwear garment with demarcation lines to define the rear dimensions of the V-shaped embodiment.

FIG. 18 is a perspective view of the front side 58 of the V-shaped sun protective neckwear garment 50 folded and laid flat; FIG. 19 is a perspective view of the back side 59 of the V-shaped sun protective neckwear garment 50 folded and laid flat; FIG. 20 is an isometric view of the V-shaped sun protective neckwear garment; and FIGS. 21 and 22 are front and back perspective views, respectively, of the V-shaped neckwear garment 50 further showing preconfigured dimensions with demarcations, described in more detail below. Further, as illustrated in FIGS. 18-22, the back side 59 of the V-shaped sun protective neckwear garment 50 adopts the back side 44 configuration of the sun protective neckwear garment 10, such that back bib portion 69 of the V-shaped sun protective neckwear garment 50 terminates with a bottom convex fabric edge 54.

Addressing the V-shaped sun protective neckwear garment 50 in more detail, FIGS. 18-22 further illustrates the V-shaped sun protective neckwear garment 50 comprises a continuous single body tubular unit having a generally ship decanter shape 100 adopted from the sun protective neckwear garment 10, as illustrated and described above in FIGS. 1-12, wherein FIGS. 18-22 shows the V-shaped neckwear embodiment 50 is notably modified to include the front V-shaped bib portion 51 further contoured to include the front V-shaped bottom fabric edge 52, having an apex 53, while adopting the substantially identical back side 44 of the sun protective neckwear garment 10, to form the single tubular body unit having a generally V-shape ship decanter shape 101.

Further, FIG. 18 shows the front V-shaped bottom fabric edge 52 and the apex 53 pointing down; and further shows the back bottom convex fabric edge 54 is defined by long dashed-dot lines, hidden by the front V-shaped bib portion 51. The rear view of the V-shaped sun protective neckwear garment 50 is illustrated in FIG. 19 showing the back bib portion 69 terminates with the back side convex fabric edge 54; the back side 59 is shorter in length than the front V-shaped side 58. Further FIG. 19 illustrates the longer front V-shaped bottom fabric edge 51 revealed behind the shorter back bottom convex fabric edge 54. The V-shaped sun protective neckwear garment 50 provides a greater front V-shaped bib portion 51 surface area to shield the wearer's upper chest and skin from the sun's radiation and allows the sun protection neckwear to reach the other top garment of the wearer. Equally, the V-shaped neckwear garment 50 provides more surface area and thereby enables more moisture to be wicked from the wearer's body.

As described and illustrated, it is for illustrative purposes only, the drawing in FIGS. 18 and 19, are shown such that the portion within the V-shaped sun protective neckwear garment 50 meet along common lines defined by tiny dotted lines L7-L10 in FIG. 18; and delineated by dotted lines L11-L14 in FIG. 19. As illustrated in FIGS. 18 and 19, the V-shaped neckwear embodiment 50 includes basically four elasticized seamless integral portions configured circumferentially including the chin-collar portion 55, tubular neck portion 56, V-shaped bib portion 51; wherein the V-shaped bib portion 51 includes two laterally opposing shoulder portions 76 and 77, the right shoulder portion 76 and left shoulder portion 77. As seen in FIG. 18, the front side 58 of the V-shaped neckwear garment 50 shows the front chin-collar portion 63 is bounded by the front top straight fabric edge 61 and laterally by the two laterally opposed concave sides 67 and 68 and terminates generally at L7 where the front chin-collar portion 63 integrally seamlessly merges with the front tubular neck portion 65; the front tubular neck portion 65 is bounded laterally by the two laterally opposed concave sides 67 and 68 and generally terminates at L8 where the tubular neck portion 65 integrally seamlessly merges with the front V-shaped bib portion 51; the front V-shaped bib portion 51 terminates with the V-shaped bottom fabric edge 52 with apex 53 and the front V-shaped bib portion 51 is bound laterally by the two laterally opposed shoulder portions 79 and 80; the front V-bib portion 51 integrally seamlessly merges with the front right shoulder portion 79 at L9; and to the laterally opposing front left shoulder portion 80 at L10. The right shoulder portion 79 is bounded by the right concave side 67 and merges with the right concave side 67 when the neckwear garment 10 is stretched in the open position, as illustrated in FIG. 20 at line L15. The left shoulder portion 80 is bounded by the left concave side 68 and merges with the left concave side 68 when the V-shaped neckwear garment 50 is stretched open, as illustrated in FIG. 20 at line L16.

FIG. 19 is a perspective view of the V-shaped sun protective neckwear garment showing the back side 59 of the neckwear garment 50 showing the back chin-collar portion 64 is bounded by the back top straight fabric edge 62 and laterally by the two laterally opposed concave sides 67 and 68 and terminates generally at L11 where the back chin-collar portion 64 integrally seamlessly merges with the back tubular neck portion 66; the back tubular neck portion 66 is bounded laterally by the two laterally opposed concave sides 67 and 68 and generally terminates at L12 where the back tubular neck portion 66 integrally seamlessly merges with the back bib portion 69; the back bib portion 69 terminates with the back convex fabric edge 54; and the back bib portion 69 is bound laterally by the back right shoulder portion 81 and the back left shoulder portion 82 integrally seamlessly extending to the back right shoulder portion 81 and to the laterally opposing left shoulder portion 82. The back bib portion 69 merges with the right shoulder portion 81 at L14 and with the left shoulder portion at L13. The back right shoulder portion 81 is bound by the right concave side 67 and merges with the right concave side 67 when the neckwear garment 50 is stretched in the open position, as illustrated in FIG. 20 at line L15. The back left shoulder portion 82 is bounded by the left concave side 68 and merges with the left concave side 68 when the V-shaped neckwear garment 50 is stretched open, as illustrated in FIG. 20 at line L16.

FIG. 18 further illustrates the circumferential top straight fabric edge 60 which defines the top opening 70 of the V-shaped neckwear garment 50 and contemporaneously provides the top straight fabric edge 60 of the chin-collar portion 55 of the V-shaped sun protective neckwear garment 50. As illustrated, in FIG. 18, with reference to FIG. 20, the front top straight fabric edge 61 and the back top straight fabric edge 62 are continuous to form the top circumferential straight fabric edge 60. FIG. 19 with reference to FIG. 20, further illustrates the circumferential top straight fabric edge 60 which defines the top opening 70 of the V-shaped neckwear garment 50 and contemporaneously provides the top straight fabric edge 60 of the chin-collar portion 55 of the V-shaped sun protective neckwear garment 50.

Focusing on drawing FIGS. 18 and 19 with reference to FIG. 20, described in more detail below, the illustrations show the V-shaped neckwear garment's 50 unique bottom circumferential V-convex fabric edge 57 which defines the larger bottom opening 71 and contemporaneously provides the bottom V-shaped fabric edge 52 of the front V-shape bib portion 51 of the V-shaped neckwear garment 50 and the back bottom convex fabric edge 54 of the back bib portion of the V-shaped neckwear garment 50. As illustrated, the front bottom V-shaped fabric edge 51 and the back bottom convex fabric edge 54 are continuous and seamlessly integrated to form the bottom combination V-convex circumferential fabric edge 57 that defines the bottom opening 71. Further, as illustrated in FIGS. 18, 19, and 20, the circumferential top fabric edge 60 of the V-shaped neckwear garment 50 and the bottom combination V-convex bottom fabric edge 57 are joined by the two laterally opposed vertically aligned substantially identical concave generally C-shaped sides 67 and 68, the right concave side 67 and the left concave side 68, at two laterally opposing top end points 72 and 73, the right concave side end point 72 and a left concave side end point 73, and joined by two laterally opposing bottom concave side end points 74 and 75, a right concave side end point 74 and a left bottom concave side end point 75. The two concave sides 67 and 68, as illustrated, are shared by the chin-collar portion 55; and shoulder portions 76 and 77; and the tubular neck portion 56 therebetween. The two opposing concave sides 67 and 68 provide the unique tubular ship decanter shape 101 of the V-shaped neckwear garment 50.

Furthermore, FIG. 20, an isometric view of the V-shaped sun protective neckwear garment 50, shows the unique single tubular body unit having the V-shaped ship decanter shape 101, having an exterior surface 83 and an interior surface 84. In addition, FIG. 20 shows the V-shaped sun protective neckwear garment 50 top opening 70 and the larger bottom opening 71 integrally seamlessly formed by the two concave sides 67 and 68. As illustrated, the bottom opening 71 is stretched in the open position elucidating the two concave sides 67 and 68 seamlessly integrated into the tubular decanter shape 101 of the V-shaped neckwear garment 50. In addition, the V-shaped sun protective garment 50 shows the front side 58 showing the V-shaped bib portion 51 terminating with the bottom V-shaped fabric edge 52 with apex 53 pointing down; and shows the V-shaped fabric edge 52 integrally seamlessly formed to the back bottom convex edge 54, a portion of which is hidden by the front V-shaped bib portion 51 and designated by the dashed line at 54; to form the circumferential V-convex fabric edge 57. In addition, FIG. 20 shows the portions of the V-shaped neckwear garment 50 including the front neck chin-collar portion 63 which integrally seamlessly circles back to the back chin-collar portion 64. Further, FIG. 20 shows the front chin-collar portion integrally seamlessly formed to the front tubular neck portion 65 wherein the front tubular neck portion 65 circles back to the back tubular neck portion 66; and the front tubular neck portion 65 is integrally seamlessly formed to the front V-shaped bib portion 51; and the front V-shaped bib portion 51 is integrally seamlessly formed to the front right shoulder portion 79 and to the laterally opposing left front shoulder portion 80; and the front right shoulder portion 79 integrally seamlessly circles back to the back right shoulder portion Turning now to an additional aspect of the V-shaped sun protective neckwear garment 50, FIGS. 21 and 22 illustrate the V-shaped neckwear garment 50 in detail with predetermined dimensions to construct the V-shaped sun protective garment 50. FIG. 21 is a perspective view of the front side 58 of the V-shaped sun protective neckwear garment 50 when folded and laid flat with dimensions illustrated in inches and designation lines. FIG. 22 is a perspective view of the back side 59 of the V-shaped sun protective neckwear garment 50 with dimensions illustrated in inches and designation lines. As described and illustrated, it is for illustrative purposes only, the drawing in FIGS. 21 and 22, are shown such that the portion within the V-shaped sun protective neckwear garment 50 meet along common lines defined by tiny dotted lines h-o in FIG. 21; and delineated by dotted lines h'-k; m-p; in FIG. 22. As illustrated in FIGS. 21 and 22, the dimensions of the V-shaped sun protection neckwear garment 50 are preferably selected based upon one size fits all. Fabric may stretch up to generally 2.00 inches laterally wherein the fabric has two-way stretch, or in the alternative the fabric may stretch 2.00 inches laterally and longitudinally wherein the fabric has four-way stretch. Alternatively, the dimensions of the V-shaped sun protective neckwear 50 are selected measured from the size of the person that will be wearing the present invention as well as the portion of the wearer's chin.

Referring to FIG. 21, the front side of the V-shaped sun protection neckwear 50 is dimensioned with a first length substantially 12.00 inches along the front vertical medial axis extending from the front top straight fabric edge 61 to the apex 53 of the bottom V-shaped fabric edge 52, as indicated by line (1) seen in FIG. 21. As illustrated in FIG. 22 a rear view perspective of the V-shaped sun protection neckwear 50 the back side is dimensioned with a second length substantially 10.00 inches along the back vertical medial axis extending from the back straight fabric edge 62 to the back bottom convex fabric edge 54, as indicated by line p, seen in FIG. 22.

The two concave sides 67 and 68 of the V-shaped sun protective neckwear 50 as illustrated in FIG. 21 and FIG. 22 are generally parallel vertically aligned and substantially identical to each other. Right concave side 67 is dimensioned with a third length substantially 9.50 inches along the periphery from right top end point 72 to right bottom end point 74 as designated by line i seen in FIG. 21; and similarly left concave side 68 is dimensioned with a fourth length substantially 9.50 inches along the periphery from left top end point 73 to left bottom end point 75 as designated by line i' seen in FIG. 22.

Further, FIGS. 21 and 22, shows the V-shaped neckwear garment 50 embodiment when folded and laid flat, has the front top straight fabric edge 61 dimensioned with a first width substantially 7.50 inches extending from the right top end point 72 to the left top end point 73, as designated by line h seen in FIG. 21; and similarly has a back straight fabric edge 62 dimensioned with a second width substantially 7.50 inches extending from the right top end point 72 to the left top end point 73, as designated by line h' seen in FIG. 22; and therewith define the top opening 70 of the V-shaped neckwear garment 50 dimensioned with a first circumferential surface substantially 15.00 inches.

Further as illustrated in FIGS. 21 and 22, the front V-shaped bib portion 51 of the V-shaped neckwear 50 embodiment terminates with bottom V-shaped fabric edge 52 having apex 53; wherein the V-shaped fabric edge 52 has a third width dimensioned along the exterior surface of the peripheral V-shaped fabric edge 52 substantially 17.00 inches from the right bottom end point 74 to the left bottom end point 75 as designated by line j; and the back bottom convex fabric edge 54 has a fourth width dimensioned substantially 15.0 inches along the exterior peripheral convex fabric edge 54 from the right bottom end point 74 to the left bottom end point 75 as indicated by line o; therewith the front V-shaped fabric edge 52 and the back bottom convex fabric edge 54 defining the bottom opening 71 of the V-shaped neckwear garment 50 dimensioned having a second exterior circumferential surface substantially 32.00 inches. FIG. 21 shows the hidden back convex fabric edge 54 behind the longer front V-shaped bib portion 51, and is delineated by a dashed line o. The circumferential distance along the edge of the bottom opening can be stretched an additional 2.00 inches laterally in 2-ways, or 4-ways laterally and longitudinally depending on the elasticity of the weaved fabric, if needed or desired with elasticity sufficient when stretched to pass over the head of the wearer and to retract back to fit snugly and comfortably around the wearer's shoulders and upper chest and upper back.

In addition, as illustrated in FIG. 21, the V-shaped sun protection neckwear 50 when folded and laid flat includes a front tubular neck 65 fifth width dimensioned substantially 5.50 inches at its narrowest, as indicated by line k which extends from right concave side 67 to left concave side 68. Similarly, as illustrated in FIG. 22 when folded and laid flat, the V-shaped sun protection neckwear 50 embodiment, includes a back tubular neck portion 66 having a sixth width dimensioned substantially 5.50 inches, as indicate by line k' seen in FIG. 22, which extends from the right concave side 67 to the left concave side 68, defining the tubular neck portion 12 at its narrowest of the V-shaped sun protective neckwear garment 50 having a third circumferential surface distance dimensioned substantially 11.00 inches.

In addition, as shown in FIG. 21, the front V-shaped bib portion 51 is dimensioned with a seventh width substantially 13.25 inches along a straight line, as indicated by line m seen in FIG. 21, from one vertically aligned concave side bottom end point 74 to the opposing vertically aligned concave side bottom end point 75; and as seen in FIG. 22 the back bib portion 69 of the V-shaped neckwear garment 50 is dimensioned with an eighth width dimensioned substantially 13.25 inches along a straight line, as indicated by line m' seen in FIG. 22, from one concave side bottom end point 74 to the opposing concave side bottom end point 75; therewith defining the fourth circumferential exterior surface dimensioned substantially 26.50 inches.

The front side chin-collar portion 63 in the V-shaped neckwear garment 50 embodiment extends a distance of 1.00-2.00 inches from the front top straight fabric edge 61 down towards the front tubular neck portion 65 as indicated by line n, seen in FIG. 21; and the back chin-collar portion 64 in the V-shaped neckwear 50 extends a distance of 1-2 inches from the back top straight fabric edge 62 towards the back tubular neck portion 66, as indicated by line n' in FIG. 22.

It will be further apparent, in another embodiment of the present invention, the sun protective neckwear 10, crafted as the scoop shaped version 40, or V-shaped version neckwear garment 50, may be configured, crafted as one size fits all configuration, or as needed, as extra-small, small, medium, large, extra-large, etc. and or the like, having predetermined measurements configured corresponding therewith, or predetermined measurements customized for a specific wearer.

For complete effectiveness of the invention, the sun protective neckwear garment 10 is worn, with reference to FIG. 10 showing the chin-collar portion in the up position stretched over and covering the wearer's chin. It is well apparent, that the scoop sun protective neckwear garment 40 and the V-shaped neckwear garment 50 can be worn with the chin-collar portion 11 and 63, respectively, in the up position or in the folded down position. In addition, the V-shaped neckwear garment 50 can be worn for complete effectiveness of the configuration with the V-shaped bib portion 51 in the front to cover the wearer's chest; or in the alternative if the wearer is engaging in activity which exposes the wearer's upper back to the sun, the V-shaped bib portion 51 may be oriented to the back and with the convex fabric edged bib 69 oriented to the front to protect the wearer's upper chest. Generally, the chin-collar portion 11 of the sun protective neckwear 10; scoop neckwear version 40, and/or V-shape neckwear version 50 is preferably made circumferentially with a measurement the distance from the midpoint of an average wearer's chin extending and stretching with a two inch extra extended elasticized pull around the measure of an average wearer's head such that when it joins back at the midpoint of the wearer's chin it recedes tightly and comfortably about the wearer's chin in the pulled up position. The circumferential measurement of the tubular neck portion 12 of the neckwear garment 10; tubular neck portion 12 of the scoop version neckwear garment 40, and/or the tubular neck portion 56 of the V-shaped version neckwear garment 50 should be of predetermined measurements to include the circumferential distance around the average neck of a wearer such that the tubular neck portion 2 fits tightly but comfortably around the wearer's neck for effectiveness when the garment is worn, as illustrated in FIG. 10.

The manufacture of the sun protective neckwear 10, the scoop shaped version 40 and the V-shaped version 50 according to the preferred embodiment, is made configured in a seamless single tubular body unit having generally a ship decanter shape 100, woven with ultraviolet blocking thread to form a neckwear garment with preferably a 24-28 gauge using a circular sewing machine, or a double needle-bar raschel knitting machines for producing seamless garments for example, a SANTONI, or a knitting machine supplied by KARL MAYER, or by LIBA, double needle bar warp knitting, double needle bar raschel machines, or any circular knitting machines for seamless garments. The sun protective neckwear garment 10 is preferably manufactured wherein the woven fabric comprises 1 ply weaved fabric; in the alternative, the sun protective neckwear garment 10 can be made having a 2-ply weaved fabric.

As illustrated in FIG. 23A-D, the sun protective neckwear garment 10, in another embodiment can be configured and constructed to form the seamed sun protective neckwear garment 90 with a first sheet 91 of fabric, as shown in FIG. 21A, and a second sheet 92 of fabric, as shown in FIG. 21B; each sheet of fabric 91 and 92 having a substantially identical ship decanter shape 100 adopted from the sun protective neckwear garment 10.

Figure 23:
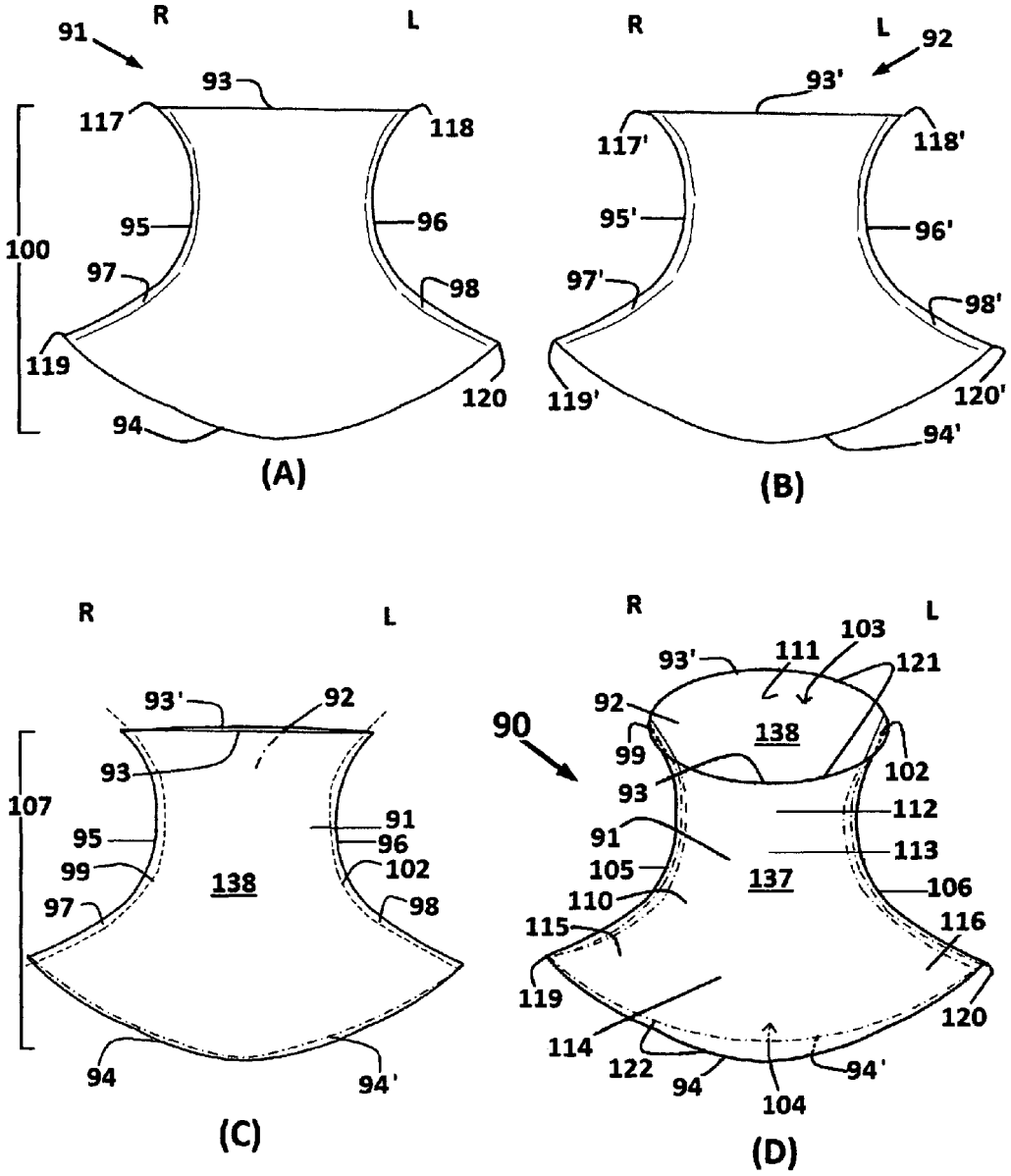
FIG. 23A-23D is a schematic illustration showing the steps to form the seamed embodiment of the sun protective neckwear garment.

FIG. 23A-D is a schematic illustration of the construction of the seamed sun protective neckwear garment 90. FIGS. 23 A and B shows the first step in constructing the seamed sun protective neckwear garment 90 where two sheets of fabric 91 and 92 are provided having a ship decanter shape 100. FIG. 23A shows the first sheet of fabric 91 has a top straight fabric edge 93; and a bottom concave fabric edge 94 joined by two laterally opposing generally parallel substantially identical concave fabric side edges 95 and 96, a right concave fabric edge 95 and a left concave fabric edge 96. The right concave fabric edge 95 has a marginal edge 97 therein; and the left concave side 96 has a marginal edge 98 therein; and further the right concave side 95 has right top end point 117 and a right bottom end point 119; and the left concave side 96 has a left top end point 118 and a left bottom end point 120. Further, as shown in FIG. 23B the second sheet of fabric 92 has a top straight fabric edge 93'; and a bottom concave fabric edge 94' joined by two laterally opposing generally parallel substantially identical concave fabric sides 95' and 96', a right concave side 95' and a left concave side 96'. The right concave side 95' of the second sheet of fabric has a marginal edge 97' therein; and the left concave side has a marginal edge 98' therein; and further the right concave side 95' has a right top end point 117' and a right bottom end point 119'; and the left concave side has a left top end point 118' and a left bottom end point 120'.

Referring to FIG. 21C the second step requires aligning the first sheet 91 with the second sheet 92; the first sheet 91 is placed lying flat against the second sheet 92 with the top straight fabric edges 93 and 93' aligned; and the two right concave sides 95 and 95' aligned; and front bottom convex fabric edges 94 and 94' aligned; so that the two sheets 91 and 92 are aligned as mirror images with respect to each other. Next, required by the third step, the two sheets 91 and 92 of fabric 91 and 92 are seamed together along the right concave side marginal edges 97 and 97' thereof; and the two sheets of fabric 91 and 92 are seamed together along the left concave marginal edges 98 and 98' thereof, to form the joined seamed sun protective neckwear 90 having single tubular body unit having a generally ship decanter shape 107 with seamed portions 99 and 102, designated by short dashed lines, a right seam 99 and a left seam 102.

Then, required by the fourth step, the seamed sun protective neckwear garment 90 is turned inside out by pulling the top straight fabric edge 93 thoughin the interior of the seamed neckwear garment 90 along a vertical axis and out though the bottom opening 104. The side stitched seams 99 and 102 are concealed therein, as illustrated by the dashed-dot lines in FIG. 23 D; and revealed in this elevation view at 105 and 102 on the interior surface 138 of the seamed neckwear garment 90. As illustrated in FIG. 23D, the seamed sun protective neckwear garment 90 is contoured to the single body tubular ship decanter shape 100 and having the smaller opening 103 oriented at the top and the larger opening 104 at the bottom, and the vertically aligned seamed concave sides 105 and 106 therebetween; and first sheet 91 deemed the front side 110 and second sheet 92 of fabric deemed the back side 111 of the seamed sun protective neckwear garment 90, which are substantially identical; and further having an exterior surface 137 and an interior surface 138 substantially identical. The seamed sun protective neckwear garment 90 is now ready to be worn by a user.

Further, FIG. 23D shows an elevation view of the seamed neckwear garment 90 wherein the top opening 103 is defined by circumferential top straight fabric edge 121, formed by first sheet bottom convex edge 94 and second sheet bottom convex fabric edge 94'; and a larger bottom opening 104 defined by circumferential bottom convex fabric edge 122 formed by first sheet top fabric edge 93 and second sheet top fabric edge 93'; and circumferential fabric edge 121 and bottom circumferential bottom edge 122 joined by two seamed concave sides 105 and 106, a right seamed concave side 105 and a left seamed concave side 106. It should be noted the two sheets of fabric 91 and 92 can be seamed together using any suitable stitching method including lock stitch (single or double), chain stitch (single or double), overlock stitch (three thread or four thread), safety stitch (five thread or six thread) and cover stitch). In the alternative, the two sheets of fabric 91 and 92 can be affixed together proximate to the two concave sides 95 and 95' and 96 and 96' marginal edges 97 and 97' and marginal edges 98 and 98' using the affixing means, welding. Or in the alternative, the two sheets 91 and 92 of fabric can be affixed to each other by sewing, followed by welding.

The seamed sun protective neckwear garment 90 includes the four portions seen in the sun protective neckwear garment 10, as illustrated in FIG. 23D, the chin-collar portion 112; the tubular neck potion 113; the bib portion 114 wherein the bib portion 114 extends to the right shoulder portion 115 and to the laterally opposed left shoulder portion 116. The front side 110 and the back side 111 of the seamed sun protective neckwear garment 90 are substantially identical and include an exterior surface 137 and an interior surface 138, substantially identical:

In use, the wearer orients the sun protective neckwear garment 90 with the smaller opening 103 at the top and the larger opening 104 at the bottom, and pulls the wearer's head therein the bottom opening 104 and through the smaller top opening 103, maneuvering the tubular neck portion 113 around the wearer's neck with the seamed concave sides 105 and 106 laterally opposed juxtaposed to each side of the wearer's neck; and the bib portion 114 to lay upon the wearer's upper chest and upper back, the shoulder portions 115 and 116 to extend over a portion of the wearer's shoulders, and the chin-collar portion 112 stretched over the wearer's chin, or in the alternative the chin-collar portion 112 folded down under the wearer's chin.

Readily apparent to those skilled in the art, the same method of constructing the seamed sun protective neckwear garment 90 described above including two sheets of fabric 91 and 92, can be adopted to craft the scoop version sun protective neckwear garment 40 as illustrated in FIGS. 16 and 17; and craft the V-shaped sun protective neckwear garment 50 as illustrated in FIGS. 21 and 22. It is recommended to increase the lateral width of the second sheet by substantially 1.00 inch-1.50 inches to provide a seam allowance. In addition, the same method of constructing the seamed protective neckwear garment 90 can be used to construct a custom made sun protective neckwear garment 10 for a particular user needing or desiring a specific size, color, and the like. In addition, the seamed sun protective neckwear garment 90 can be made in a plurality of colors; and further the first sheet 91 can have a different color from the second sheet 92.

The sun protection neckwear garment 10, the scoop neckwear garment 40, or the V-shaped neckwear garment 50, or the seamed sun protective neckwear garment 90, are configured and manufactured to be very versatile, flexible, not rigid, and require small amounts of material. For that purpose, the neckwear 10 can be made by a single piece of fabric with two of its opposite side edges sewn, or woven, or welded, or removably fastened together, to form a single seam and to achieve the form of the continuous single body tubular unit having the ship decanter shape 100. The seam edges may be affixed by any fastening means such as sewing, welding, or removably fastened by any fastening means such as hook and loops, zippers, VELCRO®; buttons; snaps; hook and eyes; plastic snap strips; and/or the like.

Turning now to FIG. 24A-B, with reference to FIG. 1-5, shows a schematic illustration of an alternative embodiment of a VELCRO® sun protective neckwear garment 200 wherein the sun protective neckwear garment 10 is provided, and wherein the neckwear garment 10 further comprises a split 85 to form a split sun protective neckwear blank 150 shown in FIG. 24A. The previously numbered aspects, as seen in FIG. 1-5 of the sun protective neckwear garment 10 will be reserved while describing the split sun protective neckwear blank 150 and the VELCRO® sun protective neckwear garment 200 embodiment for brevity and clarity. The first step of construction of the VELCRO® neckwear garment 200 requires providing a sun protective neckwear garment 10 and cutting a split 85 along the vertical medial axis of the back side 44 of the neckwear garment 10 to form the split sun protective blank. FIG. 24A is a perspective view of the back of the split sun protective neckwear blank 150 which shows the split 85 along the vertical medial axis of the back side 44 extending from the back top straight fabric edge 37 to the back bottom convex fabric edge 39 forming a first end 86 and a second end 87 which creates a first end 86 and second opposite longitudinal end 87, each having an exterior surface 41 and an interior surface 42. In addition, each end 86 and 87 have longitudinal marginal edges 88 and 89, respectively therein. The second step requires securing fastening means 123 and corresponding fastening means 124 on the first end 86 and the second end 87 to form the VELCRO® sun protective neckwear garment 200. According to this aspect of the invention 200, the fastening means 123 and 124 are provided by first strip 47 and second strip 47' of hook-and-loop material having a pile, more particularly, VELCRO®.

Figure 24:
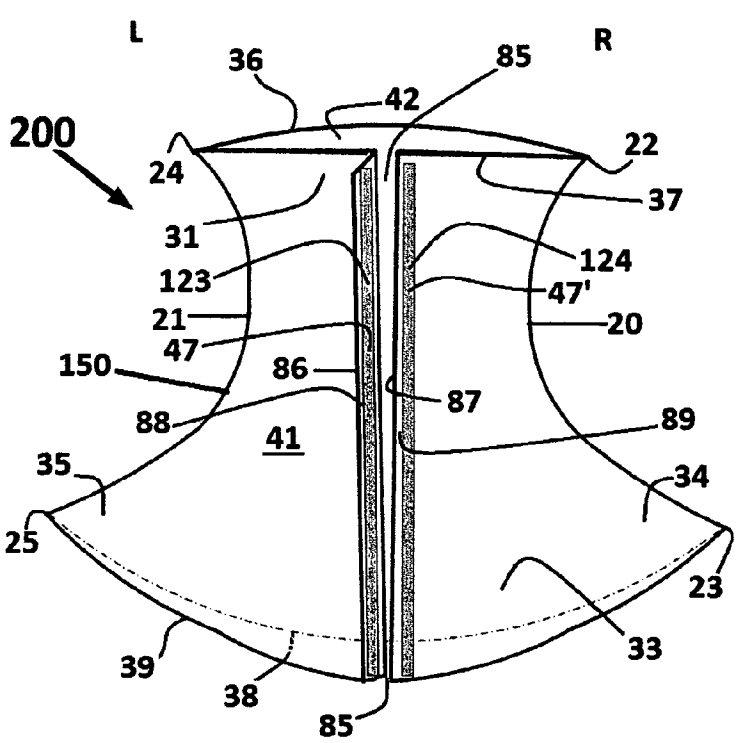
FIG. 24A-24B is a schematic illustration showing the step to form the split embodiment of the sun protective neckwear garment having the medial split located on the back of the sun protective neckwear garment seen in FIG. 24 A; and the step to form the VELCRO® embodiment of the sun protective neckwear garment having VELCRO® fastening means affixed upon the vertical medial split of the rear portion of the sun protective neckwear garment seen in FIG. 24B.
Figure 25:
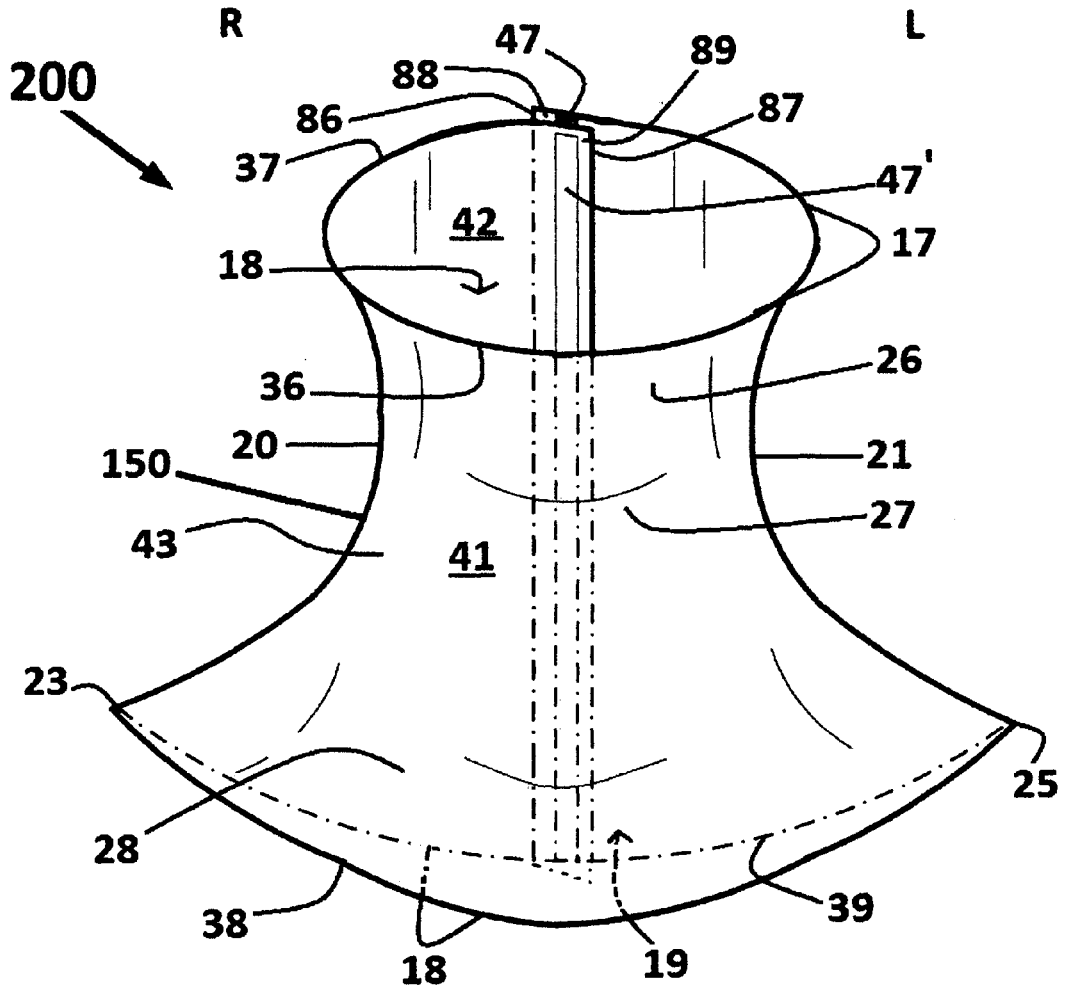
FIG. 25 is an elevation view of the VELCRO® embodiment of the sun protective neckwear garment with VELCRO® fastening means in the closed position.

FIG. 24B is a perspective view of the back of the sun protective garment 200 showing the first end 86 bent forward for the viewer to see the interior surface 42 affixed with a first fastening means 123, more particularly VELCRO® 47, affixed along the first longitudinal marginal edge 88 of the longitudinal end 86. Further as illustrated in FIG. 24B, the corresponding fastening means 124, more particularly VELCRO® 47' is affixed along the second marginal edge 89 of the longitudinal end 87. The VELCRO® fastening means 47 and corresponding VELCRO® fastening means 47' provide a means for removably fastening the first end 86 to the second end 87 to position the sun protective neckwear garment 200 in the closed position as seen in FIG. 25. It should be noted the VELCRO® strips 47 and 47' fastening means can be stitched to the longitudinal marginal edges 88 and 89 using any suitable stitching method including lock stitch (single or double), chain stitch (single or double), overlock stitch (three thread or four thread), safety stitch (five thread or six thread) and cover stitch). It should be noted that other fasteners or fastening means may be used without departing from the spirit of the invention, for example, zippers, hook and eyes, snaps, plastic snap strips, buttons, and/or the like.

The first end 86 is removably joined to the second end 87 along the opposite longitudinal marginal edges 88 and 89 by means of fastening means 47 and 47' to form a continuous sun protective neckwear garment 200 having a single tubular body unit having a ship decanter shape 100, as illustrated in FIG. 25, and described in more detail below.

FIG. 24B shows the first VELCRO® fastening means 47 is attached to the first end 86 interior surface 42 of the split neckwear garment 200 proximate to its first longitudinal marginal edge 88; and second VELCRO® fastening means 47' is attached to the second end 89 exterior surface 41 of the split neckwear garment 200 proximate to the second longitudinal marginal edge 89. The first VELCRO® fastening means 47 extends along substantially the entire length of the first marginal edge 88, and the second VELCRO® fastening means 47' extends along substantially the entire length of the second marginal edge 89. The first end 86 and second end 87 of the split neckwear garment 200 are removably fastenable to each other at the first VELCRO® fastening means 47 and second VELCRO® fastening means 47' and when fastened to each other form a continuous sun protective neckwear garment 200, as seen in FIG. 25.

As is well apparent, the sun protective neckwear garment 10 may be configured with a split 85 on the side of the neck garment including fastening means along each end of the split 85 that overlie the wearer's shoulder, or a sheet split may be configured in the front of the neck garment including fastening means that overlie a wearer's chin, neck and upper chest (not illustrated). In addition, as is well apparent, the seamed sun protective neckwear garment 90 may include a split 85 along the vertical medial axis of the second sheet of fabric 92, or first sheet of fabric 91; the V-shaped sun protective neckwear garment 50 can be configured with a split 85 along the vertical medial axis of the back side 59 of the neckwear garment 50.

FIG. 25 illustrates an elevation view of the VELCRO® neckwear garment 200 having VELCRO® fastening means 47 and 47' in the closed position. As illustrated in FIG. 25, when the neckwear garment 200 is in the closed position, the first 47 and second VELCRO® fastening means 47' are positioned such that when the first end 86 is attached to the second end 87, the first end 86 can be disposed over the second end 87 of the sun protective neckwear garment 200 such that the VELCRO® strips 47 and 47' are placed into engagement; and therefore the VELCRO® strips 47 and 47' are hidden away from view, as indicated by the vertical dashed-dot lines in FIG. 25, when the first 86 and second ends 87 are overlapped with the first marginal edge 88 over the second marginal edge 89.

Figure 26:
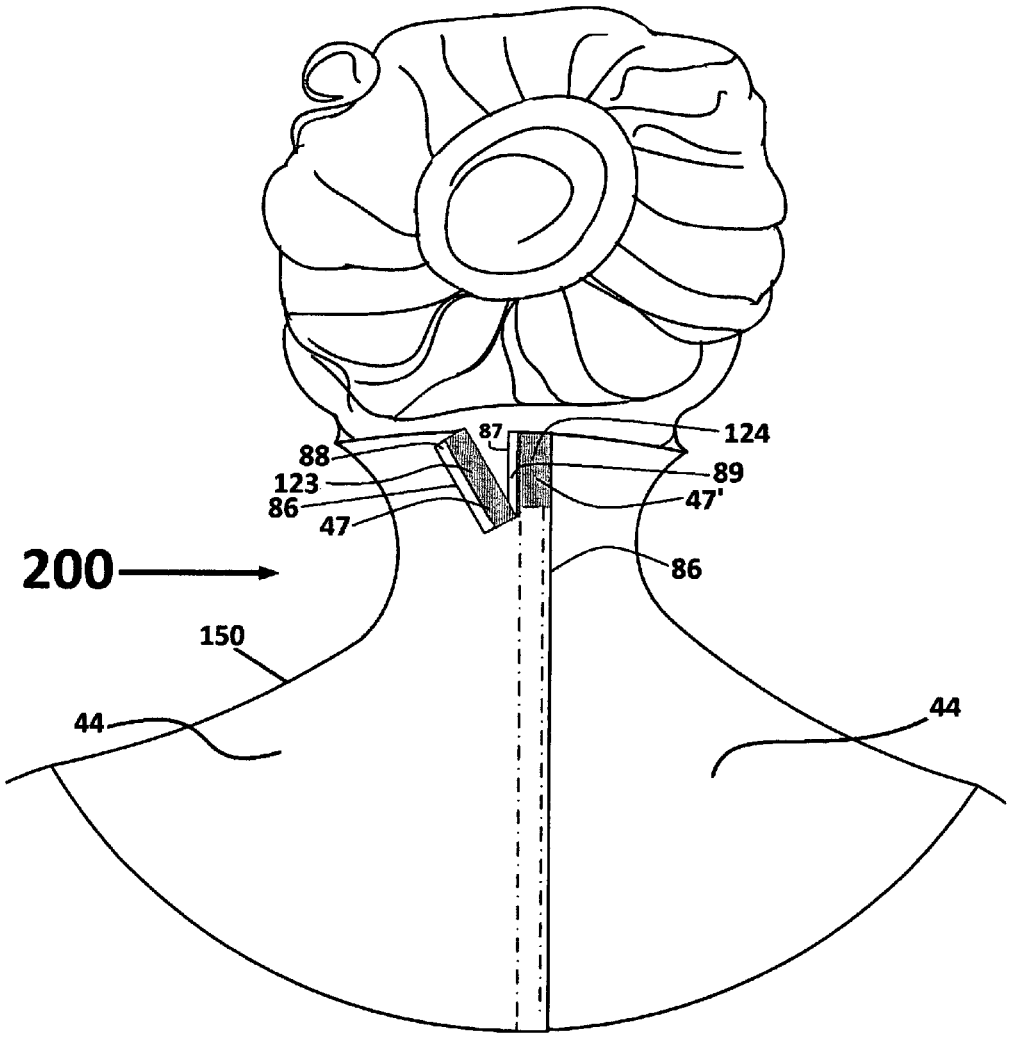
FIG. 26 is a rear perspective view of the VELCRO® embodiment of the sun protective neckwear garment having VELCRO® fastening means in the closed position as worn by a user.

More particularly, FIG. 26 illustrates the VELCRO® sun protective neckwear garment 200, in use, showing a perspective view of the back of the VELCRO® sun protective neckwear garment 200 worn by a wear. The VELCRO® strips 47 and 47' are placed into engagement and are hidden away. As illustrated in FIG. 26, with the fastening means 47 and 47' so affixed to the longitudinal marginal edges 88 and 89, the split sun protective neckwear garment 200 has a second longitudinal end 87 that is aesthetically hidden behind a portion of overlapping material of the overlying first longitudinal end 86 when the fastening means are engaged. It is convenient for a wearer to close or open the VELCRO® strips 47 and 47' fastening means along the edge-to-edge ends 86 and 87 when the wearer desires or needs to put on or take off the split sun protective neckwear garment 200 without any need for pulling the neckwear garment 200 over the head of the wearer.

To join the first end 86 to the second end 87, any suitable releasable fastener may be used and fastening means affixed to the longitudinal marginal edges 88 and 89 by a suitable affixing means, such as sewing. A preferred fastener is commercially available VELCRO® as shown in FIGS. 24, 25, and 26. As noted above, the fastening means may be zippers; buttons; snaps; plastic snap strips; hook and eyes; and/or the like.

It is well understood, the sun protection neckwear 10 as previously illustrated above, is in the preferred one size fits all that protects and shields substantial areas of the wearer's chin, neck, chest, shoulders, and back. However, modifications can be made to custom fit a specific wearer with a specific size sun protective neckwear garment, for example, the predetermined configurations of the shoulder portions 14 and 15 may be wider and may extend across the shoulders of the wearer and terminate on each of the slopes of the wearer's shoulders. However, the split sun protective neckwear blank 150 may be constructed to permit the incorporation of multiple sizes, such as x-small, small, medium, large, x-large, for example, or the incorporation of the VELCRO® neckwear garment 200 adjustment capability, for example by virtue of a plurality VELCRO® strips spaced a predetermined lateral distance apart from each other at the first end 86, with at least one VELCRO® strip on the second end 87, as an adjustment means which permit quick and easy adjustment. It will be understood that having larger surface areas or smaller surface areas, as well as non-circumferential edges may be embodied if desired or necessary to the wearer.

Figure 27:
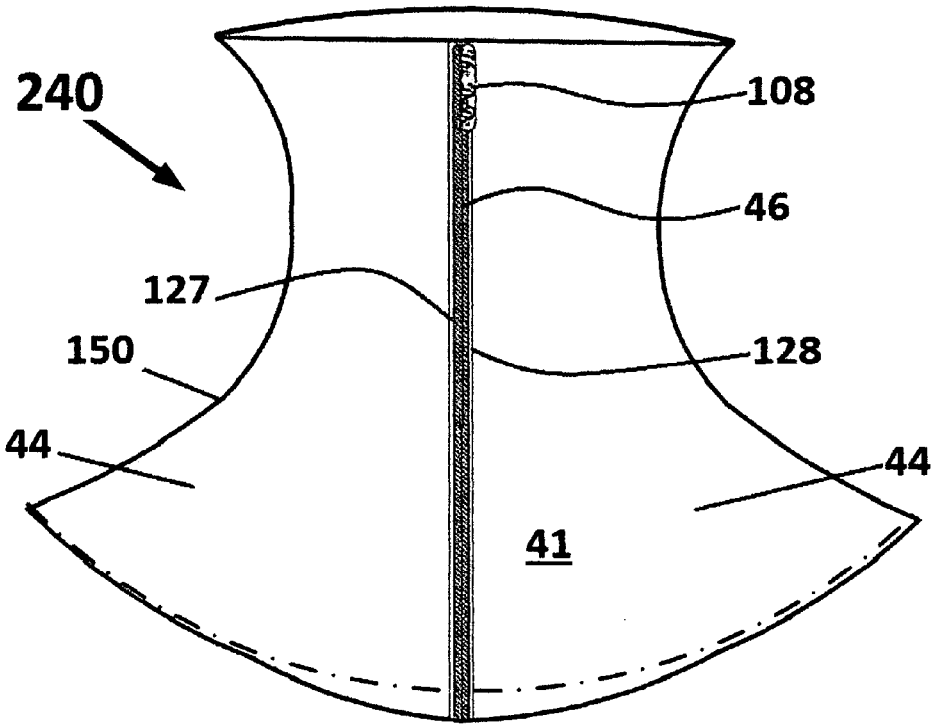
FIG. 27 is a rear perspective view of the zipper embodiment of the sun protective neckwear garment illustrating a zipper fastening means affixed upon the vertical medial split of the rear portion of the sun protective neckwear garment.

The split sun protective neckwear blank 150 can be used to form a plurality of sun protective neckwear garments having a variety of fastening means. FIG. 27 shows a zippered sun protective neckwear garment 140 wherein a split sun protective neckwear blank 150 utilizing a zipper 46 as the fastening means. As illustrated in FIG. 24, a back perspective view of the zippered sun protective neckwear garment 140 is shown, in which case, with reference to FIG. 24A, each longitudinal marginal edge 88 and 89 as created by the split 85 may be affixed or sewn to each corresponding marginal edge 127 and 128 of the zipper 46 such that the teeth of the zipper 46 and the longitudinal marginal edges 127 and 128 of the zipper 46 are partially exposed when the zipper 46 is engaged, which adds to the modern design of the neckwear garment 140. Or in the alternative, the longitudinal marginal edges 88 and 89 of the split 85 are affixed to the corresponding edges of the zipper 21 such that the teeth of the zipper 46 and the longitudinal edges of the zipper 127 and 128 are hidden when the teeth of the zipper 46 are engaged (not shown). In addition, FIG. 27 the zipper has a zipper handle 108 with a logo, The DeDe®, affixed thereon.

Figure 28:
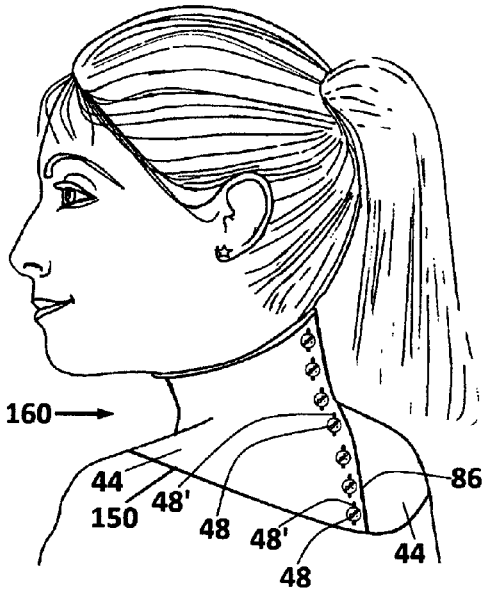
FIG. 28 is a rear perspective view of the button embodiment of the sun protective neckwear garment illustrating a button fastening means affixed upon the vertical medial split of the rear portion of the sun protective neckwear garment.
Figure 29:
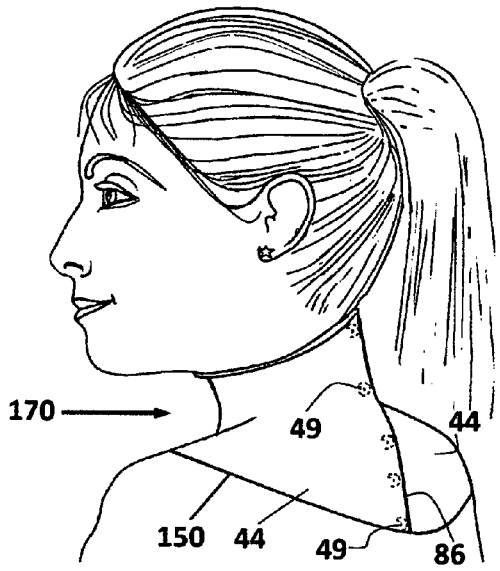
FIG. 29 is a rear perspective view of the snap embodiment of the sun protective neckwear garment illustrating a snap fastening means affixed upon the vertical medial split of the rear portion of the sun protective neckwear garment.
Figure 30:
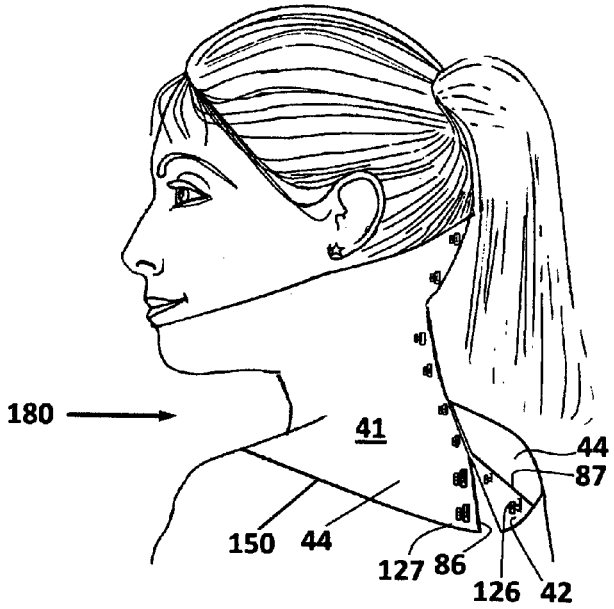
FIG. 30 is a rear perspective view of the hook and eye embodiment of the sun protective neckwear garment illustrating a hook and eye fastening means affixed upon the vertical medial split of the rear portion the sun protective neckwear garment.

Alternate fastening means can be used, for example, to construct another embodiment of the present invention, more particularly, the buttoned sun protective neckwear garment 160 utilizing a fastening means, particularly buttons 48 and corresponding button holes 48'. FIG. 28 is a back perspective view of the buttoned sun protective neckwear garment 160 in the closed position worn by a user with the buttons 48 engaged within the button holes 48'. In addition, a snapped sun protective neckwear garment 160 can be constructed having a series of mateable snaps 49 providing the fastening means. FIG. 29 is a back perspective view of the snapped sun protective garment 170 in the closed position worn by a user with the snaps 49 engaged within the corresponding units hidden behind the first end 86 of the split sun protective neckwear blank 150. FIG. 30 is a back perspective view of a hook and eye sun protective neckwear garment 180 having a series of hooks 126 and eyes 127 showing the eyes 127 affixed to the marginal edge of the first end 86 and the hooks 126 affixed to the marginal edge of the second end 87 of the split sun protective neckwear blank 150. The split 85 feature of the split sun protective neckwear blank 150 permits donning and removing the sun protective neckwear from the wearer without requiring the sun protective neckwear to pass over the wearer's head. Similarly, the sun protective neckwear 10 may be configured with a split 85 on the side of the neck garment including fastening means along each side of the sheet split that overlie the wearer's shoulder, or a sheet split may be configured in the front of the sun protective neckwear 10 including fastening means that overlie a wearer's neck and upper chest (not illustrated). In another embodiment, the split 85 may be cut into the second sheet 92 of the seamed sun protective neckwear garment 90, as described above. Fastening means are then affixed to the first end 86 and the second end 87 of the blank 150 so that the first end 86 and the second end 87 can be removably engaged when worn.

Figure 32:
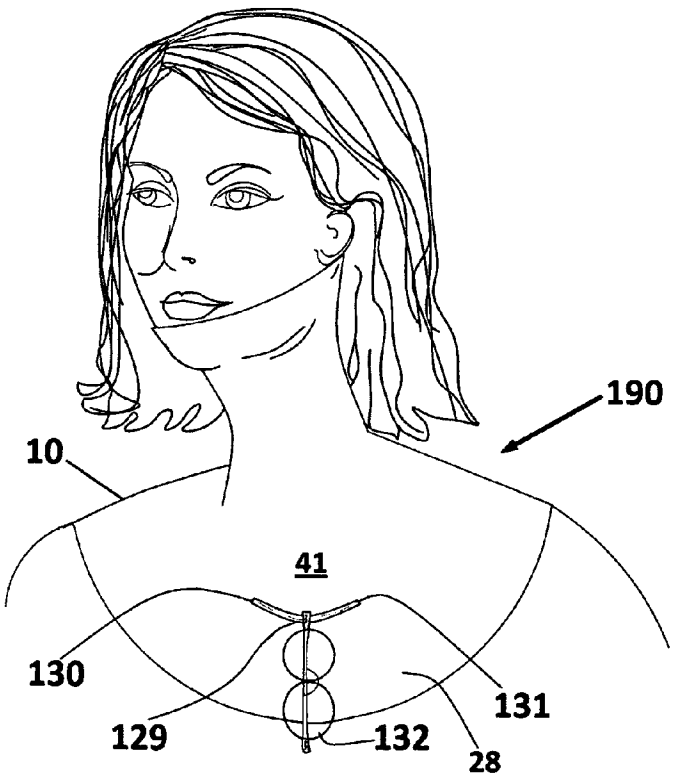
FIG. 32 is a front perspective view of the hook loop embodiment of the sun protective neckwear garment worn by a user illustrating a hook loop affixed on the front bib portion of the neckwear garment holding a pair of sun glasses.
Figure 31:
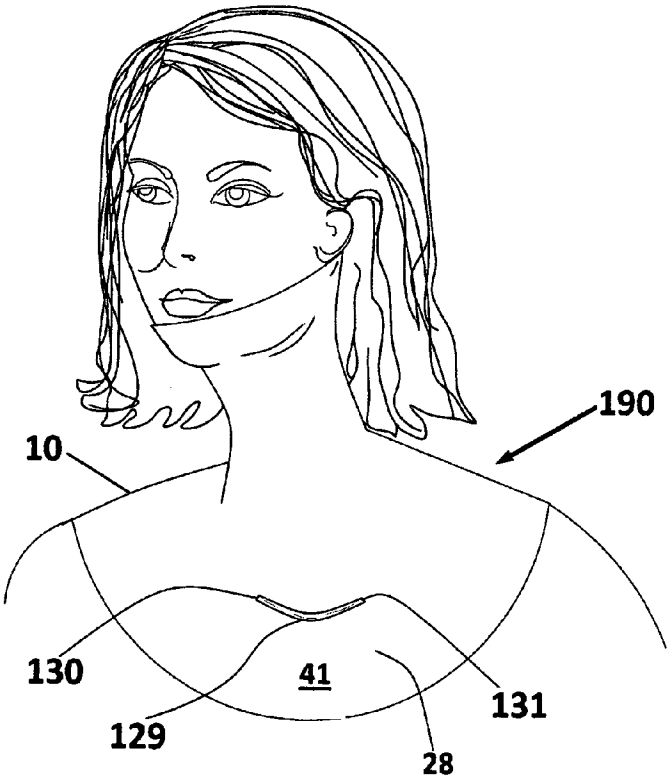
FIG. 31 is a front perspective view of the hook loop embodiment of the sun protective neckwear garment worn by a user illustrating a hook loop embodiment affixed on the front bib portion of the sun protective neckwear garment neckwear garment.

In another embodiment of the present invention, as illustrated in FIG. 31, the sun protective neckwear 10 can further include a hook loop 129 affixed to the neckwear garment 10 to construct the hook loop sun protective neckwear garment 190. FIG. 31 is a front perspective view of the hook loop neckwear garment 190 as worn by a user. The loop is affixed to the exterior surface embodies the sun protective neckwear garment 10 wherein the hook loop is affixed to the exterior surface 41 front bib portion 28 of the neckwear garment 10. The loop 129 is comprised of an elongated strip of material, which may be a textile, or fabric, or material, and may be of the same substance as that of which the neckwear garment is made. In the alternative, the loop 129 may be comprised of different material, and may be selected for its durability or friction, such as plastic or composite material. The textile, fabric, or material, or composite, with which the elongated strip is comprised, will be sufficient to give some substantial property to the loop 129 such that the loop 129 will present at least a slight opening in the natural state. As illustrated in FIG. 31, the elongated strip has two opposing ends 130 and 131, a first end 130 and a second end 131, each of which is attached to the fabric on the exterior surface 41 front bib portion 28 of the sun protective neckwear garment 10 but not limited to. The loop 129 comprises a strip of material joined at each of its ends and to the front of the exterior surface 41 of the neckwear garment 10 at predetermined distance from each other to define the closed loop 129. The loop 129 is affixed to the neckwear garment 10 to enable the wearer to hang the neckwear garment 10 on a hook, or to insert glasses or sun glasses 132 therein, or for aesthetics. As illustrated in FIG. 32, an arm of the wearer's sunglasses 132 is inserted throughin the opening formed by the loop. As seen in FIG. 32, this enables an arm of an object, such as glasses or sunglasses 132 to be inserted thoughin the loop 129 so that the pair of glasses is held to the neckwear 10 when not needed, or to keep the wearer's hands unencumbered while engaging in physical activities, or when making a purchase. In addition, the loop 129 can be used to hold or anchor other objects, such as tags, ribbons, cords of a name tag, and the like.

Figure 34:
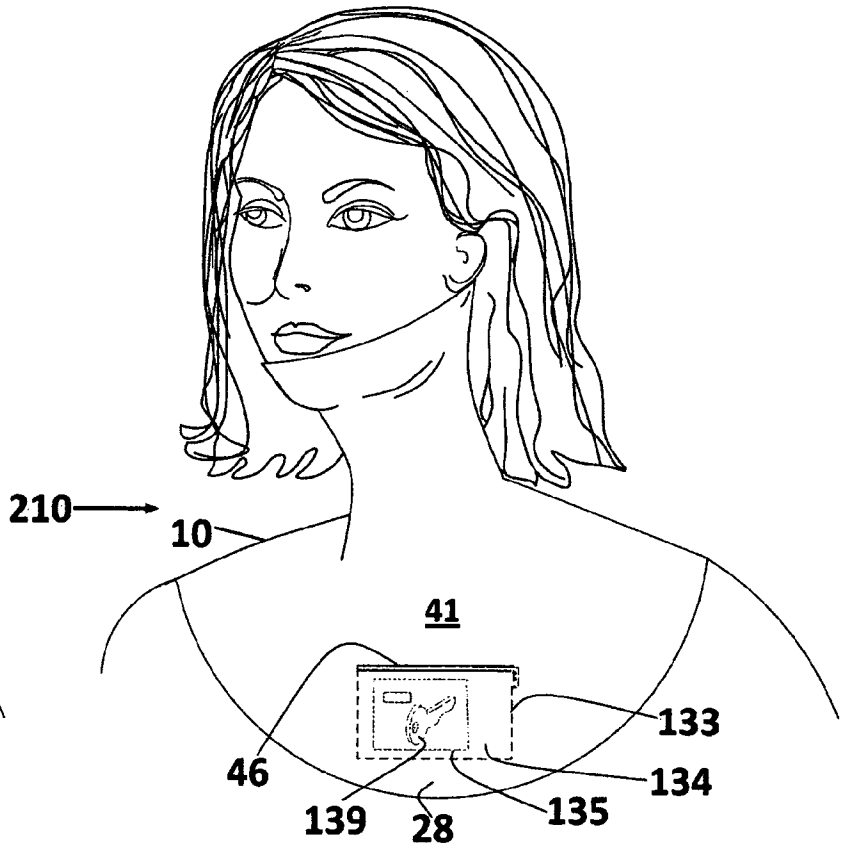
FIG. 34 is a front perspective view of the pocket embodiment of the sun protective neckwear garment worn by a user illustrating a hidden pocket holding a key and credit card with a zipper fastener.
Figure 33:
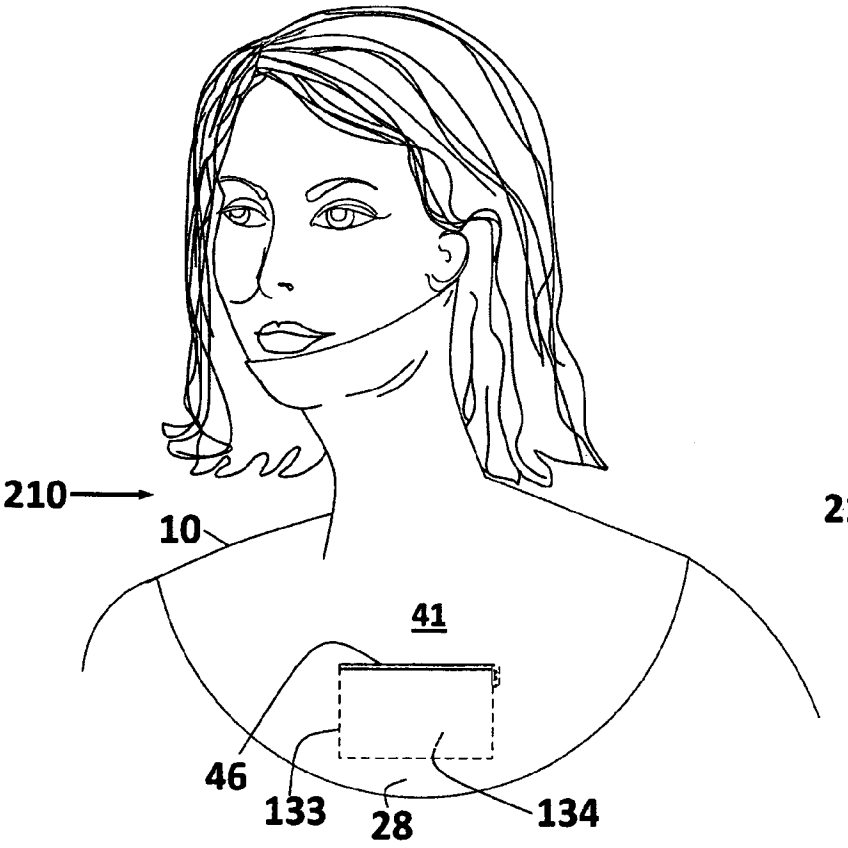
FIG. 33 is a front perspective view of the pocket embodiment of the sun protective neckwear garment worn by a user illustrating a hidden pocket affixed on the sun protective neckwear garment.

In another embodiment of the present invention, as illustrated in FIG. 32, the sun protective neckwear 10 can further include a hidden pocket 133 affixed to the neckwear garment 10 to construct the pocket sun protective neckwear garment 210. FIG. 33 is a front perspective view of the pocket sun protective neckwear garment 210 as worn by a user, showing the hidden pocket 133 with a zipper 46 fastener as a closing means. The cavity 134 of the hidden pocket 133 is defined by the dashed lines showing the cavity 134 of the hidden pocket 133 concealed behind the front bib portion 28 of the neckwear garment 10. FIG. 34 is a front perspective view of the pocket sun protective neckwear 133 worn by a user, showing the hidden pocket 133 which is holding a key 139 and credit card 135 with a zipper 46 fastener as a closing means. The pocket 133 provides a holding means to enable the wearer to hold keys 139, credit cards 135, cash, jewelry, gum, candy, lozenges, asthma inhaler, atomizer, makeup, medication, CHAPSTICK®, heating patch, cooling patch, perfume, sanitizing lotion, and/or other small items. Thus, when using the sun protective neckwear 210 a wearer is freed from having to carry items if there is no pants pockets, shirt pockets, jacket pockets, or the like, or the wearer is freed from having to carry items in the wearer's socks or under the wearer's feet in the wearer's shoes, or freed from carrying items in the pant pockets, short pockets, or shirt pockets or jacket pockets. The pocket sun protective neckwear garment 210 may be particularly useful when a wearer is running, bicycling, golfing, walking, jogging, sun bathing, playing soccer, playing rugby, or while driving a vehicle, and/or while participating in other physical activities. It should be noted that although the sun protective neckwear 210 illustrated in FIGS. 33 and 34 shows only a single, substantially rectangular pocket 133, it would be possible within the spirit of the present invention to provide pockets of different shapes to accommodate a particular item or items, or to provide a plurality of pockets or provide a pocket on the exterior of the neckwear garment 10. The pocket 133 can be removably attached to the neckwear garment 10 or can be permanently affixed to the neckwear garment 10.

In another embodiment of the present invention, a pocket 133 can be configured by affixing a generally rectangular preexisting pocket made of the same material as that used in making the neckwear garment 10 in predetermined dimensions to accommodate the size of a standard credit card 135. The pocket is affixed by stitching the pocket to the inside of the neckwear garment 10 employing a decorative stitch such that the aesthetic value of the neckwear garment is 10 not diminished. In the alternative the pocket may be removably affixed to the neckwear garment 10 by a fastening means, such as VELCRO® 47 or iron on tape or two sided iron on adhesive tape, male and female snaps, hook and eye, and/or the like. (Not Illustrated)

In addition, as illustrated in FIGS. 33 and 34, the pocket 133 includes a pocket closing means along the top edges of the pocket 133 to allow the pocket 133 to be closed. The closing means in the present invention is a zipper 46. The closing means can include a pliable nylon zipper, a zipper, snaps, buttons, hooks, VELCRO®, and/or the like.

Alternatively, the neckwear garment 10 can include an open pocket that is a pocket including no closing means along the top edges. Such a pocket may be used when the wearer is driving a vehicle while wearing the neck garment to shield the glaring sun on the wearer's neck, and upper chest, and shoulders, and the wearer needs to gain fast and easy access to the pocket's contents. In another embodiment of the present invention, a pocket with a flap configured to fold over the opening along the top edge of the pocket can be configured. A snap can be used to removably position the flap to close the pocket. Other pocket closing means may be used, such as VELCRO®, snaps, buttons, loop and button, hook and eye, and/or the like. The neck garment 10 may be configured with the pocket either inside or outside. Depending upon the needs or desire of the wearer together with the contents of the pocket, it may be desirable to have the pocket on the outside for comfort, or on the inside for security, or on the inside for aesthetics. It would also be in the spirit of the invention to provide a plurality of pockets, and it would further be possible to provide one or more pockets on both the inner surface of the neckwear garment 10 and another pocket or pockets on the outside of the neckwear garment 10.

The sun protective neckwear garment 10 can be crafted and manufactured in various patterns and colors including solid colors, patterns, tie-dyes, batik wax dyes, silk screens, stripes, checks, geometric patterns of circles, squares, triangles, rectangles, hexagons, pentagons, octagons, diamonds, paisleys, zigzags, and freehand splashes and designs, cartoon characters, photos statements, comic strip characters, super hero characters, graphics, text, monikers, artistic designs, marks, trademarks, logos, and any design which is imbedded within the selected fabric of choice to manufacture the neckwear garment 10.

Figure 35:
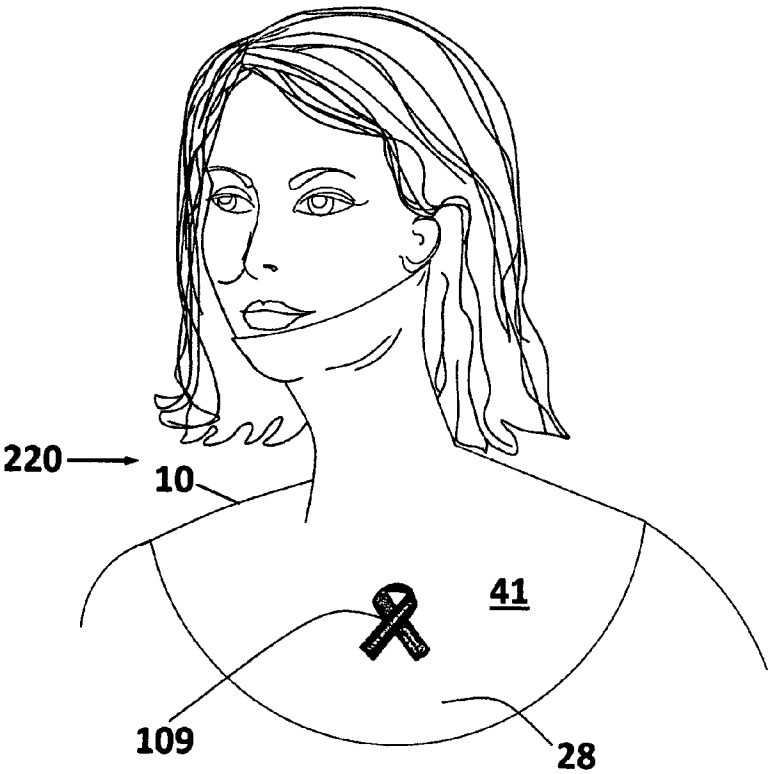
FIG. 35 is a front perspective view of the ribbon embodiment of the sun protective neckwear garment worn by a user illustrating an Alzheimer's ribbon affixed to the sun protective neckwear garment.

In addition, it will be seen that the sun protective neckwear garment 10 facilitates the addition of embellishments, or decorations, which can be affixed and adorn the neckwear garment 10 to construct a ribbon sun protective neckwear garment 220. The ribbon sun protective neckwear garment 220 embodies the sun protective neckwear garment 10 and further includes an embellishment, a ribbon 109 secured to the exterior surface 41 of the front bib portion 26 of the sun protective neckwear garment 10. In FIG. 35, a front perspective view of the ribbon sun protective neckwear garment 220 is shown, worn by a user, secured thereon, a purple ribbon 109 identified with an Alzheimer's Association. The ribbon sun protective neckwear garment 220 provides the wearer with a neckwear garment having promotional indicia that provides a means to raise funds, awareness, and interest in charitable organizations, special interest groups, especially the Alzheimer's Association. The sun protective neckwear garment 220 can be provided in exchange for a donation to the Alzheimer's Association, or any particular charitable organization. As seen in FIG. 35, the embellishment is positioned, affixed, fastened, on or imbedded within the material of the sun protective neckwear garment 10 for easy recognition to a viewer. The promotional ribbon 109 included in the design of the neckwear garment 10 embellishes the neckwear garment 10 forming a promotional piece of clothing that may be an integral part of the sports outfit, or wardrobe worn by the wearer without compromising the wearer's main outfit. In addition, the user can select from a variety of sun protective neckwear garments 10 which include a variety of ribbons, or embellishments or indicia and purchase them at a lesser cost than purchasing a T-shirt, hat, or entire outfit, which includes the same promotional indicia or ribbon.

Relatedly, the sun protective neckwear garment 10 can be utilized as an article of manufacture as a means to prominently display a variety of promotional images, or indicia, or text, for a specific sport team or company, or self-named moniker, logo, and the like, that can be easily donned on and off and replaced with another sun protective neckwear garment 10 which has a different sports team, company, or name, or logo, affixed thereon. The sun protective neckwear garment 10 is interchangeable among the wearer's outfit, or top, or shirt, or apparel, but does not comprise the neckwear garment 10 itself, or the wearer's outfit, or top, or shirt, or apparel itself, therefore, maintaining the original integrity of both the garment 10 and wearer's outfit and overcoming the burden of acquiring a variety of outfits or tops, or apparel, which display logos, text, or decorations, of an individual's favorite sports or charitable organizations or favorite entities.

If desired, a logo, or trademark, or other decoration as noted above, may extend across a portion or an entire exterior surface of the sun protective neckwear garment 10, or the logo may be affixed to the zipper handle 108 as illustrated above in FIG. 27, or the logo may be affixed to a loop 129 affixed to the loop sun protective neckwear garment 190, seen in FIG. 31.

In accordance with one aspect of the present invention, a method of raising money in any one campaign for single or multiple charitable causes or non-profit organizations, or sports booster programs, and the like, is taught, where the charitable cause or non-profit, or the sports team or amateur sports team, has a well-known logo, indicium, or inspirational or motivational slogan, or promotional image or message, or text, or other embellishment, by which it is readily identified. For example, the Alzheimer awareness ribbon 109 is purple, as seen in FIG. 35, the autism awareness ribbon wherein a colored puzzle is displayed, or cancer awareness ribbon is the color pink. The indicia, or logo, slogan, initials, name, symbol, or ribbon, or color, or decoration, and the like, is affixed to the sun protective neckwear 10 of the present invention, and each neckwear garment 10 is then exchanged with a donor amount of money or a pledge of money or service which is greater than the cost of the materials, thereof, and the cost of the labor for assembling the same. Then a predetermined amount of the proceeds are presented to the charity or non-profit or booster for the sports team, and the like.

It is contemplated that the method of fundraising for a charitable cause, or a non-profit organization, or a sports team booster, of the present invention is particularly useful for providing the donor or contributor of money or service with a tangible, useful, decorative, enjoyable, spirited, and long-lasting reminder, by way of the sun protective neckwear 10, of the commitment and support being given by that donor of the specific charitable cause or non-profit organization being supported and which is identified by the specific indicium, logo, symbol, ribbon, color, pattern, design, name, and the like, affixed on the sun protective neckwear 10.

Figure 36:
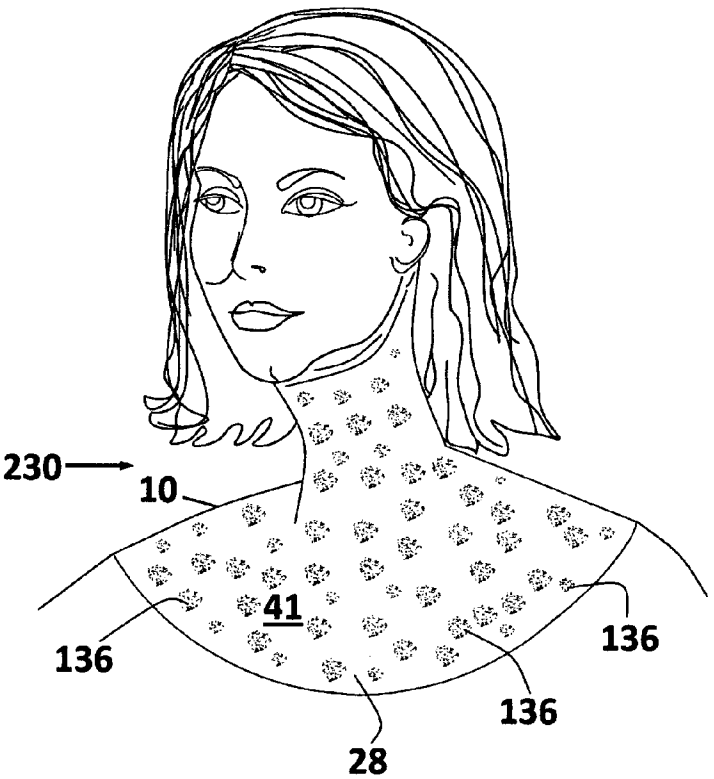
FIG. 36 is a front perspective view of the bedazzled embodiment of the sun protective neckwear garment worn by a user illustrating diamond heart embellishments affixed to the sun protective neckwear garment.

In another embodiment of the present invention, the sun protective neckwear garment 10 can include affixed thereon, beads, precious stones, jewels, sequins, lace, studs, buttons, ribbons, embroidery, graphics, monikers, patterns, and/or any other decorative embellishment which upgrades the neck garment from a conventional sport apparel or garment to a fashionable piece of clothing that is an integral part of the sport outfit, or wardrobe worn by the wearer. FIG. 36 is a front perspective view of the sun protective neckwear garment 10 worn by a user illustrating diamond heart 136 embellishments affixed exterior surface 41 of the entire the neckwear garment 10 to construct the bedazzled sun protection neckwear garment embodiment 230. In addition, the neckwear garment 10 can be manufactured in various fabrics from a plurality of colors, patterns, designs, and embellishments while comprising elasticity, flexibility, resiliency, and soothing textures with and without embellishments, for providing an attractive appearance around the neck and shoulders, upper chest, and upper back. These designs may be embroidered, sewn, printed, silk screened, beaded, or may be patches or labels that are then sewn or otherwise affixed to the neckwear garment 10.

The seamless sun protective neckwear 10 is preferably manufactured using ultraviolet blocking fabric. The neckwear 10, according to the preferred embodiment is manufactured using a lightweight, flexible, foldable, not rigid, stretchable, elastic, resilient fabric, for example, cotton, nylon, polyester, and imbedded with elasticity provided by spandex, lycra, and other like materials, and further imbedded with ultraviolet protecting agents. Ultraviolet protection fabrics provide consistent and effective ultraviolet protection under all conditions. The sun protective neckwear 10 preferably is manufactured from a single piece of fabric woven from a pattern with described dimensions, as specified and described above, preferably with a stretchable knitted material knitted on a seamless knitting machine, for example, a SANTONI®, or KARL MAYER, or LIBA, or double needle-bar warp knitting, double needle bar raschel machines. The preferred method of producing a true seamless knitted garment is seamless knitting. The seamless sun protective neckwear garment 10 is preferably formed by the method of seamless knitting. The double needle-bar raschel knitting machines preferably equipped with electronic patterning by means of piezo elements giving the machine almost unlimited patterning scope, or any circular knitting machines for seamless garments, and with a thickness preferably of substantially 0.10 mm to 10.00 mm; and a gauge of substantially 24-28; and type of yarn or thread to produce a fabric with ultraviolet blocking capability to protect the wearer's chin, neck, and shoulders, upper chest, and upper back, from the sun's UVA and UVB rays. The criticality of the thickness of the garment including a range of approximately 0.01 mm-10.00 mm is to provide a neck garment which is light weight upon the wearer's skin and when the garment comes in close contact with the wearer's skin the garment feels like a natural protective barrier against the sun, like a second skin. In addition, the neck garment having a thickness of 0.1 mm to 10.00 mm provides primarily a lightweight neckwear garment to keep the wearer's skin protected against the damaging rays of the sun and secondarily keeps the wearer's skin as cool and dry as possible.

The criticality of the gauge 24-28 is to produce a knitted garment of predetermined dimensions, whether from one's own design or from a published pattern, the gauge should match as closely as possible; significant differences in gauge will lead to a deformed garment. Patterns for knitting projects almost always include a suggested gauge for the project.

A looser gauge will produce an airier fabric with plenty of drape. A tighter gauge will produce a thicker, sturdier fabric. When yarn is woven on a 24-28 gauge machine producing a finer knit fabric that is softer and lighter to touch but having a tight spacing between stitches. The desired seamless single body tubular ship decanter unit 100, according to the preferred embodiment of the present invention, or in the alternative, according to other embodiments of the present invention presented, along with the preferred lightweight, elasticity, ultraviolet protection, and fiber content of the fabric will influence the type of knitting machine selected to manufacture the fabric and the person skilled in the art may easily select the appropriate combination.

The neckwear 10 can be made with ULTRAVIOLET-BLOCK® fabrics. An example, of an ULTRAVIOLET blocking fabric is SUNSCREEN 50™ which is a medium weight, high thread count nylon fabric with a cottony hand. It has been treated to provide a UPF50 blocking over 98% of the sun's UVA and UVB rays. It is lightweight, washable, breathable, pliable, easily folds, and cottony soft. It also has a durable water repellent finish to shed water. The basic science behind ultraviolet protection fabric is chemical ultraviolet inhibitors and ultraviolet blocking weave technology. To receive an ultraviolet block certification, sun protection fabrics must meet stringent industry and governmental guidelines. UVBLOCK® certified means that: The fabric has been tested for ultraviolet light transmission and it is then laundered 40 times and submitted to 100 hours of ultraviolet light once again tested for ultraviolet light transmission, then given a certified rating and labeled only fabrics tested by the International Ultraviolet Testing Laboratories are UVBLOCK® certified. As mentioned above, the invention relates to the sun and more specifically, the sun's UVA (long-wave) and UVB (short-wave) rays. The sun protection neckwear garment 10 preferably provides for protection, when the user is outdoors under the sun, or indoors when exposed to the sun, against UVA and UVB rays, for example near a glass window or skylight. Furthermore, the ultraviolet fabric of the sun protective neckwear 10 can also provide protection to a person while driving in a vehicle, such as a car, or truck, bus, cab, truck, boat, golf cart, chair-lift, all-terrain vehicle where the sun protective neckwear 10 can protect against the sun's radiation as it is refracting through the glass of the windshield and targeting the driver's neck, and upper chest, shoulders, and chin. Special sun-protective fabric with UPF (ultraviolet protection factor) indicate how much ultraviolet radiation can penetrate the fabric; the higher the UPF, the better. For example, a shirt with UPF of 30 means that just 1/30th of the sun's ultraviolet radiation can reach the skin. Although, shielding your body with garments made with most fabrics can block the damaging rays of the sun, one can enhance your sun safety simply by learning to evaluate your outdoor activity and wearing my sun protective neckwear garment 10 manufactured from fabrics with sun protection qualities and choosing those with the best protection.

Thus, the ultraviolet sunscreen fabric like SUNSCREEN 50™ used to manufacture the sun protective neckwear garment 10 according to the preferred embodiment of the present invention reduces wearer's risk of developing any type of skin damage or skin carcinomas, skin melanomas, skin cancers, or any skin maladies related to invasive ultraviolet radiation from the sun.

Other fabrics which can be used to manufacture the sun protective neckwear garment 10, as well as other embodiments, in combination with the ultraviolet fabrics, are "WICKAWAYS™" which are a class of fabrics that provide great moisture control. They move perspiration away from the body to the fabric's outer surface where it can evaporate. WICKAWAYS™ are soft, lightweight and breathable. These knit WICKAWAY™ fabrics do have elasticity and may be used to manufacture the sun protection neckwear 10 woven as a seamless single tubular body unit having a ship decanter shape as embodied in the present invention and are successful in providing a means to keep the wearer's skin cool and dry while participating in physical activity, for example, running, cycling, golfing, playing soccer, volley ball, or walking, and while participating in other outdoor sports under the sun or while driving a motor vehicle.

Also, the sun protective neckwear garment 10 can be made from plurality of materials and fabrics that block the ultraviolet rays of the sun, including natural textiles, fabrics, or materials, recycled materials, textiles, and/or fabrics. The neckwear garment 10 may be made from any suitable material with a combination of ultraviolet protection fabric and water wicking capability, the combination thereof, that material manufactured in the form of a single ship decanter tubular neckwear garment 10 provides maximum ultraviolet protection to the wearer's neck, upper chest, upper back, shoulders, and lower chin. The elasticity and resiliency of the material used in the manufacture of the neckwear garment 10 allows the wearer to effortlessly change the neckwear garment 10 having the chin-collar portion 11 in the up position over the wearer's chin or in the down position folded under the wearer's chin to suit the changing sun's rays or the perspiration and sweat of the wearer. In addition, the elasticity, flexibility, and small surface area of the neckwear garment 10 allows the wearer to quickly remove the neckwear 10 from around the neck and place it in the wearer's pocket or bag, and the like.

If wicking fabric is also knitted or woven in addition to the ultraviolet fabric to manufacture the garment, the selected fabric also enables the sun protective neckwear 10 to be able to provide a means to wick moisture from the wearer's body where it is likely to sweat out around the wearer's neck, upper chest, shoulders, and chin, while the wearer is active.

In addition, the sun protective neckwear garment 10 provides a secondary utility which enables wicking of moisture and perspiration from the user. Lycra WICKAWAY™ fabrics do have lots of stretch and may be used to manufacture sun protective neckwear 10 woven in a seamless single tubular body unit having a ship decanter shape that provides further resiliency and elasticity such that the neckwear 10 may be securely pulled up around the wearer's neck and chin, disposed upon the wearer's upper chest, shoulders, and upper back, while a wearer is running, exercising, cycling, walking, etc., or driving a vehicle, or for any physical activity under the sun, where the sun protective neckwear 10 provides a means to keep the wearer's skin protected against the damaging rays of the sun and simultaneously, keep the wearer's skin as cool and dry as possible.

To help retain the neckwear 10 in place on a person while partaking in physical activity or driving in a car or truck, the neckwear garment is manufactured using a UB blocking fabric containing elasticity, for example a spandex blend, or LYCRA® blend, or 2-way stretch, or 4-way stretch. When the neck garment 10 is in place around the wearer's neck and disposed on the wearer's upper chest and back the resiliency and elasticity of the fabric cooperate to comfortably and securely hold the neck garment 10 against the wearer's neck, upper chest, upper back, shoulders, and chin.

More particularly, in another embodiment of the present invention, an illuminating fabric can be used to manufacture the sun protective neckwear 10 to add safety to the wearer when exercising at night. ILLUMINITE™ technology provides a significant improvement to the existing retro-reflective trim (piping, etc.) as it dramatically improves the speed and accuracy by which a motorist can recognize an object on the road as being a pet or human being. In addition, the ILLUMINITE™ retroreflective technology embeds millions of microscopic satellite dishes into the weave of the fabric. These dishes act like mirrors to reflect back to the original light source. ILLUMINITE™ strategically create silhouette reflectivity on the wearer through the design expertise, all of the while maintaining fashion and performance.

The sun protective neckwear garment 10 provides useful features, including coverage around the user's neck, chin, chest, and portion of the shoulders, while in use, at the same time permitting substantially unrestricted physical activity to the wearer without danger of ultraviolet exposure of neck, chin, shoulders, upper back and upper chest, concurrently the garment 10 provides absorption of the wearer's sweat and provides against irritation. The neckwear garment 10 can effectively block a user's exposure to harmful ultraviolet waves of the sun and reduce the wearer's risk of developing any type of skin damage or skin carcinomas, skin melanomas, skin cancers, or skin cell damage, mutation, or skin cell change, or solar lentigines, or actinic keratosis, or sun burn, or sun freckles, brown spots, or wrinkles, or any skin maladies related to invasive ultraviolet radiation from the sun that develop as a result of the intrusion of the ultraviolet radiation while participating primarily in outdoor physical activity, or while driving a vehicle.

The neckwear garment 10 according to the present invention provides a useful feature, including a pocket that can be used for storage of small items, keys, identification, money, chap stick, etc. In addition, the garment 10 provides a useful feature including a loop, especially for user's who wear glasses or sun glasses, where the loop can be used to hold sun glasses, eye glasses, or the loop can be used for hanging the garment 10 up on a hook.

In addition, the sun protective neckwear garment 10 provides a decorative garment to which embellishments can be affixed and provides a promotional garment for specific causes, sports teams, etc. as mentioned above.

A sun protective neckwear garment 10 according to the present invention is also significantly safer than other neck garments. Wearing neck garments that cover the mouth is a danger for obstructing one's oxygen intake. Wearing a scarf is a danger that the scarf will get caught in exercise gadgets or machinery or be obtrusive and interfere with the activity the wearer is participating in. A sun protective neckwear garment 10 according to the present invention is close-fitting, substantially reducing these risks.

It will be further appreciated that the neckwear garment 10 uses a minimum of material, thereby saving on manufacturing costs. Because the neckwear garment 10 is a single tubular body ship decanter unit 100 it is easy to manufacture, store, display, package, and ship. In addition, it folds easily for packing or for placing into a pocket, bag, purse, gymnastic bag, sports bag, or any bag. Finally, the sun protective neckwear garment 10 provides a unique configured garment which is low cost to manufacture and easy to use as to enable the wearer to make sun protection part of the user's daily routine.

It will be appreciated that the sun protective neckwear garment 10 is versatile. Because the neckwear garment 10 can be constructed with two different bib configurations the scoop sun protection neckwear garment 40; and the V-shaped sun protective neckwear garment 50; the garment 10 presents at least two different aesthetic appearances, doubling its usefulness in a person's wardrobe. Furthermore, because the sun protective neckwear garment 10 presents itself as a means to affix embellishments, decorations, and/or promotional images the neckwear garment 10 multiplies its usefulness in a person's wardrobe both as a decorative apparel or promotional apparel, particularly related to sports. Moreover, people have more than one favorite sports team, or charity, or special interest group, etc. they would like to display and tout their loyalty. Thus, a sun protective neckwear garment 10 is utilized as an inexpensive article of manufacture as a means for to prominently display promotional images or indicia for a specific sport team or charitable cause or non-profit organization, and the like on a variety of wearer selected sun protective neckwear garments 10 displaying the various sports teams or charities. The sun protective neckwear garment 10 is interchangeable among the wearer's outfit, or top, or shirt, or apparel, but does not comprise the neckwear garment 10 itself, or the wearer's outfit, or top, or shirt, or apparel itself, therefore, maintaining the original integrity of the garment 10 and wearer's outfit and overcoming the burden and costs of acquiring a variety of outfits or tops, or apparel, which display a logos or decorations of an individual's favorite sports or charitable organizations or favorite entities.

While the description includes details which will enable those skilled in the art to practice the invention, it should be recognized that the description is illustrative in nature and that many modifications and variations thereof will be apparent to those skilled in the art having the benefit of these teachings. It will be readily apparent that sun protective neckwear garment 10 can take multiple forms without departing from the spirit and scope of the present invention. Although various embodiments of the present invention have been disclosed here for purpose of illustration, it should be understood that a variety of changes, modifications, and substitutions may be incorporated without departing from either the spirit or scope of the present invention. It is accordingly intended that the invention herein be defined solely by the claims appended hereto and that the claims be interpreted as broadly as permitted by the prior art.

I claim:

1. A seamless sun protective neckwear garment of clothing adapted for shielding a chin, neck, upper chest, upper back, and portion of the shoulders from the sun when worn by a wearer, comprising:

a pliable, elasticized, resilient, continuous single tubular body generally ship decanter in shape made with an ultraviolet blocking fabric having an ultraviolet protection factor of at least 30 UPF;

the ship decanter tubular body including two generally opposed openings, a top full-circle opening and a larger bottom full-circle opening integrally seamlessly joined by two laterally opposed generally parallel vertically aligned substantially identical concave sides at two laterally opposed top right and left end points and two laterally opposed bottom right and left end points;

the top opening comprises a first diameter and the bottom opening comprises a second diameter approximately twice as large as the top opening diameter, wherein the top opening is defined by a front top fabric edge and a back top fabric edge, the front top fabric edge and the back top fabric edge each having the top right and top left end points with a front top midpoint located between each right and left end points and a back top midpoint located between each right and left end bottom convex fabric edge and back bottom convex fabric edge of said bottom opening being substantially convex in shape, such that the front and back bottom convex fabric edges form a singularly smooth continuous curved bottom edge with the bottom opening, the singularly smooth continuous curved bottom edge has a circumferential length which is in continuous contact with the skin of the wearer when worn, a most convex front bottom fabric edge and a most convex back bottom fabric edge being a further distance from the front top fabric edge and the back top fabric edge, respectfully, than the right bottom and left bottom end points;

the ship decanter tubular body including a top chin collar portion and a bottom bib portion integrally seamlessly formed by a neck portion seamlessly disposed therebetween wherein the bottom bib portion includes two laterally opposing shoulder portions integrally seamlessly formed thereof;

the ship decanter tubular body having a front side and a back side substantially identical having an exterior surface and an interior surface substantially identical, and the ship decanter tubular body extends a distance over a wearer's neck, upper chin, upper chest, upper back, and portion of shoulders of a wearer when worn;

the front side and back side each having a medial axis;

the top chin collar portion includes a horizontally aligned circumferential top straight fabric edge defining the full-circle top opening, the top chin collar portion extends a distance around the chin of the wearer and the back portion of the wearer's head;

the bottom bib portion includes a horizontally aligned circumferential convex bottom fabric edge, the front bottom convex fabric edge and the back bottom convex fabric edge defining the full-circle bottom opening, the bottom bib portion extends a distance over a portion of the wearer's shoulders, upper chest and upper back;

a front bib portion seamlessly formed to a back bib portion;

the front bib portion extends a distance over the wearer's upper chest and a portion of the wearer's shoulders, and extends a distance down to a position at or below the sternum; the back bib portion extends a distance over the wearer's upper back and a portion of the wearer's shoulders, and extends a distance to a position at or below the first thoracic vertebra of the wearer; and the neck portion having a tubular configuration sized with a third diameter smaller than the top opening diameter, the tubular neck portion extends snugly circumferentially around the wearer's neck; and wherein the front side and back side are seamlessly formed by a knitting process of using a double needle bar raschel machines.

2. The seamless sun protective neckwear garment according to claim 1, wherein the fabric is comprised of wicking material.

3. The seamless sun protective neckwear garment according to claim 1, wherein the fabric comprises elastic which stretches and contracts and maintains its shape after repeated use.

4. The seamless sun protective neckwear garment according to claim 1, wherein the fabric is selected from the group consisting of latex, spandex, elasticized polyester, elasticized cotton, elasticized knit, elasticized nylon, elasticized blended fabrics, elasticized recycled fabrics, elasticized illuminate, elasticized wicking fabric, elasticized ultraviolet blocking fabrics, four way stretch fabric, and any other elasticized fabrics.

5. The seamless sun protective neckwear garment according to claim 1, wherein the fabric comprises a thickness substantially the range 0.1 mm to 10 mm ranging from approximately 0.100 mm to 10.00 mm.

6. The seamless sun protective neckwear garment according to claim 1, wherein the ultraviolet blocking fabric provides a means of protection to the wearer from exposure to radiation of the sun in critical areas on the chin, neck, upper chest, upper back, and portions of the shoulders.

7. The seamless sun protective neckwear garment according to claim 1, wherein the neckwear garment is knitted to a gauge ranging from approximately 24-28 using an ultraviolet blocking yarn.

8. The seamless sun protective neckwear garment according to claim 1, wherein the neckwear garment is worn in one of two different positions with the chin collar portion in the up position snugly over the wearer's chin, or in the folded down position juxtaposed under the wearer's chin.

9. The seamless sun protective neckwear garment according to claim 1, wherein the front chin collar portion further comprises a reinforcing patch of extra strong elastic woven therein.

10. The seamless sun protective neckwear garment according to claim 1, wherein the fabric comprises 1 ply material.

11. The seamless sun protective neckwear garment according to claim 1, wherein the neckwear garment is reversible.

12. The seamless sun protective neckwear garment according to claim 1, further comprising a hidden pocket dimensioned to receive a conventional credit card, keys, jewelry, makeup, money, music devices, earplugs, gum, lip chap sticks, and other small personal items.

13. The seamless sun protective neckwear garment according to claim 1, further comprising a holding loop affixed on exterior surface of the neckwear garment.

14. The seamless sun protective neckwear garment according to claim 1, further comprising decorative embellishments secured upon the exterior surface of the neckwear garment.

15. The seamless sun protective neckwear garment according to claim 1, further comprising promotional indicia identified for a specific cause secured upon the external surface of the fabric.

16. A seamless sun protective neckwear garment of clothing adapted for shielding a chin, neck, upper chest, upper back, and portion of the shoulders from the sun when worn by a wearer, comprising:

a pliable, elasticized, resilient, continuous single tubular body generally ship decanter in shape made with an ultraviolet blocking fabric having an ultraviolet protection factor of at least 30 UPF;

the ship decanter tubular body including two generally opposed openings, a top full-circle opening and a larger bottom full-circle opening integrally seamlessly joined by two laterally opposed generally parallel vertically aligned substantially identical concave sides at two laterally opposed top right and left end points and two laterally opposed bottom right and left end points;

the top opening comprises a first diameter and the bottom opening comprises a second diameter approximately twice as large as the top opening diameter, wherein the top opening is defined by a front top fabric edge and a back top fabric edge, the front top fabric edge and the back top fabric edge each having the top right and the top left top end points with a front top midpoint located between each right and left end points and a back top midpoint located between each right and left end points, and wherein the bottom opening is defined by a front bottom convex fabric edge and back bottom convex fabric edge of said bottom opening being substantially convex in shape, such that the front and back bottom convex fabric edges form a singularly smooth continuous curved edge with the bottom opening, the singularly smooth curved bottom concave fabric edge has a circumferential length which is in continuous contact with the skin of the wearer when worn, a most convex front bottom fabric edge and a most back bottom fabric edge being a further distance from the top front and back fabric edges, respectfully, than the right bottom and left bottom end points;

the ship decanter tubular body including a top chin collar portion and a bottom bib portion integrally seamlessly formed by a neck portion seamlessly disposed therebetween, wherein the bottom bib portion includes two laterally opposing shoulder portions integrally seamlessly formed thereof;

the ship decanter tubular body having a front side and a back side substantially identical, having an exterior surface and an interior surface substantially identical;

the front side and the back side each having a medial axis;

a front bib portion seamlessly formed to a back bib portion;

the neck portion having a tubular configuration sized at its narrowest with a third diameter smaller than the top opening diameter;

the front side is dimensioned approximately 10.00 inches which extends along a the front vertical medial axis from the front top straight fabric edge down to the front bottom convex fabric edge and the back side is dimensioned approximately 10.00 inches which extends along the back vertical medial axis from the back top straight fabric edge down to the back bottom convex fabric edge;

the right concave side is dimensioned approximately 9.50 inches along a peripheral edge of said concave side from the top right end point to the bottom right end point and said left concave side is dimensioned approximately 9.50 inches along a peripheral edge of said left concave side from the left top end point to the left bottom end point;

the front top fabric edge is dimensioned approximately 7.50 inches from the right top end point to the left top end point, and the back top fabric edge is dimensioned approximately 7.50 inches from the right top end point to the left top end point such that a continuous circumferential top fabric edge is approximately 15.00 inches;

the front bottom convex fabric edge is dimensioned approximately 15.00 inches along the front bottom fabric edge from the right bottom end point to the left bottom end point, and said back bottom convex fabric edge is dimensioned approximately 15.00 inches along the back fabric edge from the right bottom end point to the left bottom end point such that the singularly smooth circumferential curved concave bottom fabric edge is approximately 30.00 inches;

the front bib portion is dimensioned approximately 13.25 inches along a straight line from the right bottom end point to the left bottom end point, and the back bib portion is dimensioned approximately 13.25 inches along a straight line from the right bottom end point to the left bottom end point such that the exterior surface therein is approximately 26.50 inches; and the tubular neck portion is dimensioned at its narrowest with a diameter approximately 5.50 inches such that the tubular neck portion is dimensioned with a circumferential exterior surface of approximately 11.00 inches; and wherein the front side and back side are seamlessly formed by a knitting process of using a double needle bar raschel machines.

* * * * *